US009222254B2

(12) United States Patent
Schabel, Jr.

(10) Patent No.: US 9,222,254 B2
(45) Date of Patent: Dec. 29, 2015

(54) STRUCTURAL ASSEMBLY INSULATION

(71) Applicant: Norman G. Schabel, Jr., Rocky River, OH (US)

(72) Inventor: Norman G. Schabel, Jr., Rocky River, OH (US)

(73) Assignee: SChabel Polymer Technology, LLC, Rocky River ( * ) Notice: Subject to any disclaimer, the term of this patent is extended or adjusted under 35 U.S.C. 154(b) by 54 days.

(21) Appl. No.: 13/795,155

(22) Filed: Mar. 12, 2013

(65) Prior Publication Data

US 2014/0090322 A1 Apr. 3, 2014

Related U.S. Application Data

(60) Provisional application No. 61/609,944, filed on Mar. 13, 2012.

(51) Int. Cl.

| | |
|---|---|
| ***E04B 1/74*** | (2006.01) |
| ***E04B 1/90*** | (2006.01) |
| ***E04B 5/26*** | (2006.01) |
| ***E04B 1/62*** | (2006.01) |
| ***E04B 1/76*** | (2006.01) |

(52) U.S. Cl.

CPC ... *E04B 1/74* (2013.01); *E04B 1/62* (2013.01); *E04B 1/7604* (2013.01); *E04B 1/7654* (2013.01); *E04B 1/90* (2013.01); *E04B 5/261* (2013.01); *E04B 2001/742* (2013.01); *E04B 2001/745* (2013.01); *E04B 2001/746* (2013.01)

(58) Field of Classification Search

CPC ..... E04B 1/74; E04B 1/88; E04B 1/90; E04B 1/7604; E04B 5/261

USPC ..... 52/404.1, 407.3, 742.1, 742.13

See application file for complete search history.

(56) References Cited

U.S. PATENT DOCUMENTS

| | | | |
|---|---|---|---|
| 2,079,374 | A | 5/1937 | Kent |
| 2,978,339 | A | 4/1961 | Veatch et al. |
| 3,028,702 | A | 4/1962 | St Cyr |
| 3,540,977 | A | 11/1970 | Schickedanz |
| 3,567,807 | A | 3/1971 | Shannon |
| 3,625,873 | A | 12/1971 | Wilson |
| 3,822,806 | A | 7/1974 | Grimes |
| 3,987,134 | A | 10/1976 | Shiina et al. |
| 4,032,310 | A | 6/1977 | Ignoffo |
| 4,207,114 | A | 6/1980 | Schuster et al. |
| 4,272,572 | A | 6/1981 | Netherly |
| 4,304,704 | A | 12/1981 | Billings |
| 4,327,192 | A | 4/1982 | Henderson et al. |
| 4,420,442 | A | 12/1983 | Sands |
| 4,421,562 | A | 12/1983 | Sands |
| 4,541,240 | A | 9/1985 | Munro |
| 4,667,768 | A | 5/1987 | Wirt |
| 4,671,909 | A | 6/1987 | Torobin |
| 4,705,715 | A | 11/1987 | DeCoste, Jr. et al. |
| 4,752,625 | A | 6/1988 | Wu et al. |
| 4,757,092 | A | 7/1988 | Hawrylko |
| 4,777,154 | A | 10/1988 | Torobin |

(Continued)

*Primary Examiner* — Ryan Kwiecinski

(74) *Attorney, Agent, or Firm* — Cooper Legal Group LLC

(57) ABSTRACT

A structural assembly (20) providing both a surface (21) and an insulating stratum associated with the surface. The assembly (20) can comprise structural members (23-24) and pods (30) associated with the structural members (23-24). The pods (30) contribute to structural integrity, thermal insulation, and/or sound attenuation. The pods or pod-like material can be used in or on horizontal or vertical cavities, in or on horizontal or vertical surfaces, and/or incorporated into a structural assembly or equipment housing.

11 Claims, 57 Drawing Sheets

(56) References Cited

U.S. PATENT DOCUMENTS 4,782,097 A 11/1988 Jain et al.
4,843,104 A 6/1989 Melber et al.
4,859,711 A 8/1989 Jain et al.
4,871,780 A 10/1989 Sharaby
4,879,856 A 11/1989 Jones et al.
4,910,229 A 3/1990 Okubo
4,953,659 A 9/1990 Norris
4,964,600 A 10/1990 Lee
4,988,567 A 1/1991 Delgado
4,997,504 A 3/1991 Wood
5,024,289 A 6/1991 Merry
5,044,705 A 9/1991 Nelson
5,045,569 A 9/1991 Delgado
5,053,436 A 10/1991 Delgado
5,073,444 A 12/1991 Shanelec
5,126,181 A 6/1992 Figuly et al.
5,165,799 A 11/1992 Wood
5,171,366 A 12/1992 Richards et al.
5,180,752 A 1/1993 Melber et al.
5,190,983 A 3/1993 Bito et al.
5,212,143 A 5/1993 Torobin
5,225,123 A 7/1993 Torobin
5,232,772 A 8/1993 Kong
5,284,881 A 2/1994 Mizuguchi et al.
5,360,832 A 11/1994 Bito et al.
5,397,759 A 3/1995 Torobin
5,403,128 A 4/1995 Thomas
5,403,414 A 4/1995 Corston
5,424,336 A 6/1995 Taniguchi
5,578,650 A 11/1996 Delgado et al.
5,616,413 A 4/1997 Shinozaki et al.
5,618,111 A 4/1997 Porchia et al.
5,697,198 A 12/1997 Ponder et al.
5,718,092 A 2/1998 Corston
5,718,968 A 2/1998 Cutler et al.
5,738,922 A 4/1998 Kobayashi et al.
5,738,941 A 4/1998 Pero et al.
5,753,156 A 5/1998 Shigemori et al.
5,763,498 A 6/1998 Knaus
5,765,330 A * 6/1998 Richard ..... E04C 2/386 52/265
5,777,947 A 7/1998 Ahuja
5,834,526 A 11/1998 Wu et al.
5,851,626 A 12/1998 McCorry et al.
5,916,681 A 6/1999 Cipin
5,994,418 A 11/1999 Weiser et al.
6,007,890 A 12/1999 DeBlander
6,085,865 A 7/2000 Delverdier et al.
6,139,961 A 10/2000 Blankenship et al.
6,189,274 B1 2/2001 Ollikainen
6,235,803 B1 5/2001 Weiser et al.
6,322,044 B1 11/2001 Vangedal-Nielsen
6,365,268 B1 4/2002 Williams et al.
6,378,272 B1 4/2002 Archibald et al.
6,394,652 B2 5/2002 Meyer et al.
6,662,516 B2 * 12/2003 Vandehey ..... E04G 23/0218 52/309.5
6,736,423 B2 5/2004 Simonian et al.
6,743,500 B2 6/2004 Takeda et al.
7,090,441 B1 8/2006 Borgman et al.
7,226,969 B2 6/2007 Ristic-Lehmann et al.
7,241,816 B2 7/2007 Kunimi et al.
7,351,752 B2 4/2008 Miki et al.
7,550,521 B2 6/2009 Kim et al.
7,770,691 B2 * 8/2010 Schabel, Jr. ..... B60R 13/08 181/259
7,790,302 B2 9/2010 Ladely (Guevara)
7,820,094 B2 10/2010 Ladely (Guevara)
7,956,147 B2 6/2011 Shirai et al.
7,964,246 B2 6/2011 Fellinger
7,964,272 B2 6/2011 Guevara et al.
8,029,617 B2 10/2011 Guevara et al.
8,067,089 B2 11/2011 Schwantes
8,087,432 B2 1/2012 Rudi et al.
8,088,482 B2 1/2012 Glorioso, Jr. et al.
2001/0031355 A1 10/2001 Nakagawa et al.
2002/0073641 A1 * 6/2002 Menchetti ..... E04B 2/7411 52/404.1
2003/0138632 A1 7/2003 Huang
2004/0096665 A1 5/2004 Hoehne et al.
2004/0121102 A1 6/2004 Chen et al.
2004/0131853 A1 7/2004 Mushiake et al.
2004/0167241 A1 8/2004 Scherzer et al.
2004/0191518 A1 9/2004 Naito et al.
2004/0231916 A1 11/2004 Englert et al.
2005/0055973 A1 * 3/2005 Hagen ..... E04B 1/7604 52/741.1
2005/0100728 A1 5/2005 Ristic-Lehmann et al.
2005/0234143 A1 10/2005 Kim et al.
2006/0000155 A1 * 1/2006 Wagner ..... E04B 1/7604 52/22
2006/0118355 A1 6/2006 Blomeling et al.
2006/0167122 A1 7/2006 Haraguchi et al.
2006/0223897 A1 10/2006 Sasaki
2006/0240258 A1 10/2006 Sato et al.
2006/0246289 A1 11/2006 Ueda et al.
2006/0254208 A1 * 11/2006 Clark et al. ..... 52/794.1
2006/0275598 A1 12/2006 Shimamura et al.
2007/0074474 A1 * 4/2007 Jannelle ..... E04B 1/7604 52/309.4
2007/0125780 A1 6/2007 Shiina
2007/0141281 A1 6/2007 Eadara et al.
2007/0193164 A1 8/2007 Gilbert
2007/0237958 A1 10/2007 Eramo
2007/0254972 A1 11/2007 Haraguchi
2007/0259183 A1 11/2007 Knobloch
2007/0272320 A1 11/2007 Roberson
2008/0069960 A1 3/2008 Abu-Shanab et al.
2008/0085566 A1 4/2008 Swager et al.
2008/0108717 A1 5/2008 Tokoro et al.
2008/0176971 A1 7/2008 Sugawara et al.
2009/0181250 A1 7/2009 Zmarsly et al.
2009/0246445 A1 * 10/2009 Peterson ..... B29B 17/00 428/68
2009/0306250 A1 12/2009 Billings
2010/0050562 A1 * 3/2010 Kasboske ..... B29C 70/66 52/742.1
2010/0204349 A1 8/2010 Inohara et al.
2010/0319282 A1 12/2010 Ruland
2011/0023763 A1 2/2011 Morgan et al.
2014/0137497 A1 * 5/2014 Bahnmiller ..... B32B 5/14 52/309.4

* cited by examiner

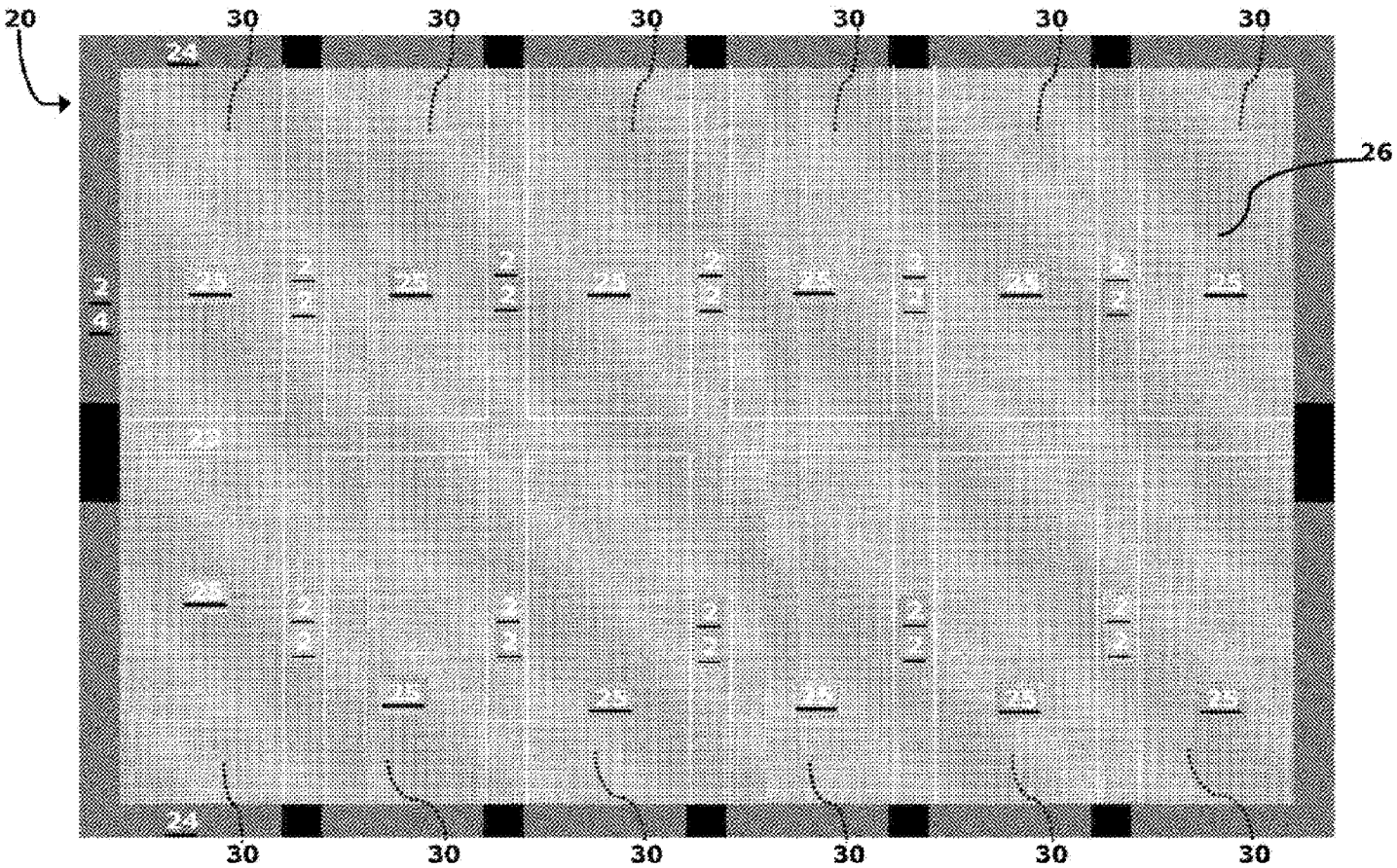
20
30
30
30
30
30
30
30
30
30
30
26
24
24
28
28
28

V30=V26
V30=V60

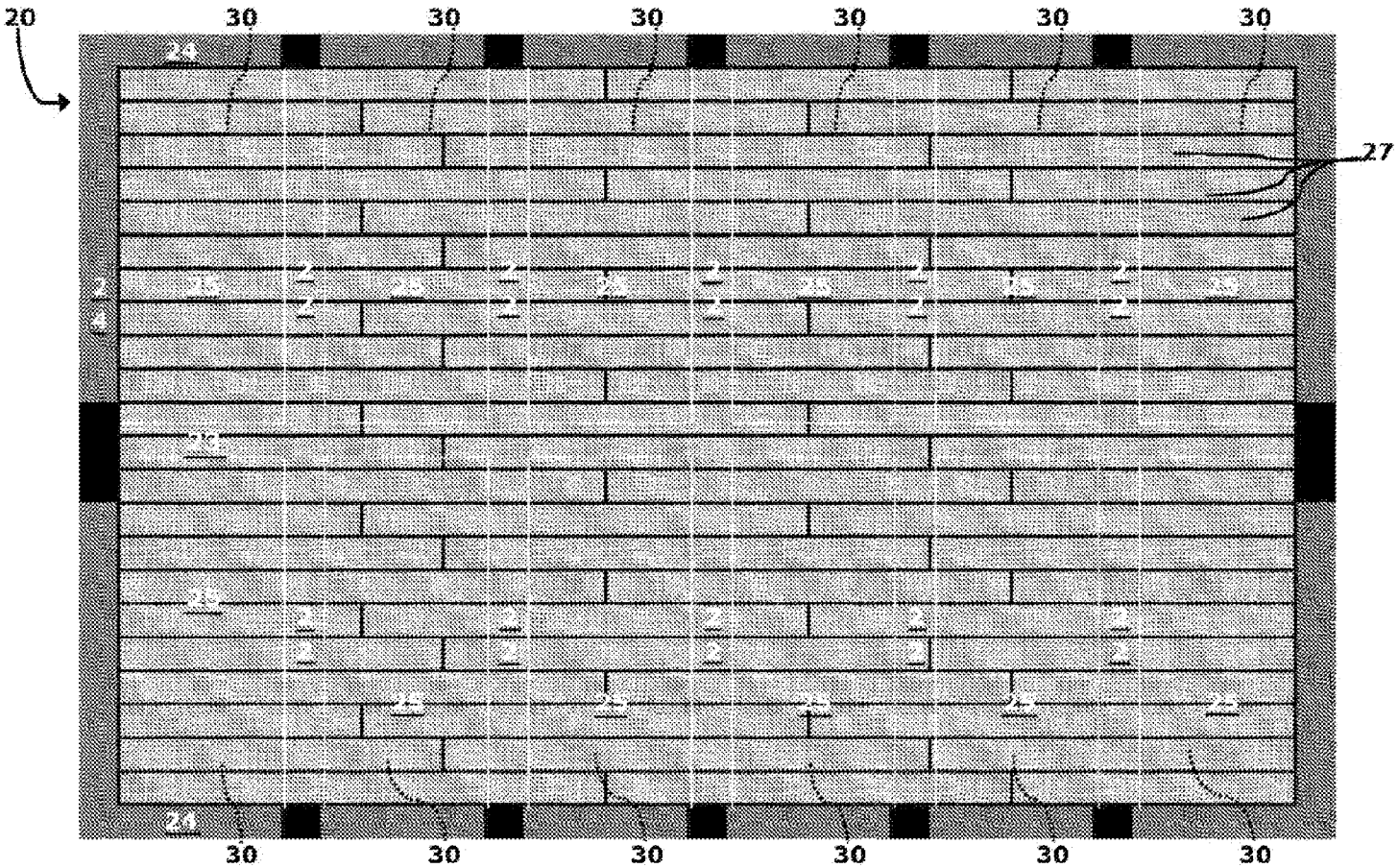
20
30
30
30
30
30
30
30
30
30
30
27
24
24
26
26
28
28
22
22
34
34
36
36
38
38
40
40
42
42
44
44
46
46
48
48
50
50
52
52
54
54
56
56
58
58
60
60
62
62
64
64
66
66
68
68
70
70
72
72

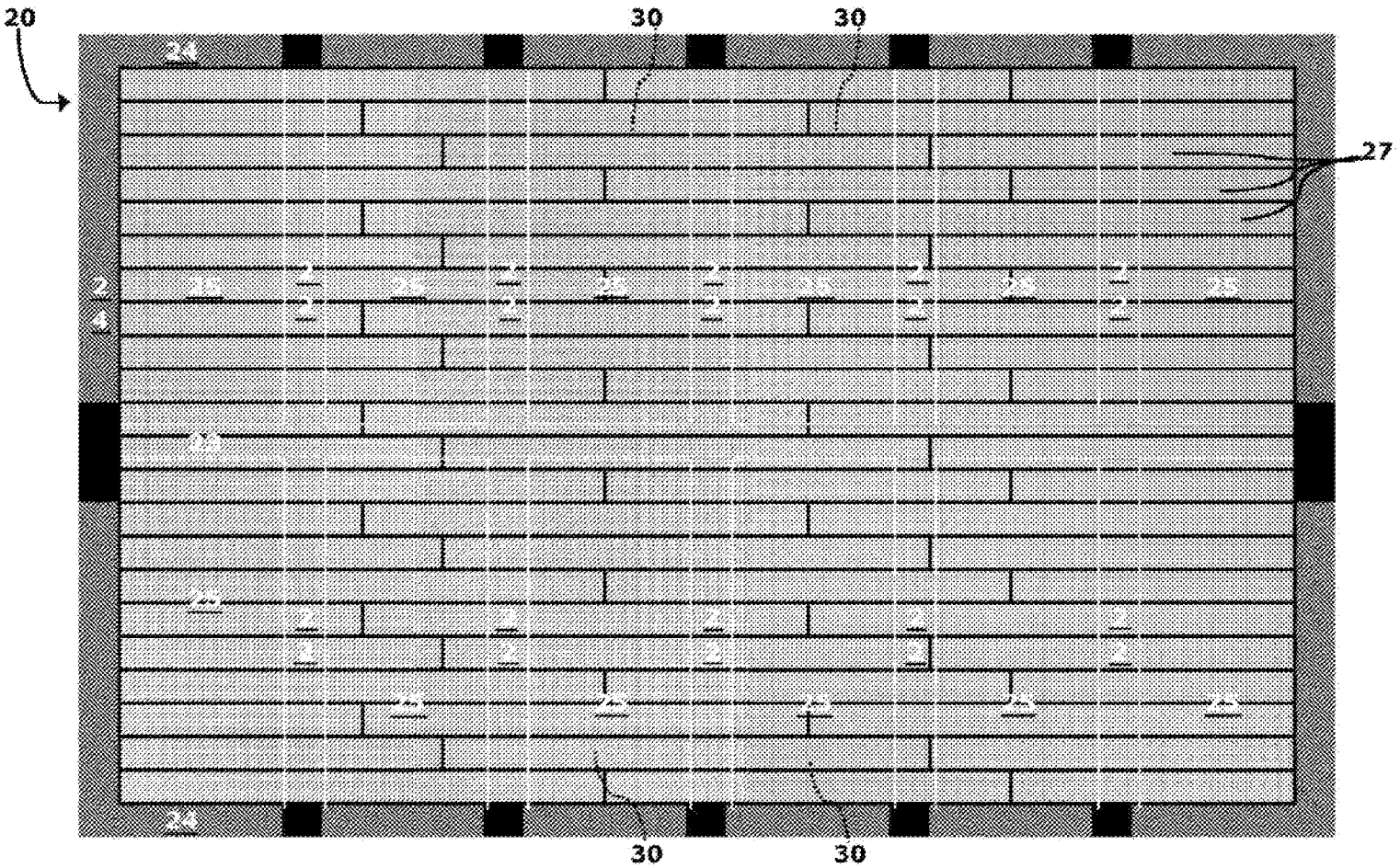
20
30
30
30
30
24
24
27
28
28
28

V30=V26
V30=V60

STRUCTURAL ASSEMBLY INSULATION

RELATED APPLICATION

This application claims priority under 35 USC 119(e) to U.S. Provisional Patent Application No. 61/609,944 filed on Mar. 13, 2012. The entire disclosure of this provisional patent application is hereby incorporated by reference.

BACKGROUND

A building can include a floor assembly or vertical wall cavity comprising a series of joists extending perpendicularly between supporting members such as walls, beams, and/or girders. In a residential home setting, for example, the attic joists and supporting members typically form a grid of rectangular cavities. These cavities are usually about 4 to about 16 inches deep, about 10 to about 30 inches wide, and about 4 to about 20 feet long.

SUMMARY

A structural assembly includes cavity-occupying pods which contribute both to its load-supporting capacity and thermal-insulating ability. The pods each include solidified carrier with pellets dispersed therein and are created by fluidly introducing a pod-making material into the cavities. The volume of each pod is substantially equal to the volume of the introduced pod-making material, and remains so for an extended time period (e.g., at least 5 years, at least 10 years, at least 20 years, etc.).

DRAWINGS

FIG. 4A shows an example floor-assembly arrangement and associated pod-making step;

FIG. 5A shows an example floor-assembly arrangement and associated pod-making step;

FIG. 5C shows an example floor-assembly arrangement and associated pod-making step;

FIG. 10C shows an example pod constitution and corresponding pod-making materials;

FIG. 10D shows an example pod constitution and corresponding pod-making materials;

FIG. 10F shows an example pod constitution and corresponding pod-making materials;

FIG. 11A shows an example pod constitution and corresponding pod-making materials;

FIG. 11C shows an example pod constitution and corresponding pod-making materials;

FIG. 12B shows an example pod constitution and corresponding pod-making materials;

FIG. 12C shows an example pod constitution and corresponding pod-making materials;

FIG. 12D shows an example pod constitution and corresponding pod-making materials;

FIG. 13B shows an example pod constitution and corresponding pod-making materials;

FIG. 13D shows an example pod constitution and corresponding pod-making materials;

DESCRIPTION

Figure 1:
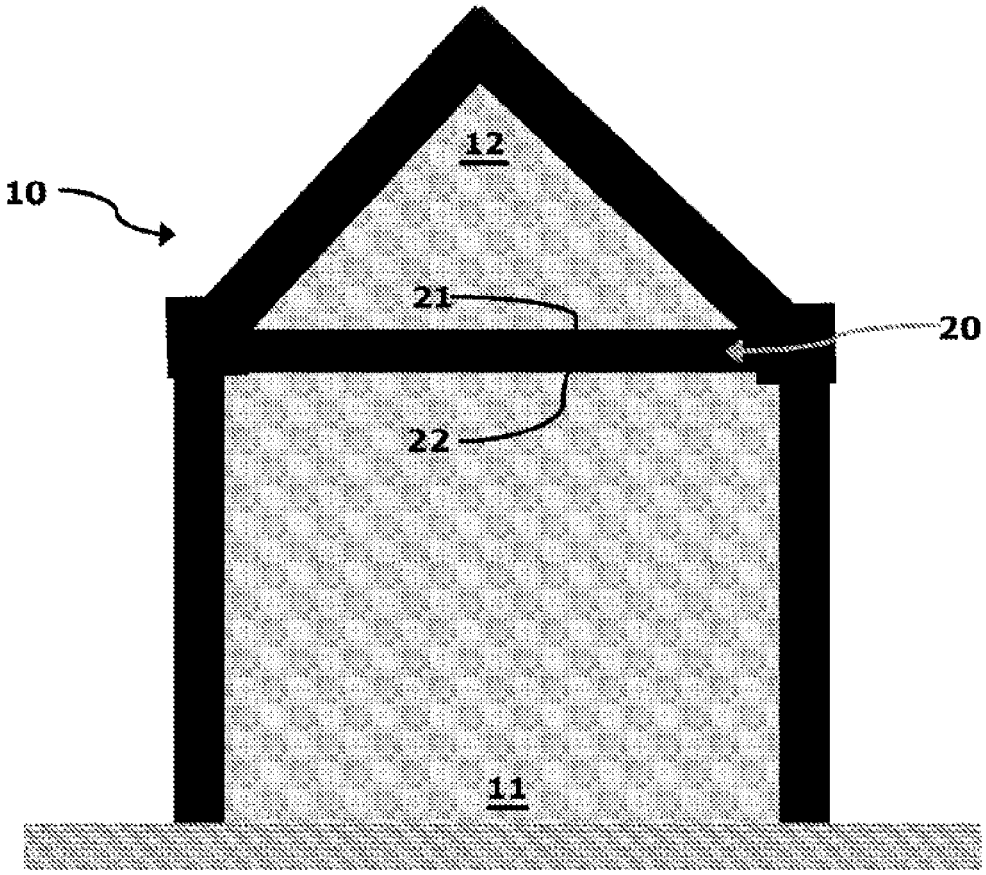
FIG. 1 shows a building having an attic floor assembly.
Figure 2A:
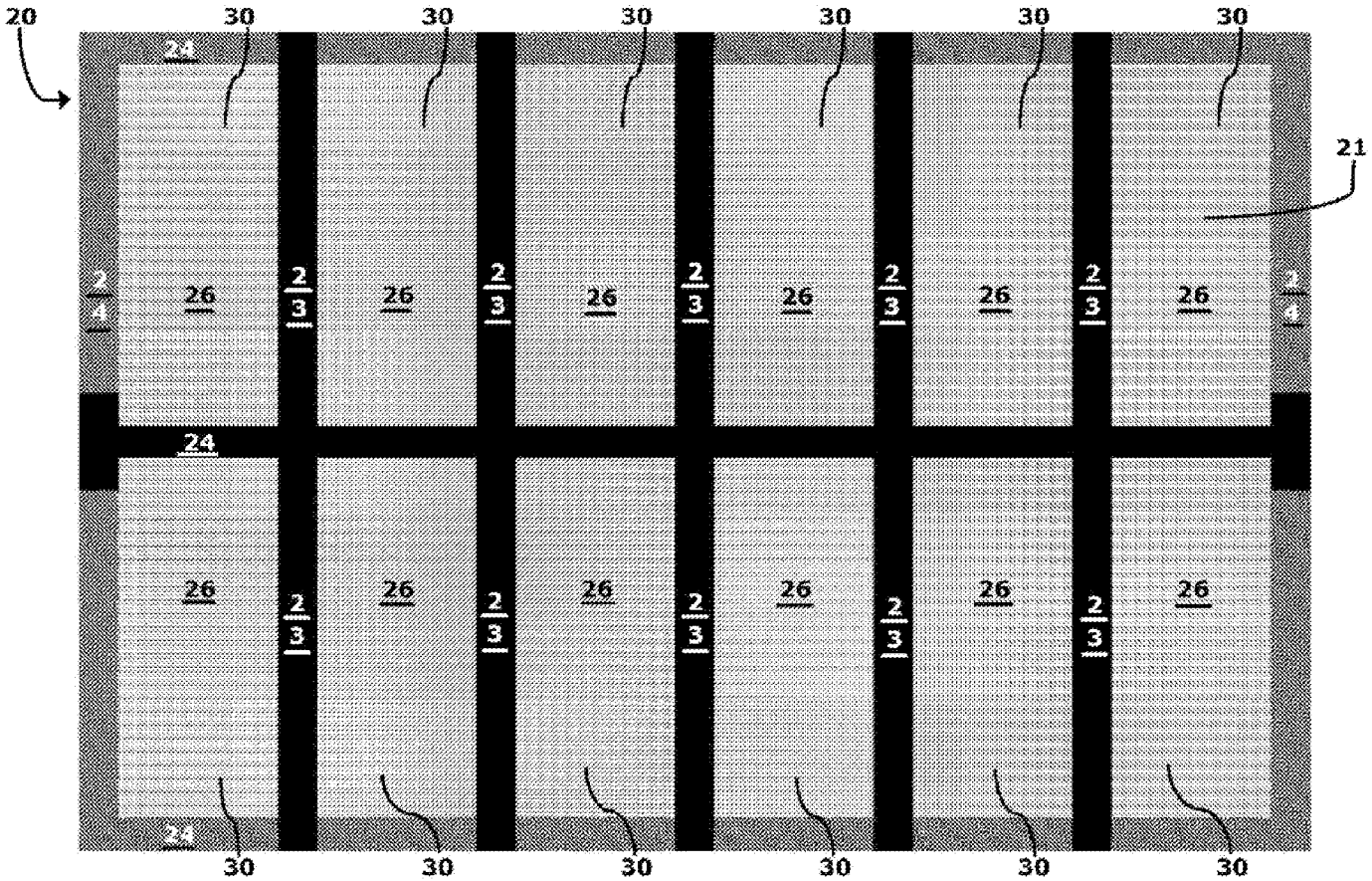
FIG. 2A shows an example floor-assembly arrangement and associated pod-making step.
Figures 2B, 10A:
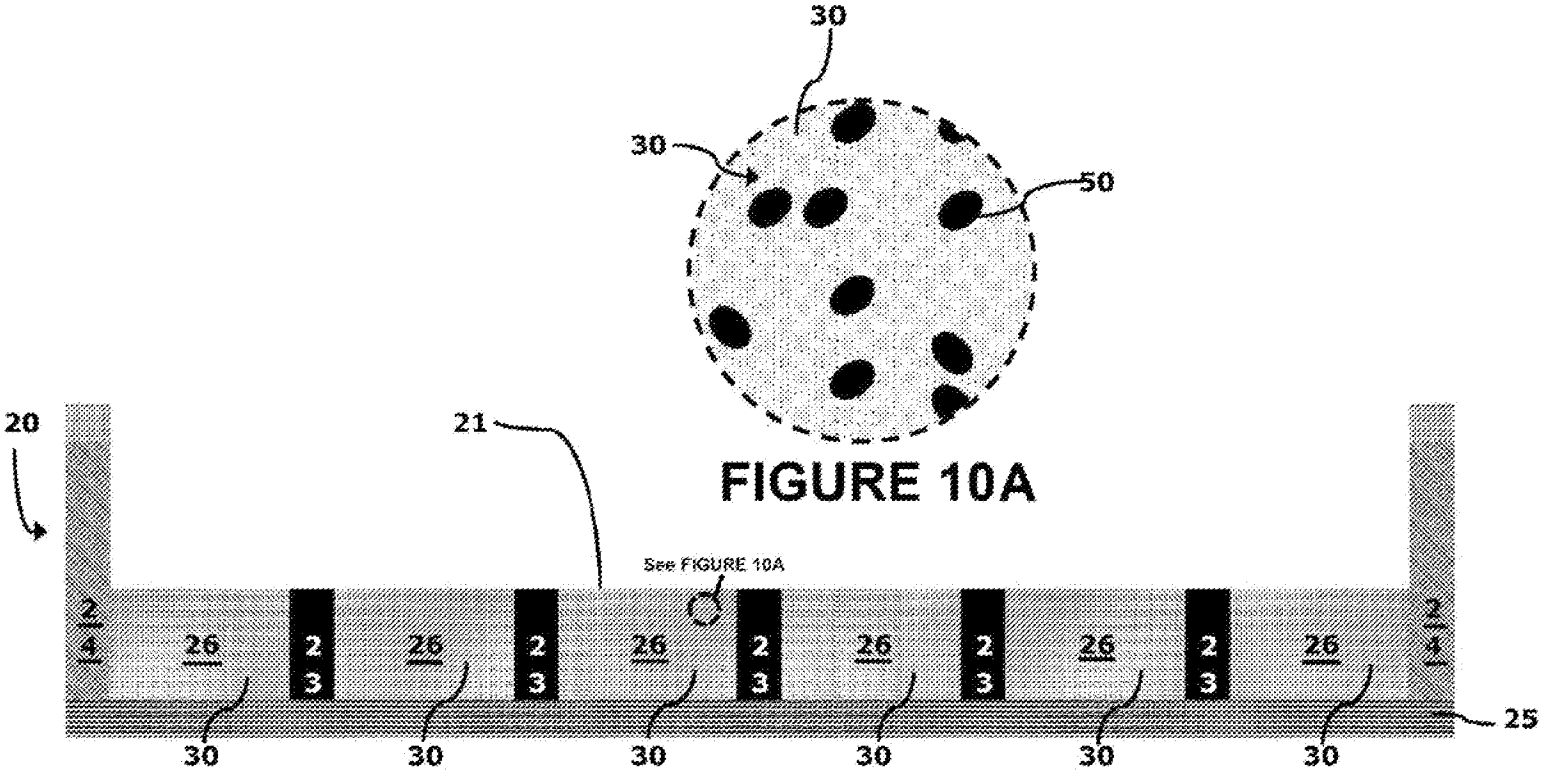
FIG. 2B shows an example floor-assembly arrangement and associated pod-making step.
FIG. 10A shows an example pod constitution and corresponding pod-making materials.
Figure 2C:
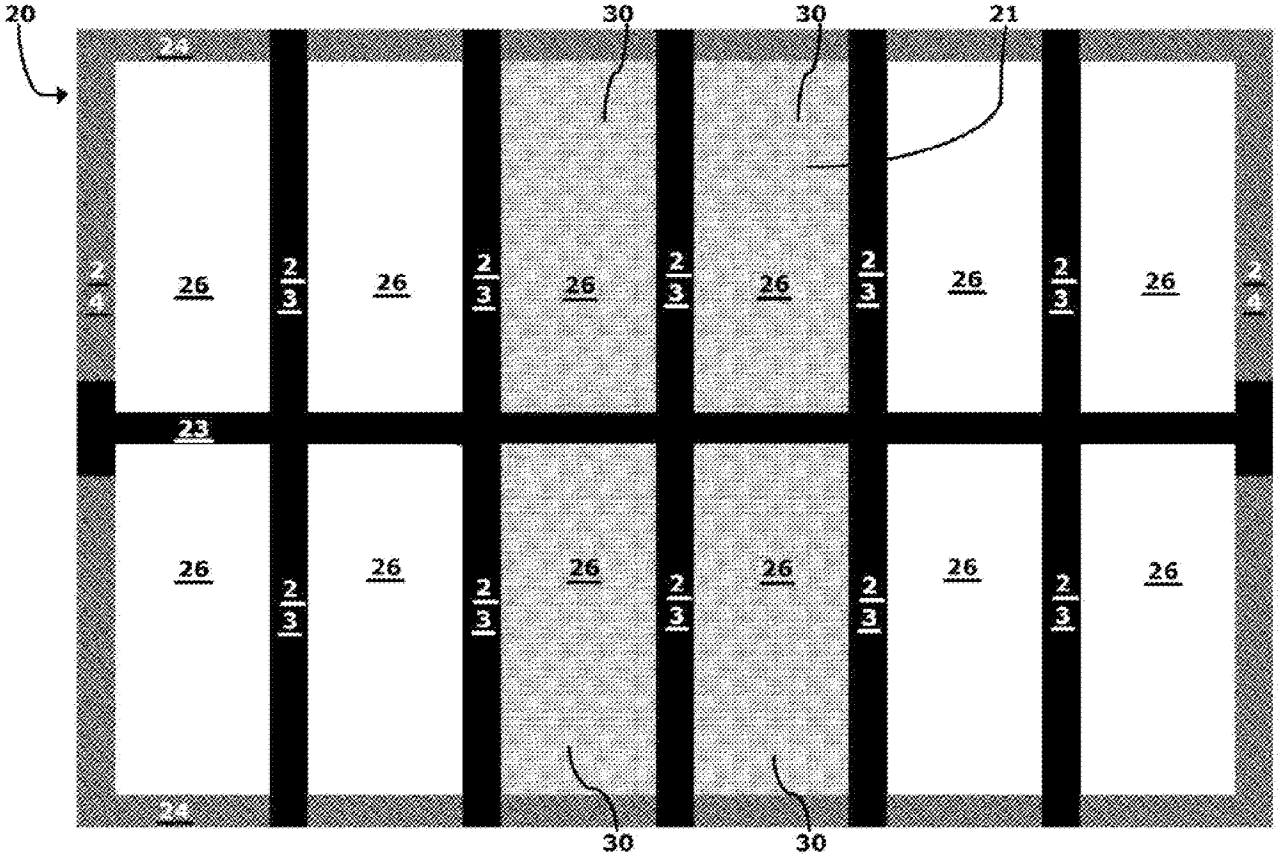
FIG. 2C shows an example floor-assembly arrangement and associated pod-making step.
Figures 2D, 10B:
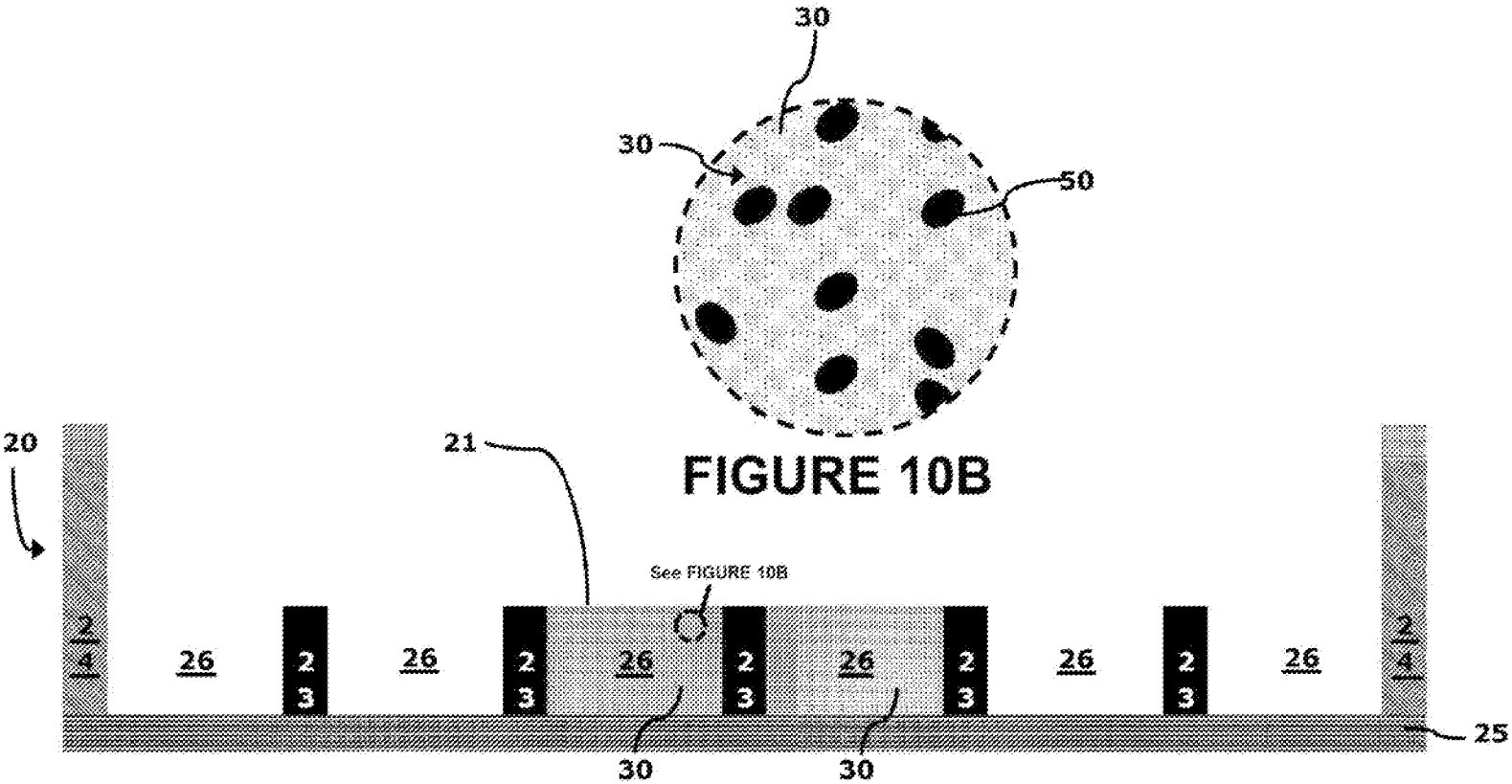
FIG. 2D shows an example floor-assembly arrangement and associated pod-making step.
FIG. 10B shows an example pod constitution and corresponding pod-making materials.
Figure 2E:
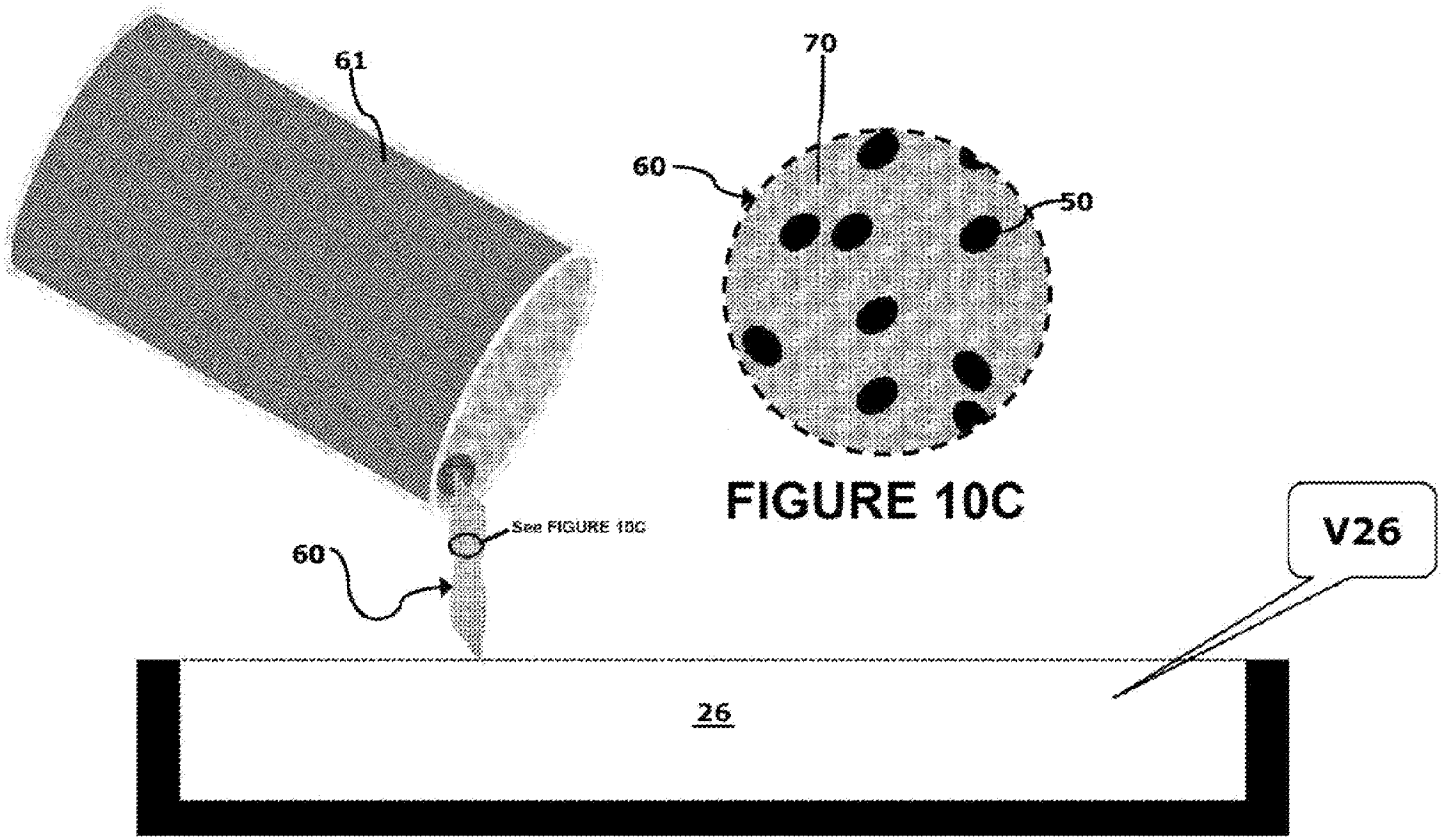
FIG. 2E shows an example floor-assembly arrangement and associated pod-making step.
Figure 2F:
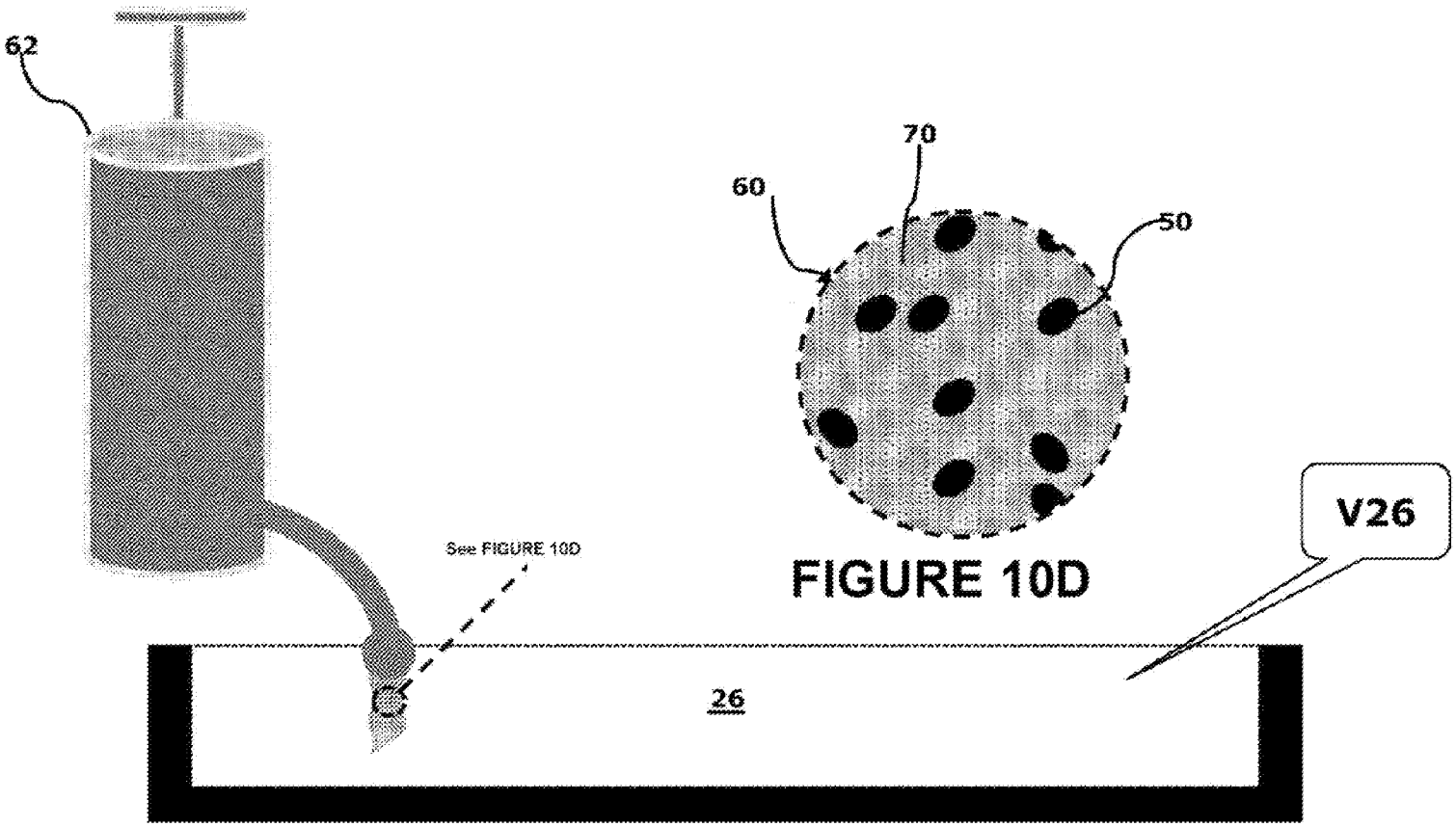
FIG. 2F shows an example floor-assembly arrangement and associated pod-making step.
Figures 2G, 10E:
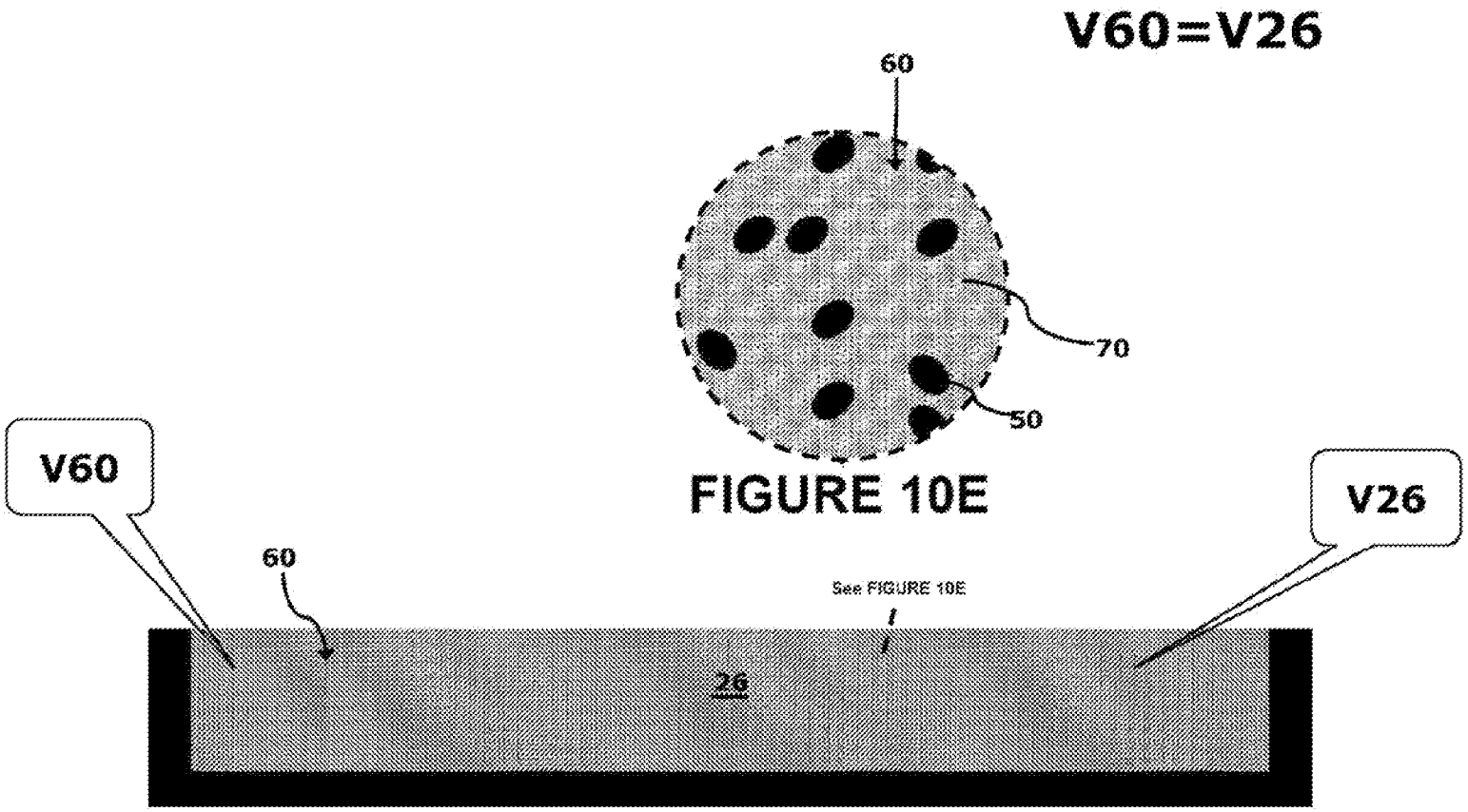
FIG. 2G shows an example floor-assembly arrangement and associated pod-making step.
FIG. 10E shows an example pod constitution and corresponding pod-making materials.
Figure 2H:
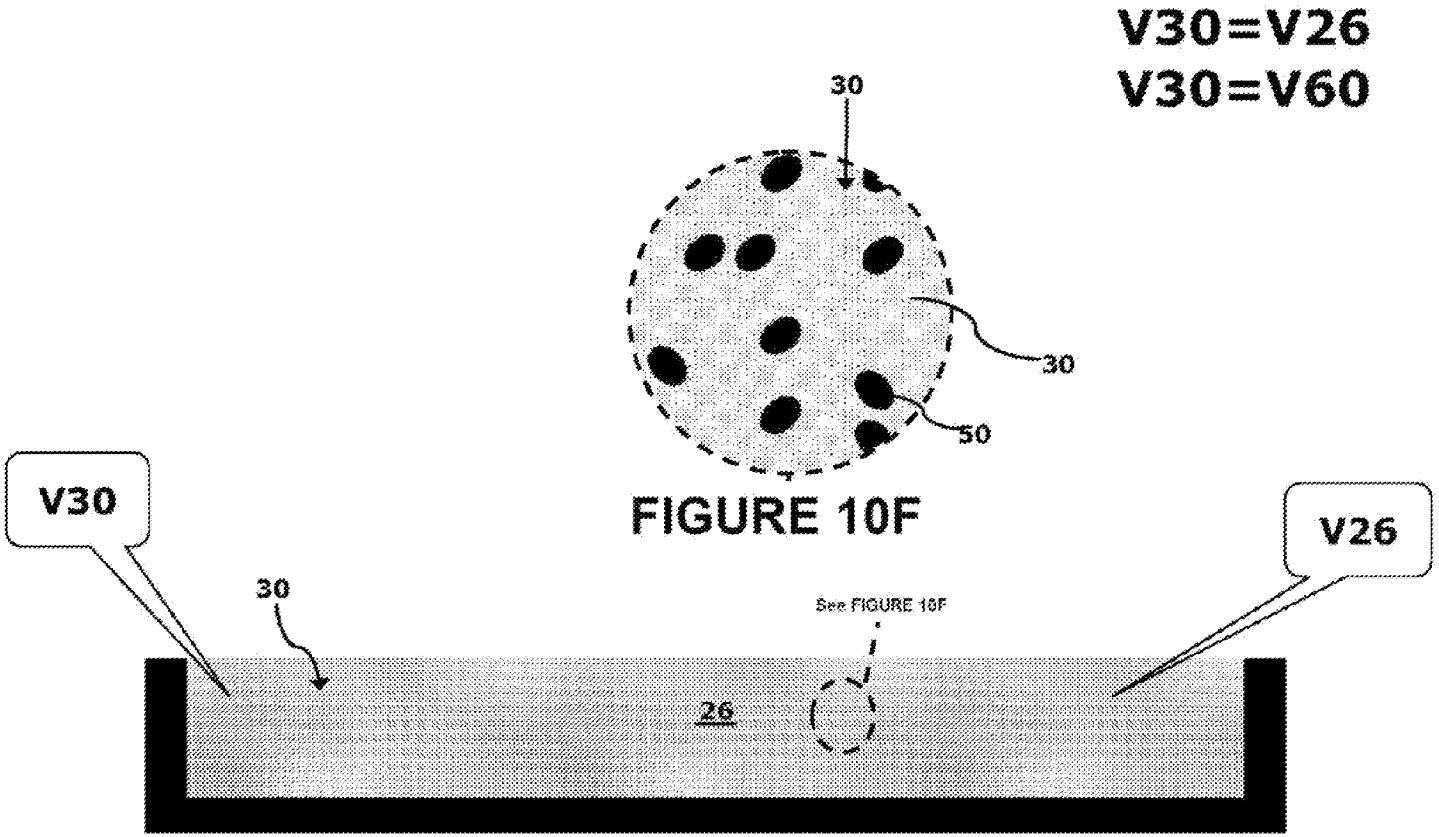
FIG. 2H shows an example floor-assembly arrangement and associated pod-making step.
Figure 2I:
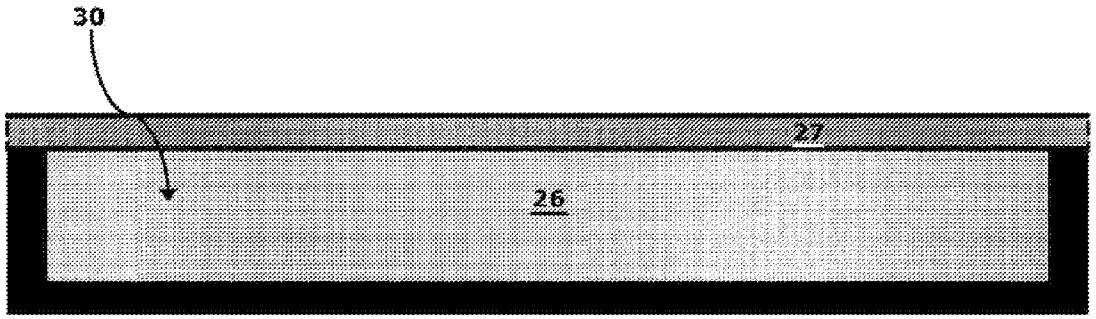
FIG. 2I shows an example floor-assembly arrangement and associated pod-making step.
Figure 2J:
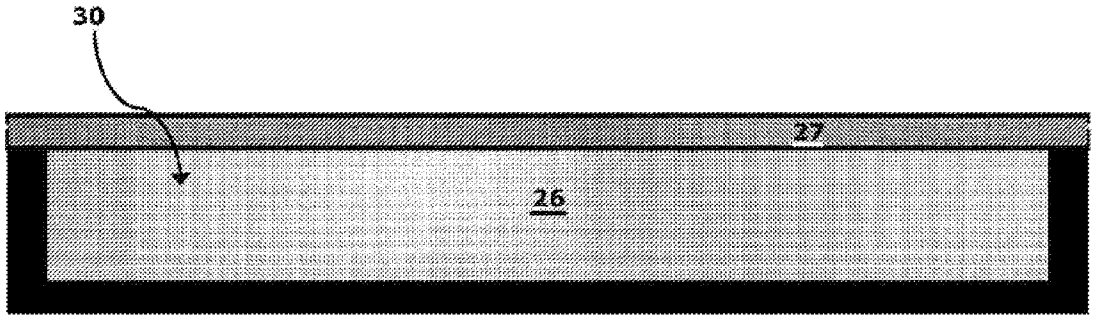
FIG. 2J shows an example floor-assembly arrangement and associated pod-making step.
Figure 3A:
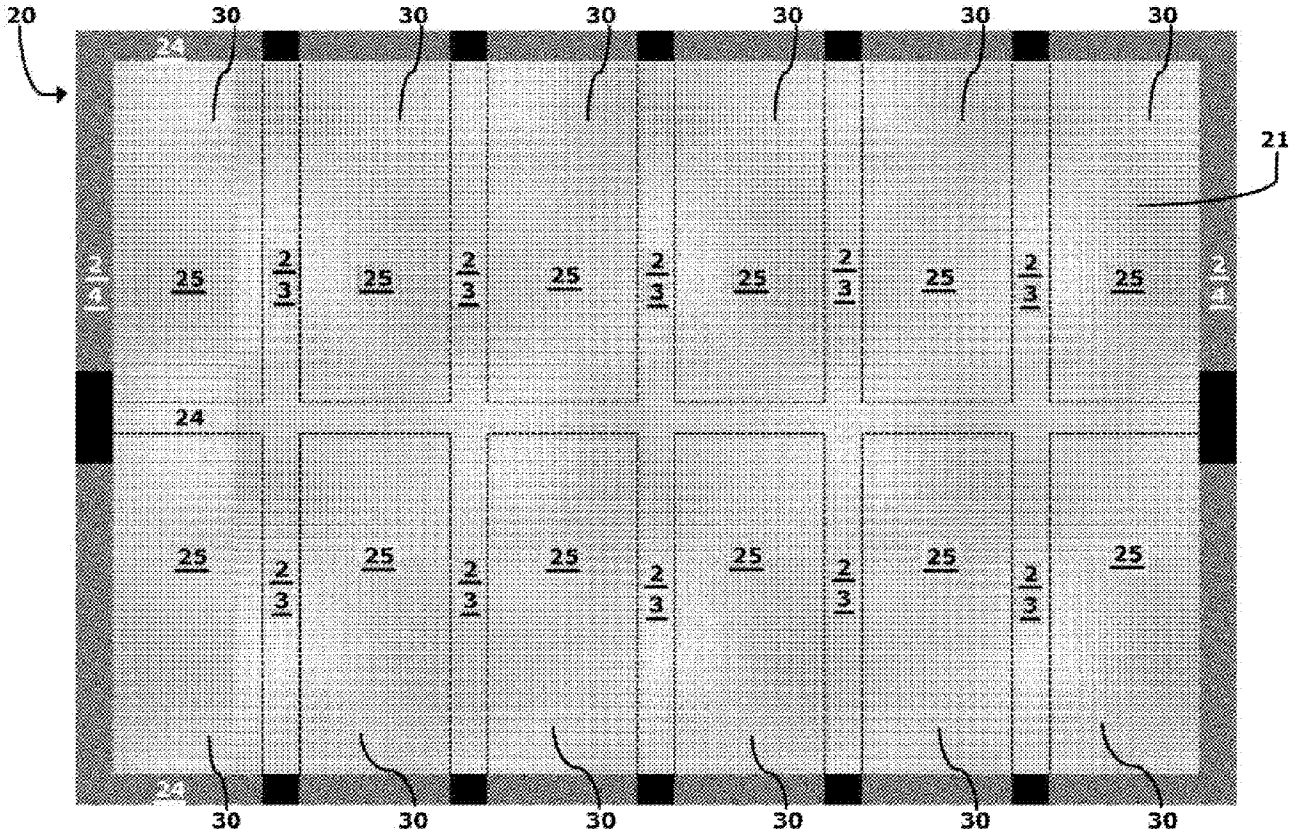
FIG. 3A shows an example floor-assembly arrangement and associated pod-making step.
Figure 3B:
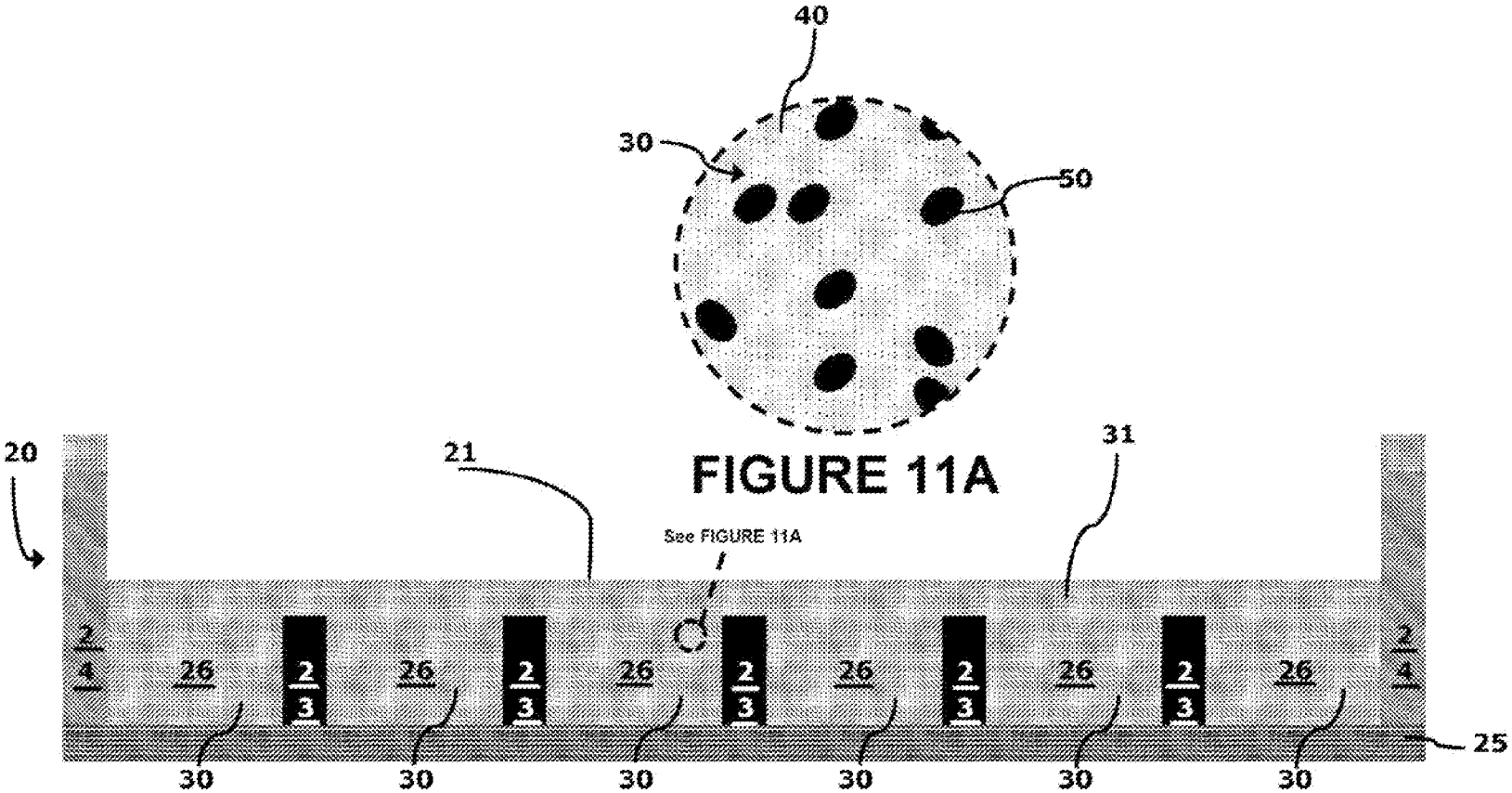
FIG. 3B shows an example floor-assembly arrangement and associated pod-making step.
Figure 3C:
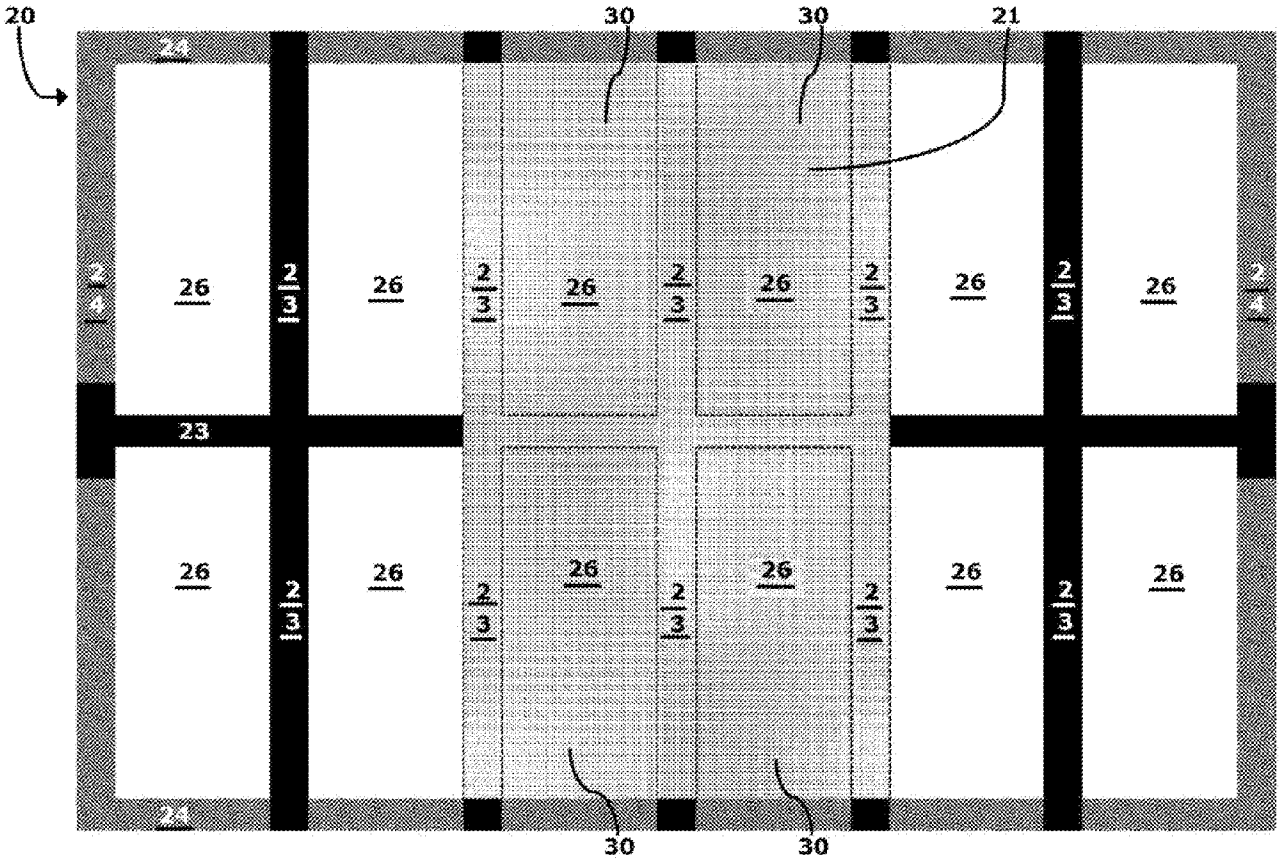
FIG. 3C shows an example floor-assembly arrangement and associated pod-making step.
Figure 11B:
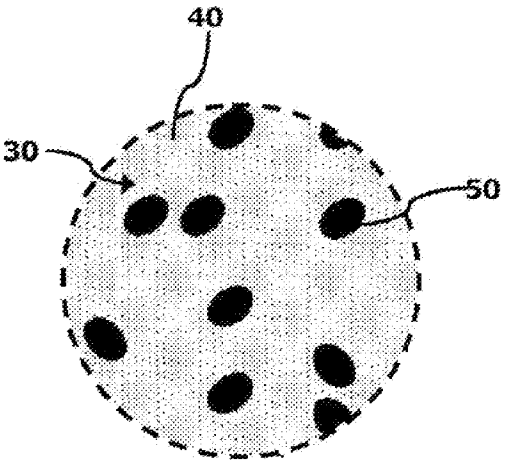
FIG. 11B shows an example pod constitution and corresponding pod-making materials.
Figure 3D:
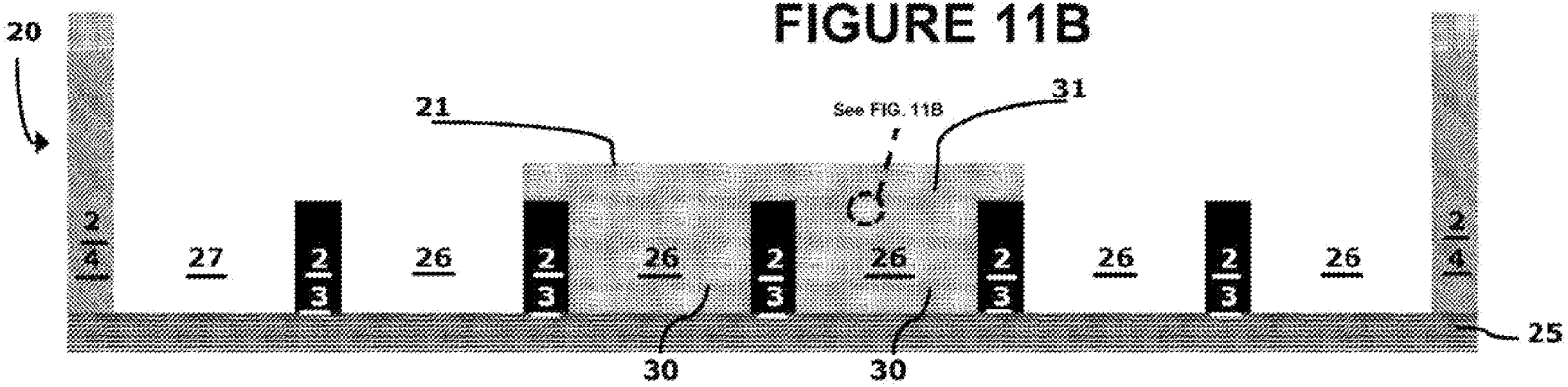
FIG. 3D shows an example floor-assembly arrangement and associated pod-making step.
Figure 3E:
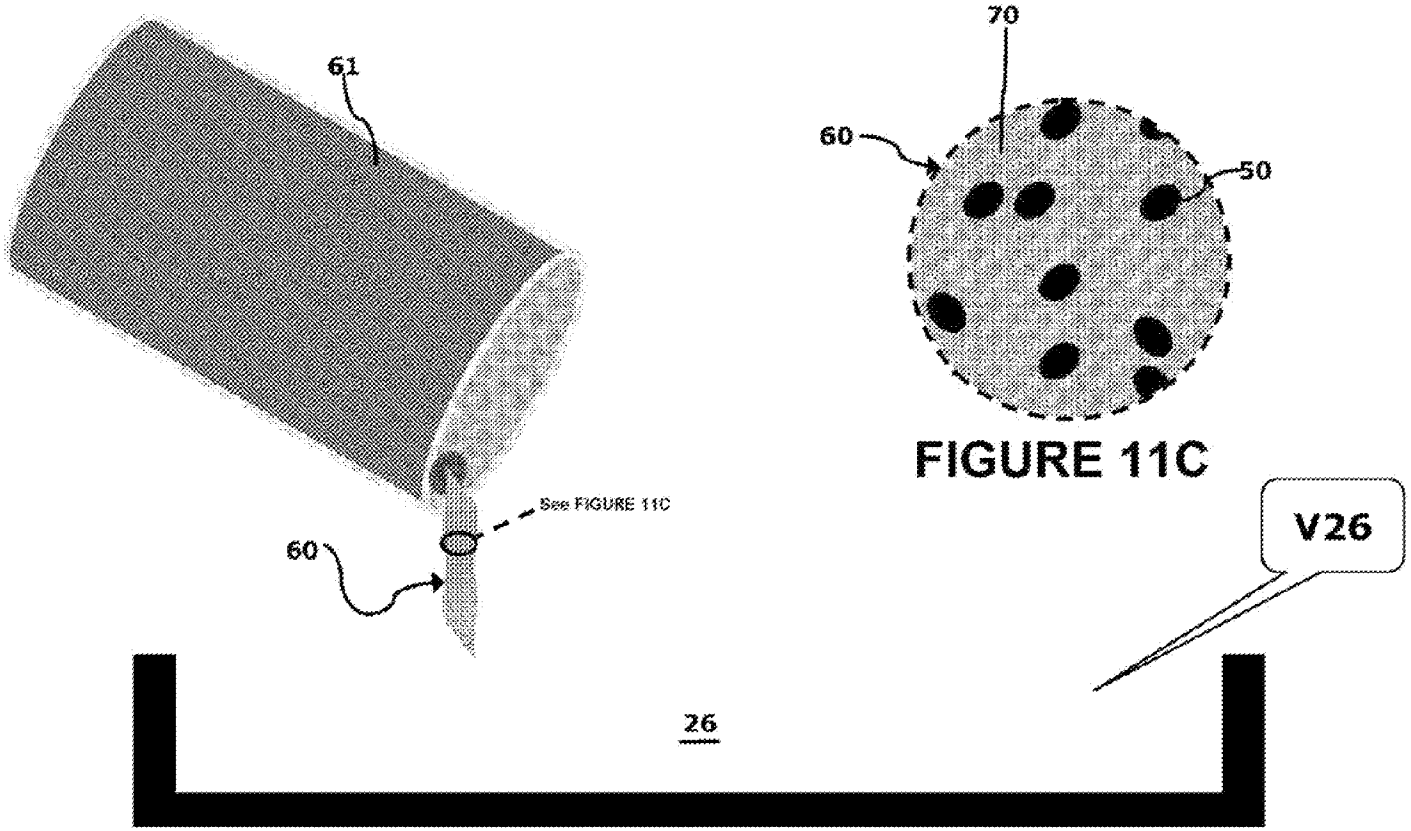
FIG. 3E shows an example floor-assembly arrangement and associated pod-making step.
Figures 3F, 11D:
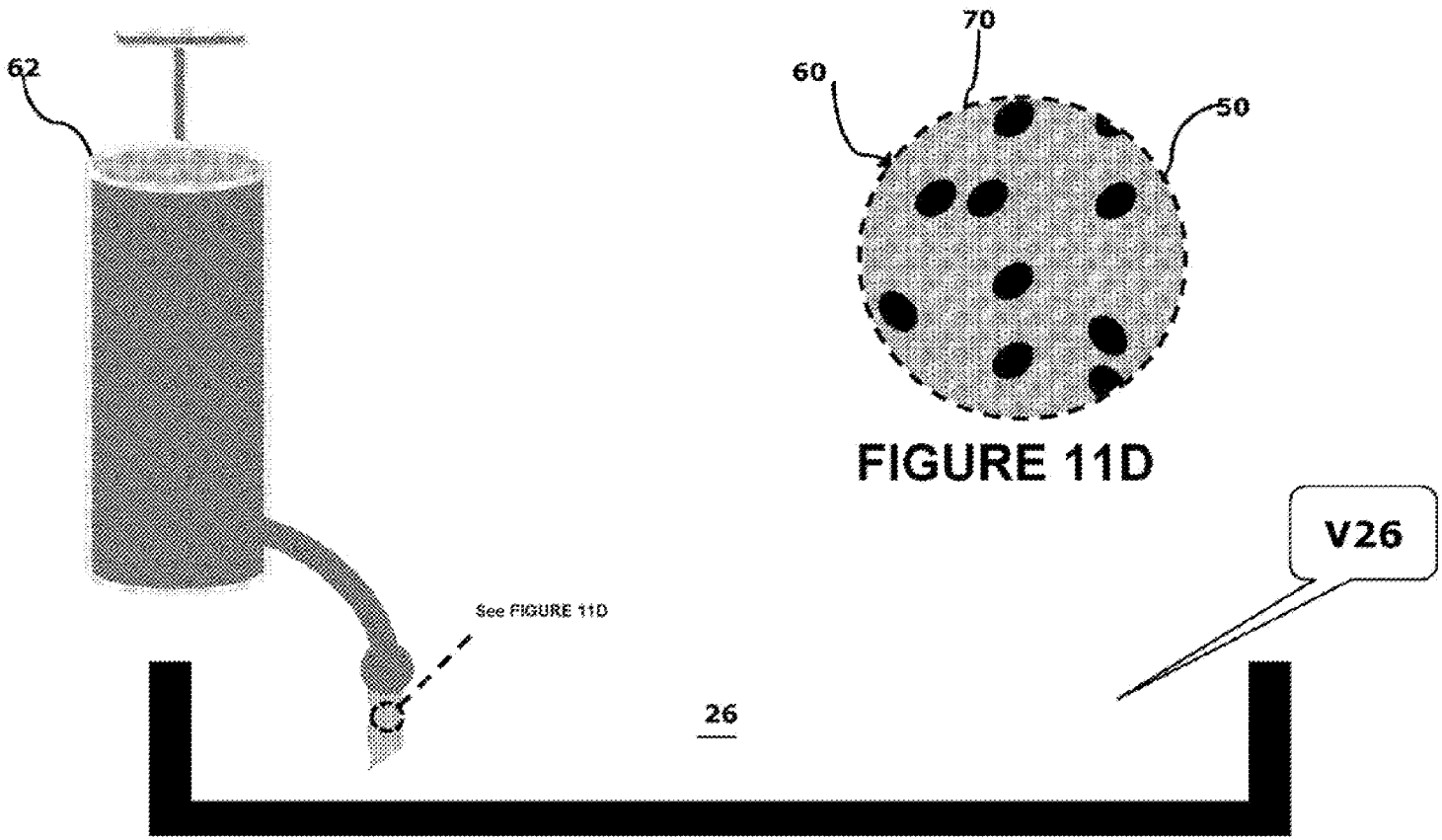
FIG. 3F shows an example floor-assembly arrangement and associated pod-making step.
FIG. 11D shows an example pod constitution and corresponding pod-making materials.
Figures 3G, 11E:
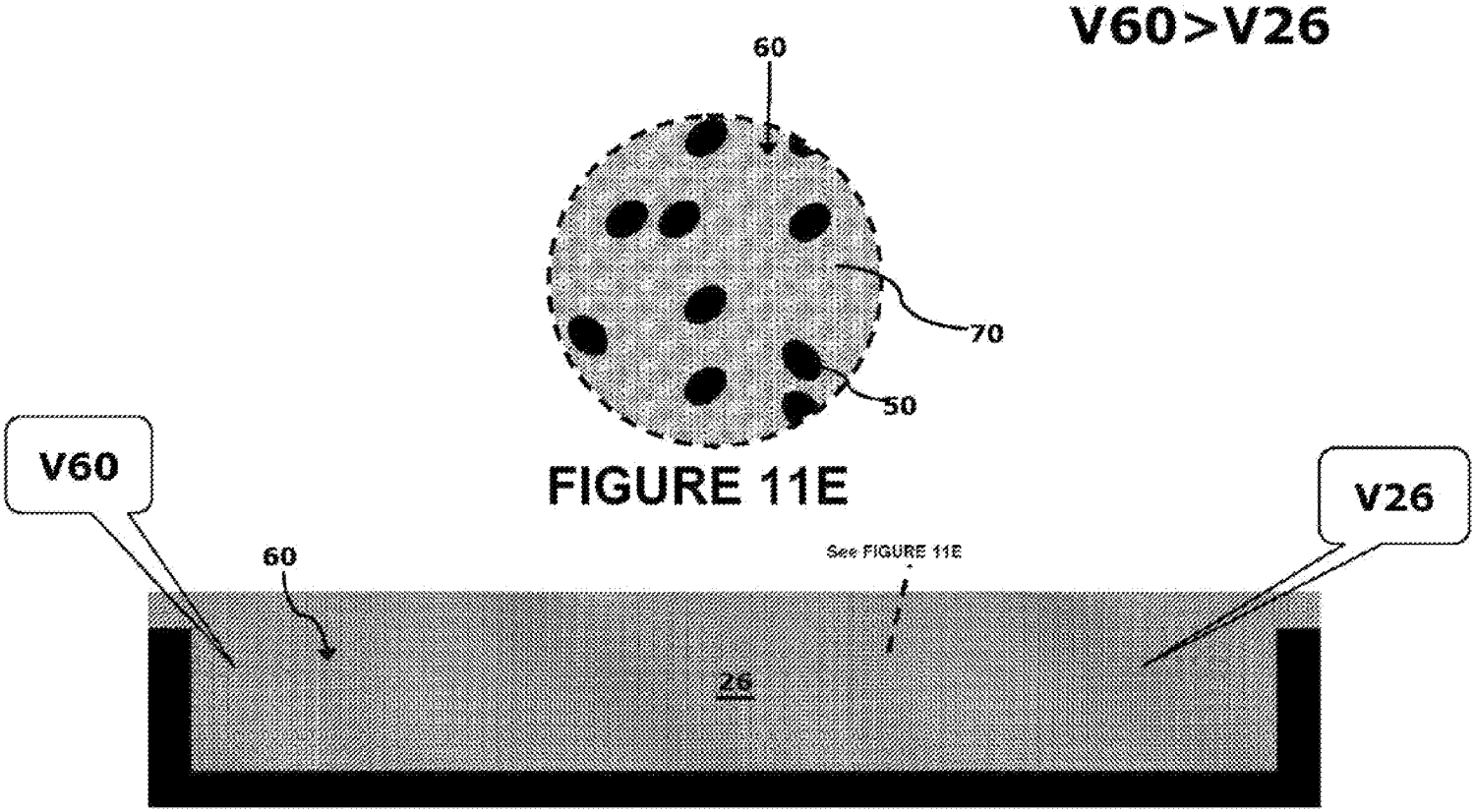
FIG. 3G shows an example floor-assembly arrangement and associated pod-making step.
FIG. 11E shows an example pod constitution and corresponding pod-making materials.
Figure 11F:
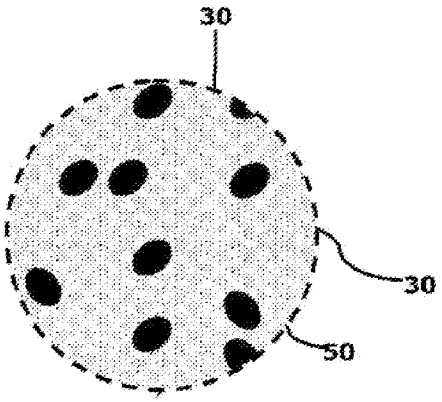
FIG. 11F shows an example pod constitution and corresponding pod-making materials.
Figure 3H:
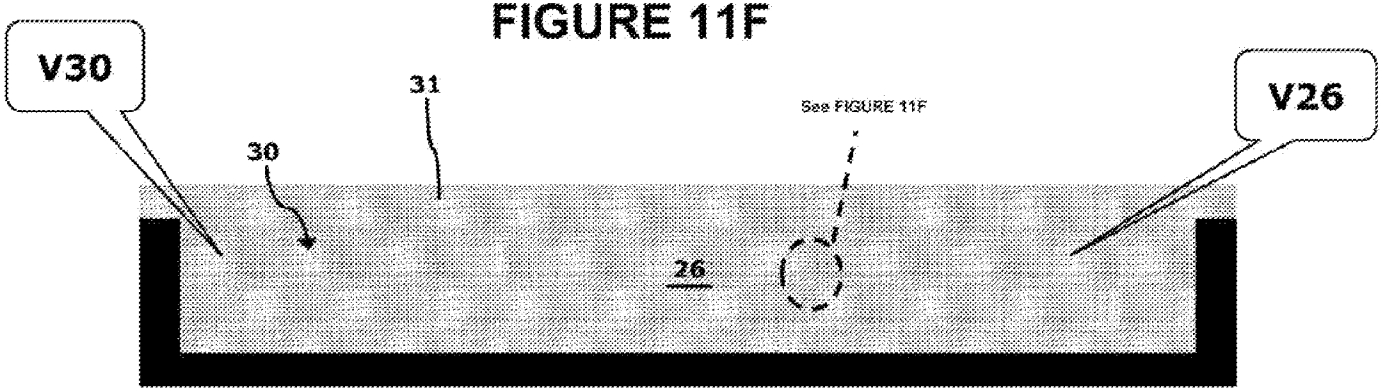
FIG. 3H shows an example floor-assembly arrangement and associated pod-making step.
Figure 3I:
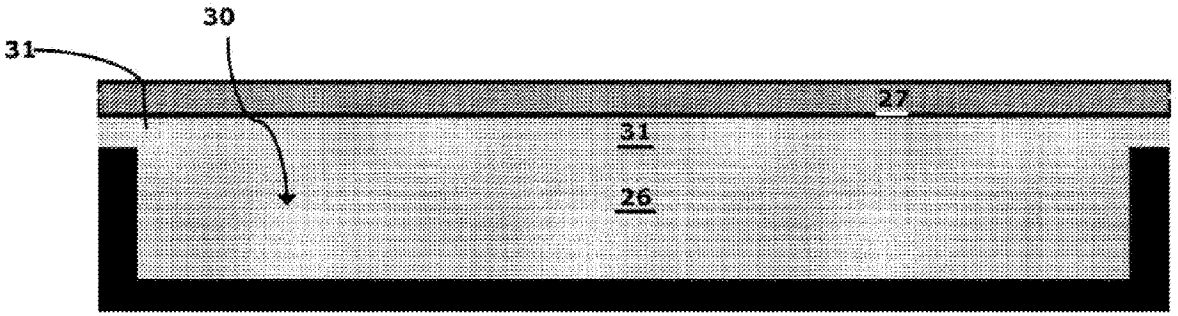
FIG. 3I shows an example floor-assembly arrangement and associated pod-making step.
Figure 3J:
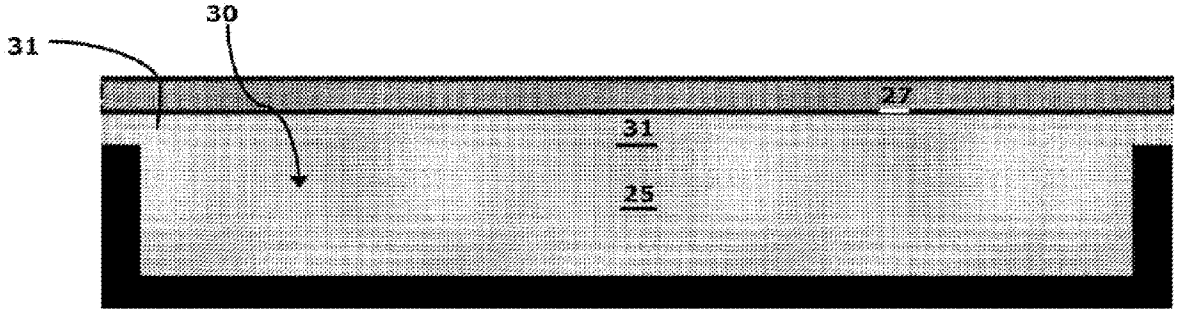
FIG. 3J shows an example floor-assembly arrangement and associated pod-making step.
Figure 4B:
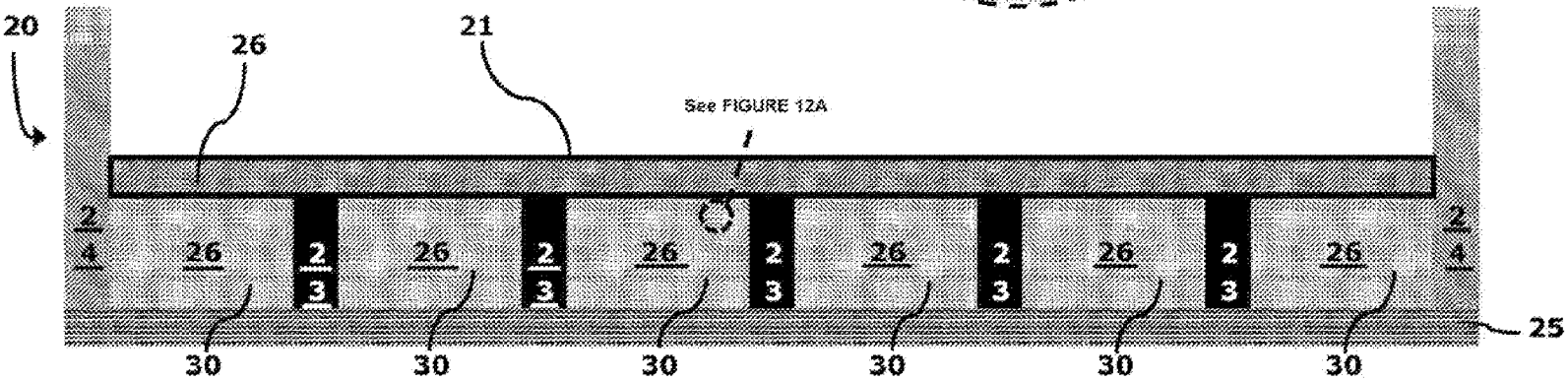
FIG. 4B shows an example floor-assembly arrangement and associated pod-making step.
Figure 4C:
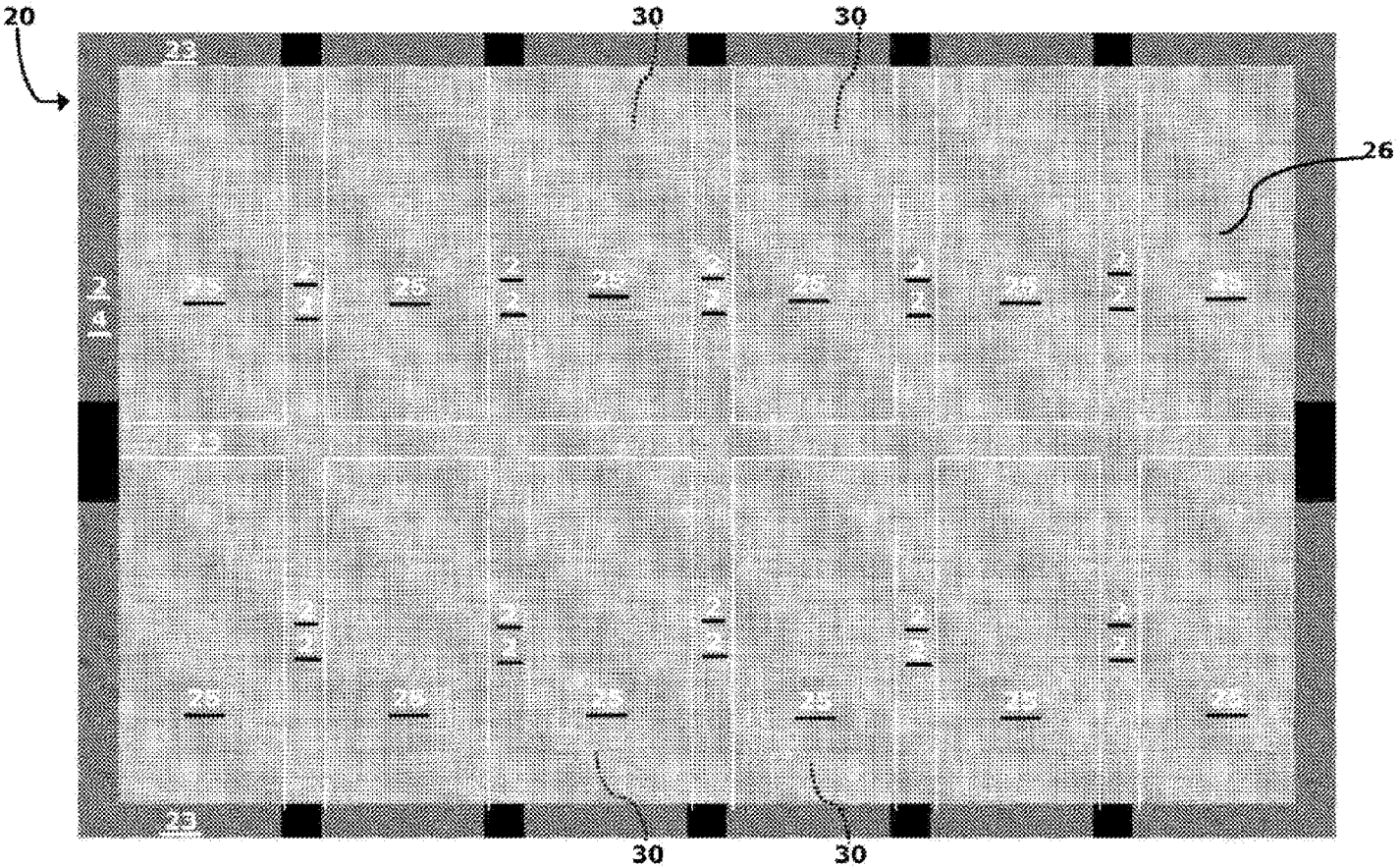
FIG. 4C shows an example floor-assembly arrangement and associated pod-making step.
Figure 4D:
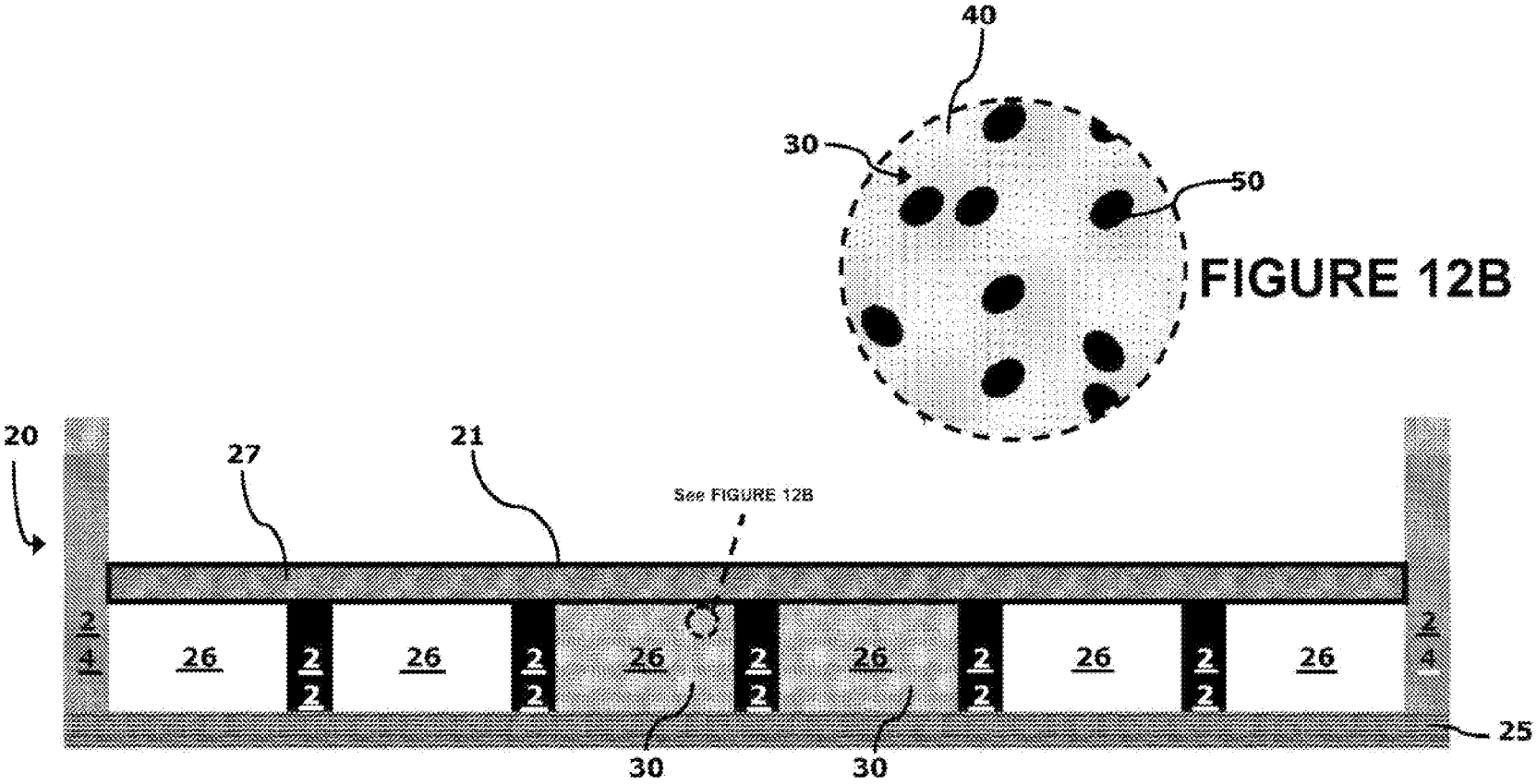
FIG. 4D shows an example floor-assembly arrangement and associated pod-making step.
Figure 4E:
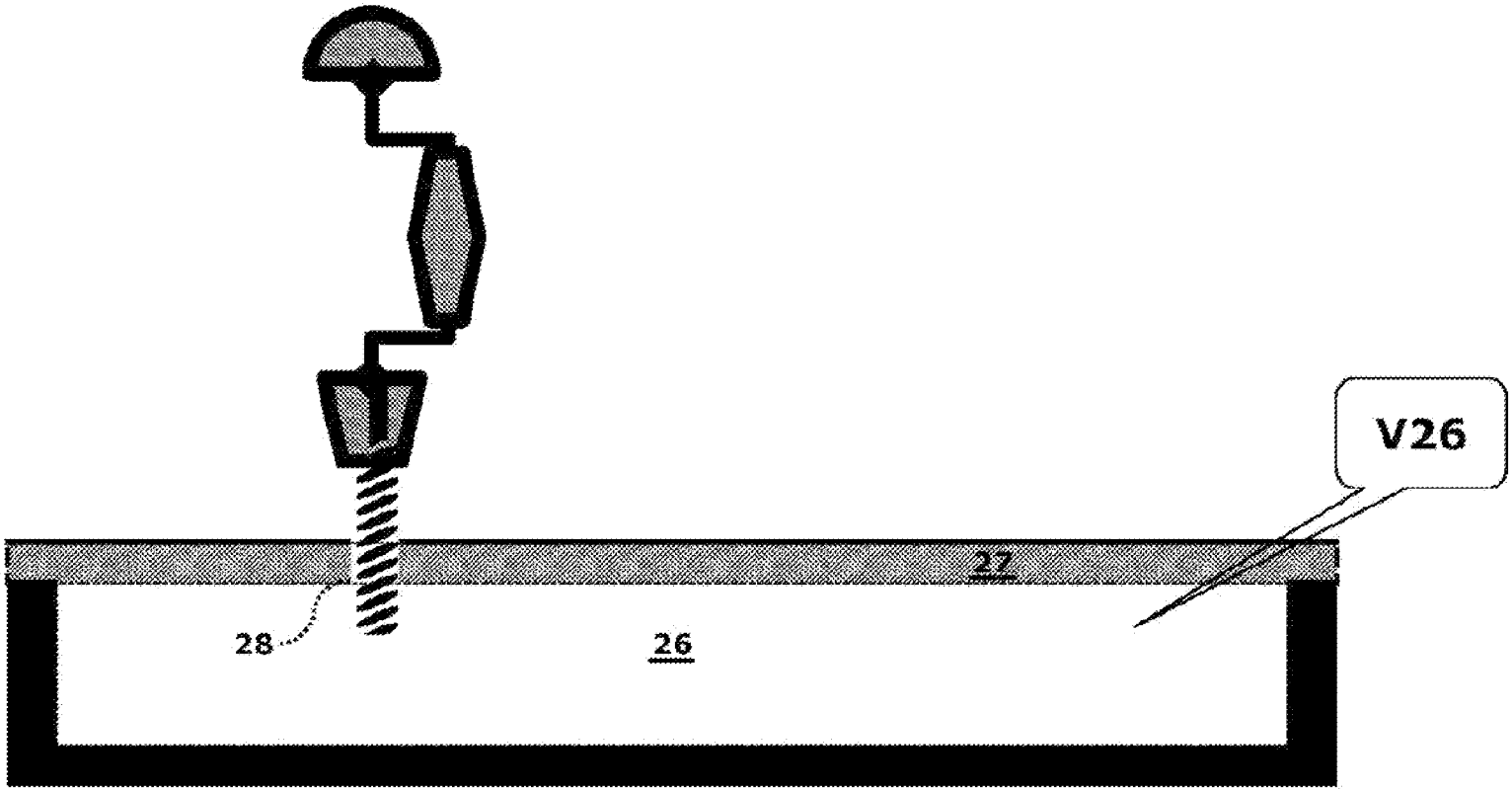
FIG. 4E shows an example floor-assembly arrangement and associated pod-making step.
Figure 4F:
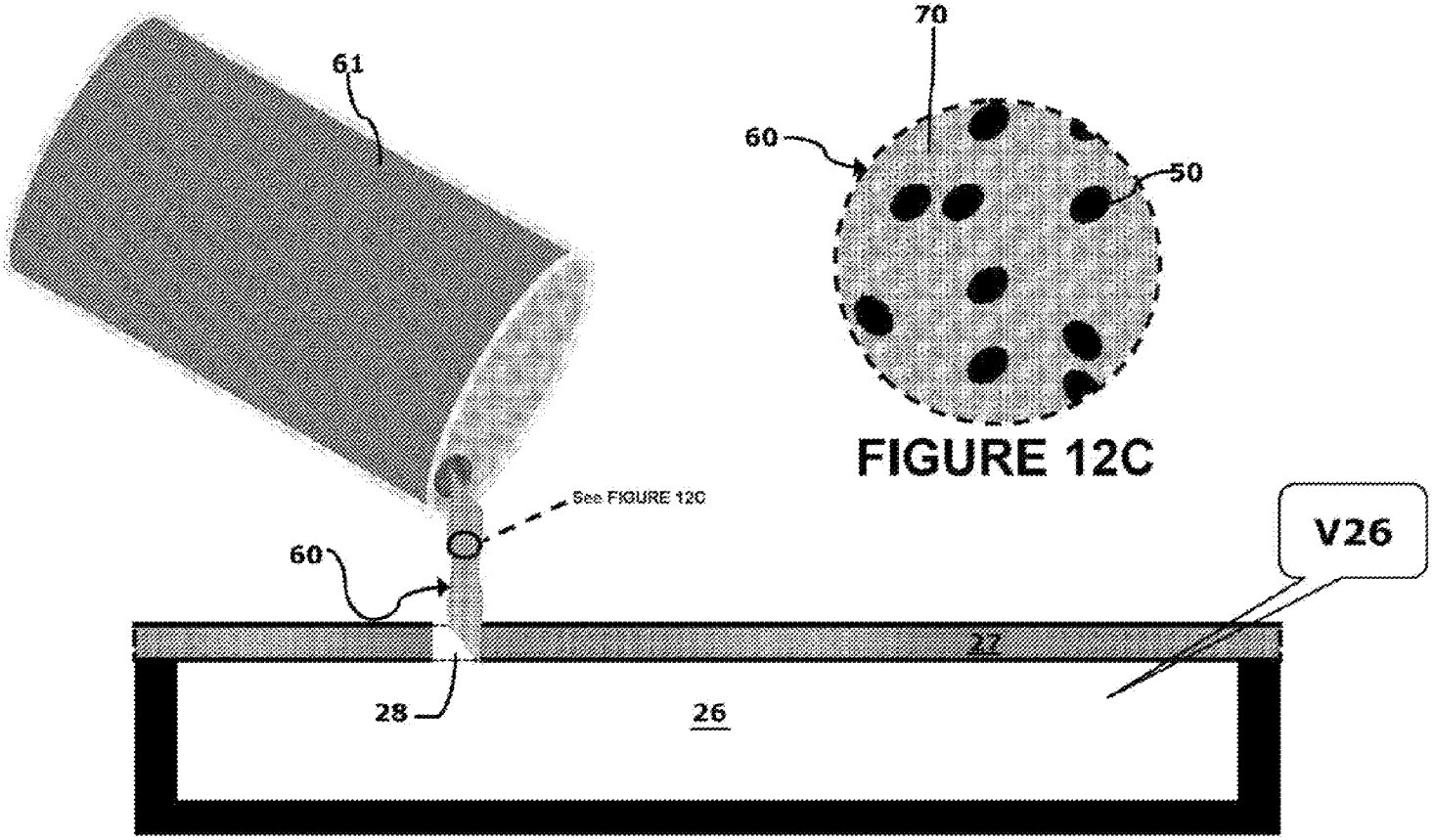
FIG. 4F shows an example floor-assembly arrangement and associated pod-making step.
Figure 4G:
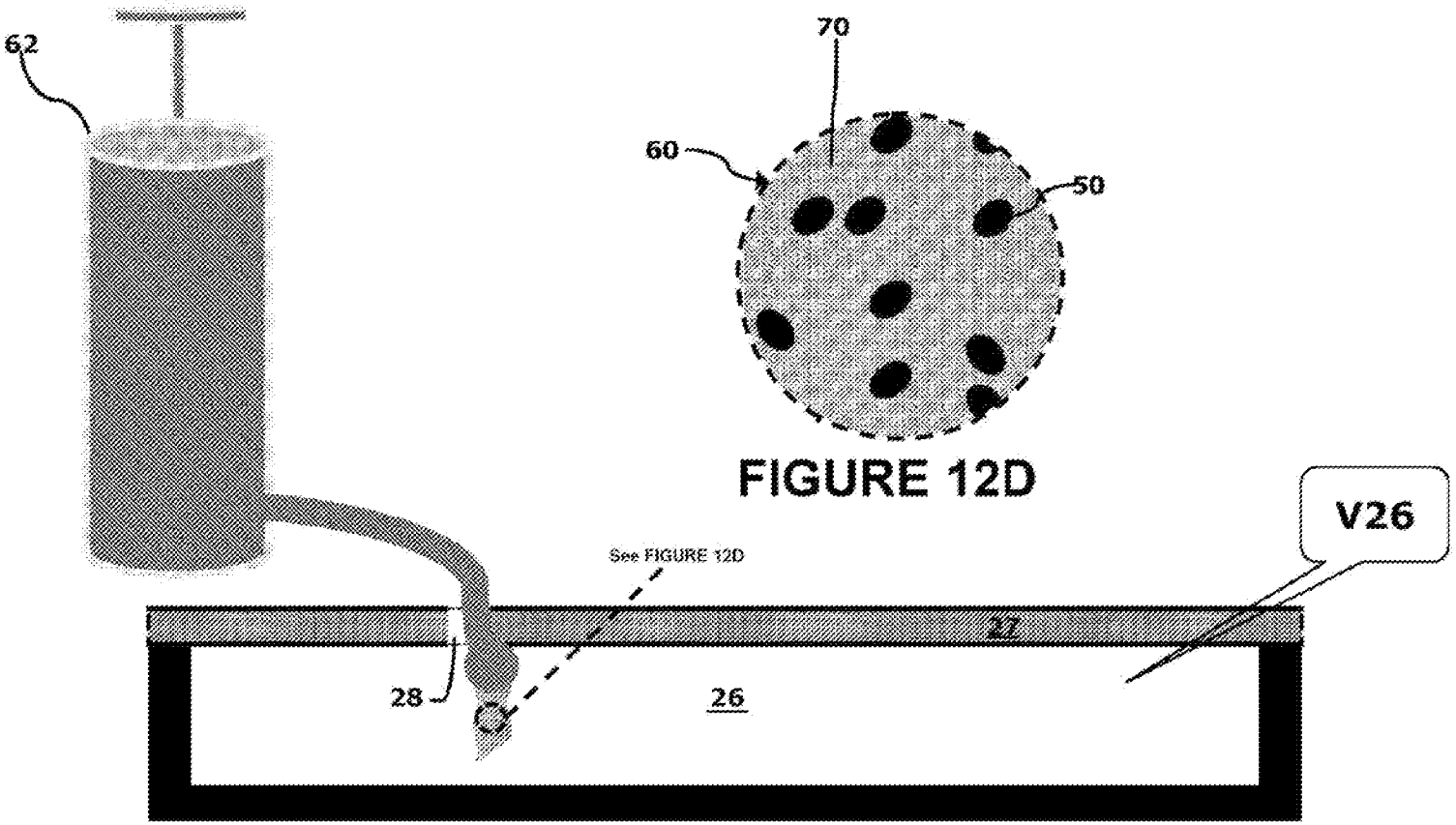
FIG. 4G shows an example floor-assembly arrangement and associated pod-making step.
Figure 4H:
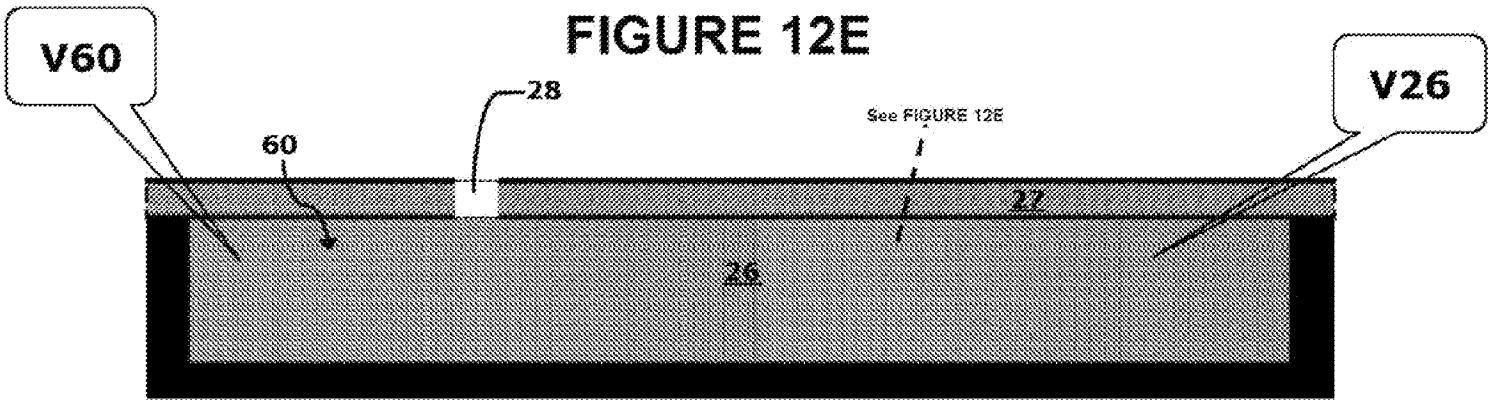
FIG. 4H shows an example floor-assembly arrangement and associated pod-making step.
Figure 4I:
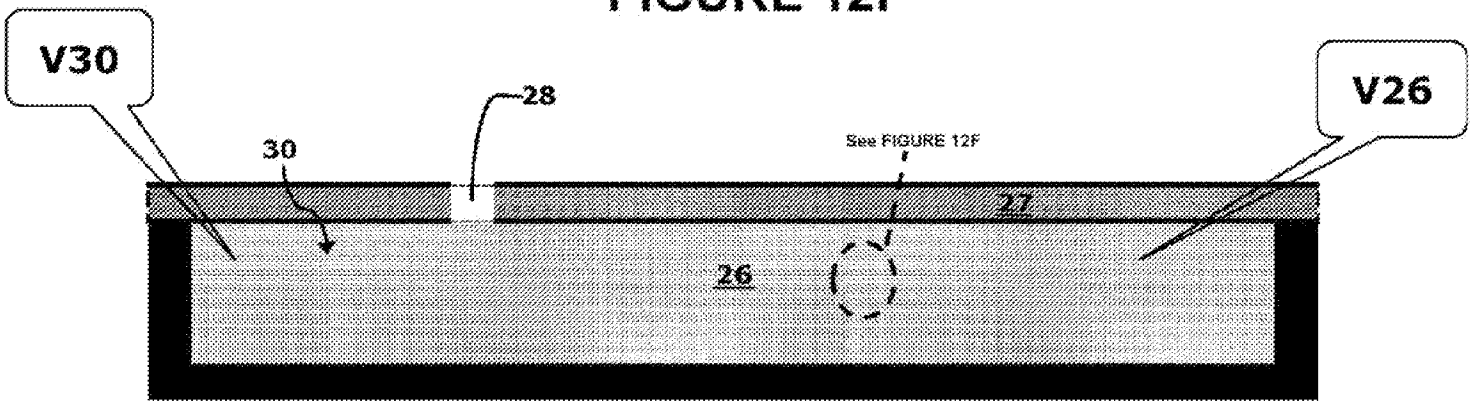
FIG. 4I shows an example floor-assembly arrangement and associated pod-making step.

Referring now to the drawings, and initially to FIG. 1, a building 10 is shown which includes a lower area 11 and an upper attic area 12. A floor assembly 20 provides a walkable surface 21 in the attic 12 and an insulating interface 22 below the walkable surface 21. The walkable surface 21 has a load-supporting capacity of at 80 psf, at least 100 psf, at least 200 psf, at least 300 psf, and/or at least 400 psf. The insulating interface 22 has an R value of at least 2.0 (a RSI value of at least 0.30) and/or a STC value of at least 30.

Some feasible floor-assembly arrangements are shown in the 2nd through 5th drawing sets. With particular reference to the first four figures in each set (FIGS. 2A-2D, 3A-3D, 4A-4D, 5A-5D, 10A, 10B, 11A, 11B, 12A, 12B, 13A, 13B), each assembly 20 includes members which structurally support the floor. These structural members can include, for example, joist members 23 and joist-bearing members 24.

The joist-bearing members 24 can comprise beams, girders, and/or walls which are positioned perpendicular to the joist members 23. The span between joist-bearing members 24 can be about 4 to about 20 feet long (about 1 to about 8 meters long).

The illustrated floor assemblies 20 also each include a deck member 25. This member 25 may or may not contribute to the structural integrity of the floor assembly 20. In some instances, it may form part of the ceiling of the lower living area 11.

The joist members 23, the joist-bearing members 24, and the deck member 25 form a grid of rectangular cavities 26.

The cavity dimensions correspond to joist depth, spacing, and span. Accordingly, each cavity 26 can be, for example, about 4 to about 16 inches deep (about 10 to about 40 centimeters deep), about 10 to about 30 inches wide (about 26 to about 80 centimeters wide), and about 4 to about 20 feet long (about 1 to about 8 meters long).

Each floor assembly 20 comprises pods 30 which occupy at least some of the cavities 26. Each pod 30 comprises a solidified carrier 40 and pellets 50 dispersed and embedded therein. The pods 30 adopt the cavities' shape whereby they resemble rectangular blocks in the illustrated embodiments.

In the floor assembly 20 shown in the $2^{nd}$ drawing set, the tops of the pods 30 and the tops of the joists form the flat walkable surface 21. In the floor assembly 20 shown in the $3^{rd}$ drawing set, pod-integral stratums 31 are situated above the cavities and the stratum tops form the walkable surface 21. In the $4^{th}$ and $5^{th}$ drawing sets, a cover sheet 27 over the pods 30 forms the walkable surface 21. The sheet 27 can be continuous (e.g., plywood, linoleum, laminate, oriented strand board, carpeting, etc.) as shown in the $4^{th}$ drawing set, or it can be segmented (e.g., hardwood strips, tiles, etc.) as shown in the $5^{th}$ drawing set. In each case, the pods 30 contribute to the structural integrity of the walkable surface 21.

In the floor assembly 20 shown in the $2^{nd}$ drawing set, lower portions of the pods 30 are contained in the interface 22. In the floor assemblies shown in the $3^{rd}$ through $5^{th}$ drawing sets, the entire pods 30 are included in the interface 22. And in each case, the pods 30 contribute to the insulating ability of the interface 22.

In the initial two figures of each drawing set (FIGS. 2A-2B, 3A-3B, 4A-4B, and 5A-5B, 10A, 11A, 12A, 13A), all of the cavities 26 are occupied by pods 30. In this manner, the walkable surface 21 can provide an uninterrupted platform in the attic 12. This approach could be adopted, for example, when the attic 12 is intended to provide additional living or storage space, and/or allow walking access across the pod surface 26.

In the next two figures of each drawing set (FIGS. 2C-2D, 3C-3D, 4C-4D, and 5C-5D, 10B, 11B, 12B, 13B), only selected cavities 26 are occupied by pods 30 to form the walkable surface 21. If the pod-occupied cavities 26 are adjacent and/or aligned, they can provide a reinforced area. This approach can be adopted, for example, when only limited access (e.g., to an attic window) is desired and/or when only certain attic areas will be used for storage.

As is best seen by referring to the following figures in each drawing set (FIGS. 2E-2F, 3E-3F, 4E-4G, and 5E-5G, 10C, 10D, 11C, 11D, 12C, 12D, 13C, 13D), the cavities 26 each define a volume V26. Volumes can and often do vary among cavities 26, but they will typically range between about 1 cubic foot to about 70 cubic feet (about 25 cubic decimeters to about 2600 cubic decimeters).

The open-cavity assemblies 20 shown in the $2^{nd}$ and $3^{rd}$ drawing sets are typical of unfinished attic floors in existing buildings and/or of still-being-assembled floors in ongoing constructions. Such an open-topped grid can also be attained by removing the covering (e.g., a continuous or segmented sheet 27) from a finished floor in an existing building. And after the pods 30 have been created in the cavities 26, they can be lidded (e.g., covered, enclosed, etc.) with a continuous or segmented sheet 27, whereby the floor assembly 20 would resemble those shown in the $4^{th}$ and $5^{th}$ drawing sets.

Figure 12A:
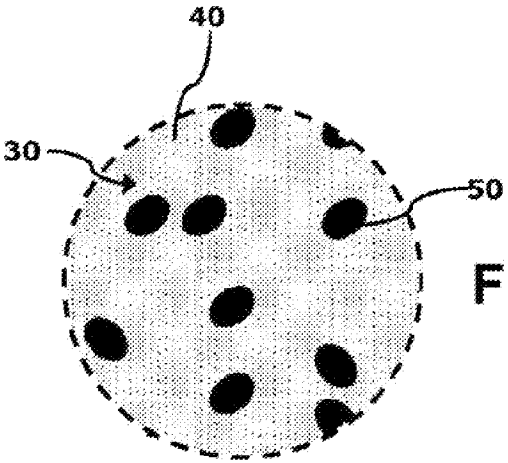
FIG. 12A shows an example pod constitution and corresponding pod-making materials.
Figure 12E:
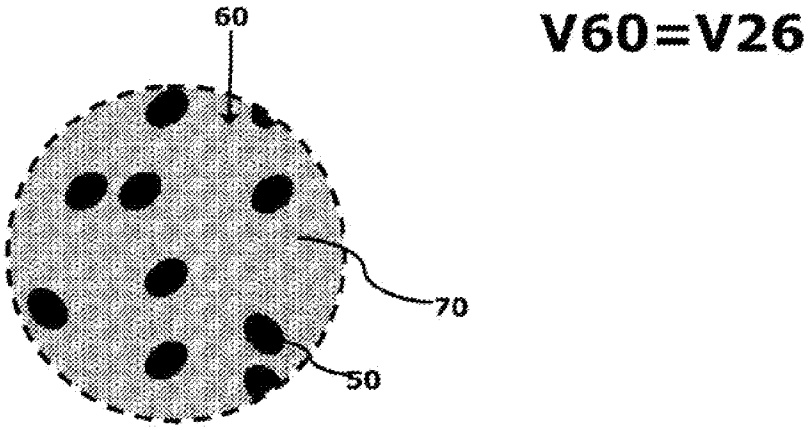
FIG. 12E shows an example pod constitution and corresponding pod-making materials.
Figure 12F:
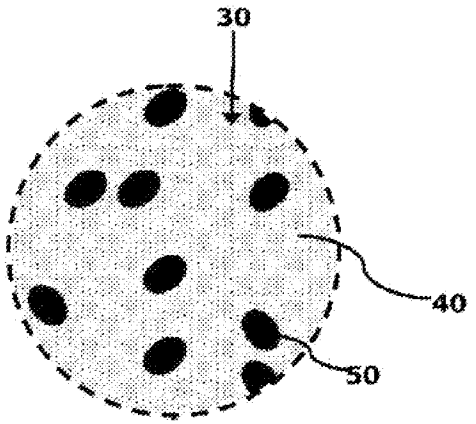
FIG. 12F shows an example pod constitution and corresponding pod-making materials.
Figure 12G:
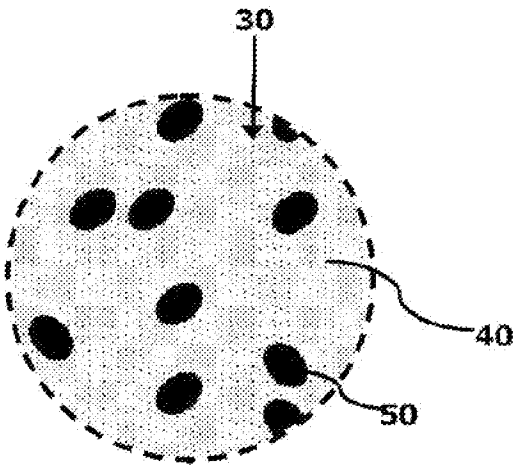
FIG. 12G shows an example pod constitution and corresponding pod-making materials.
Figure 4J:
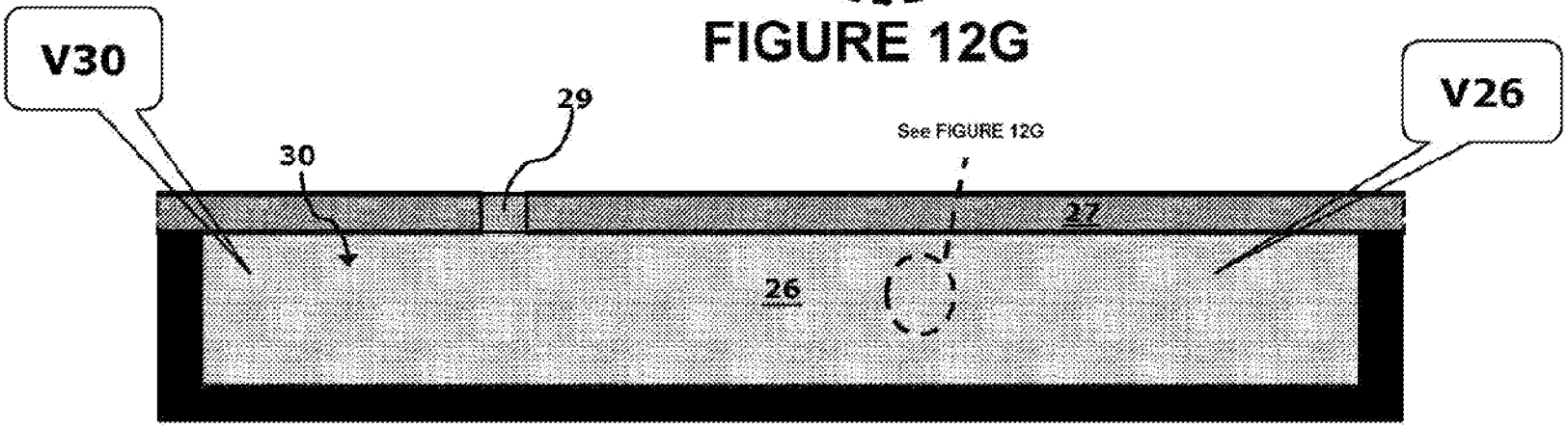
FIG. 4J shows an example floor-assembly arrangement and associated pod-making step.
Figure 12H:
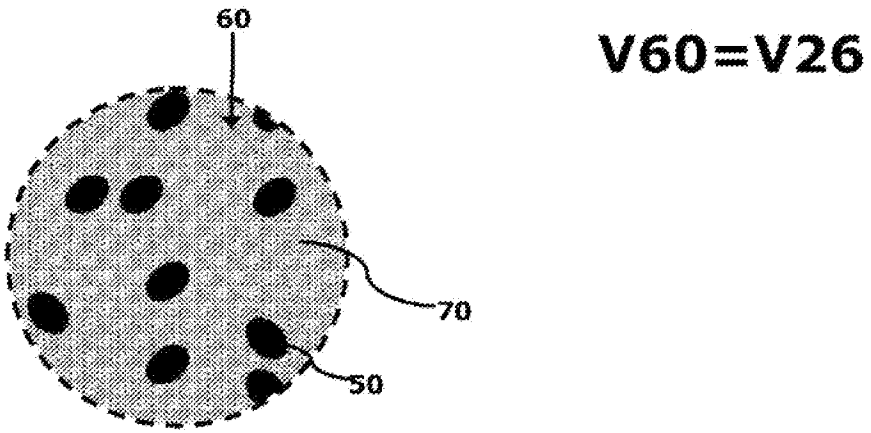
FIG. 12H shows an example pod constitution and corresponding pod-making materials.
Figure 4K:
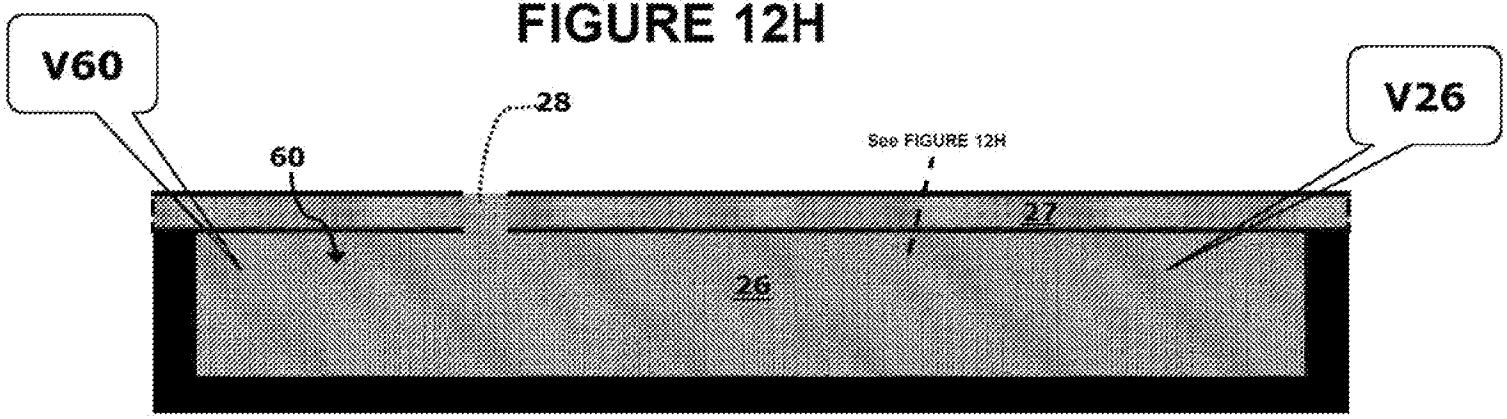
FIG. 4K shows an example floor-assembly arrangement and associated pod-making step.
Figure 12I:
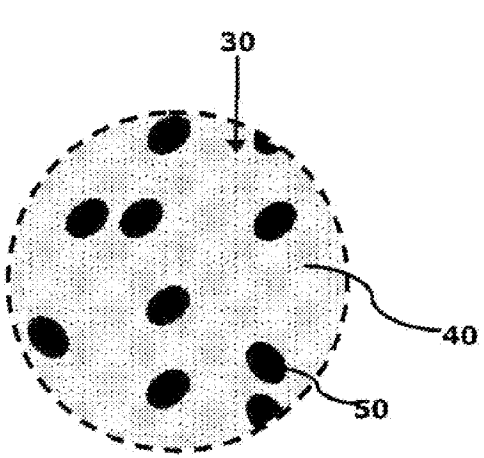
FIG. 12I shows an example pod constitution and corresponding pod-making materials.
Figure 4L:
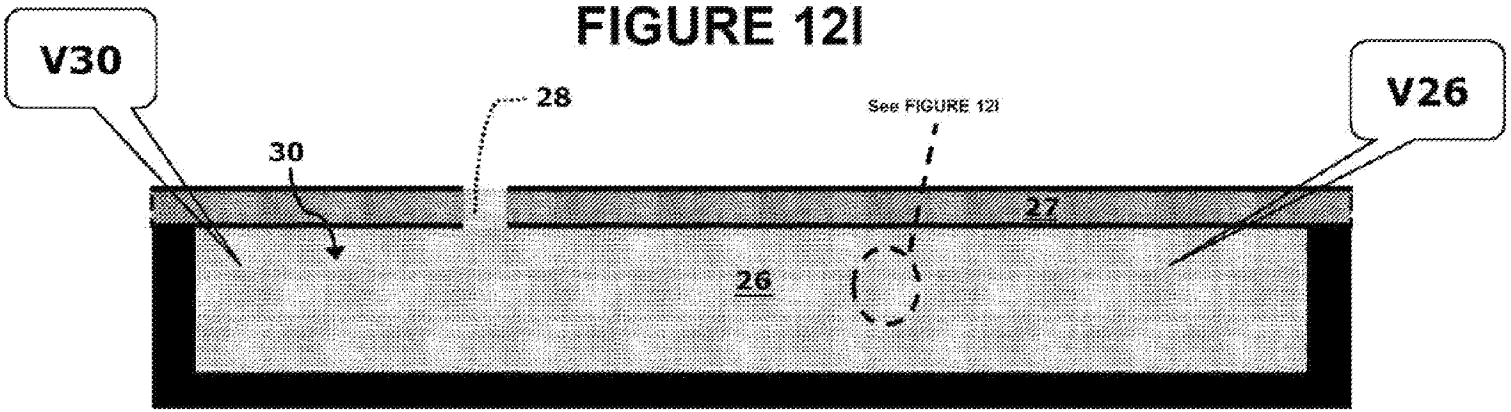
FIG. 4L shows an example floor-assembly arrangement and associated pod-making step.
Figure 13A:
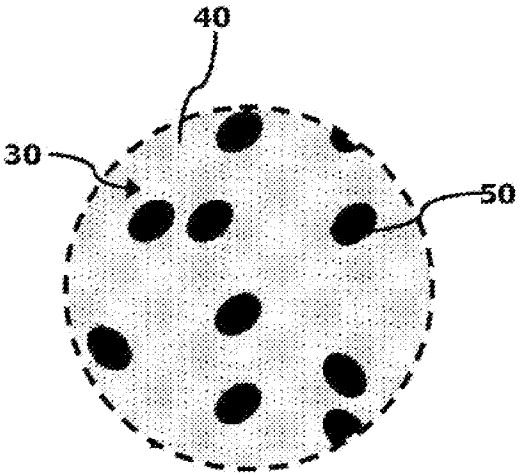
FIG. 13A shows an example pod constitution and corresponding pod-making materials.
Figure 5B:
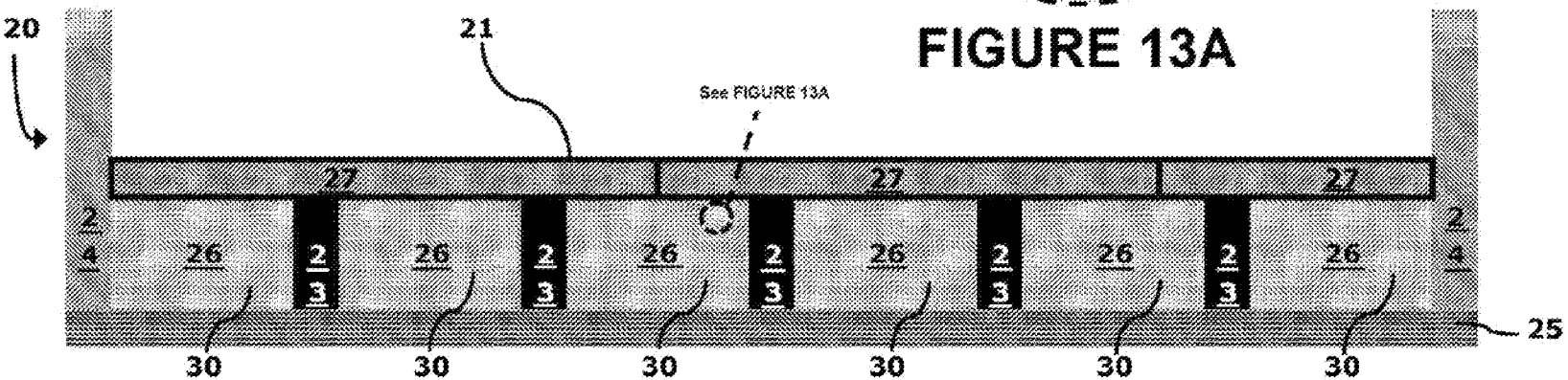
FIG. 5B shows an example floor-assembly arrangement and associated pod-making step.
Figure 5D:
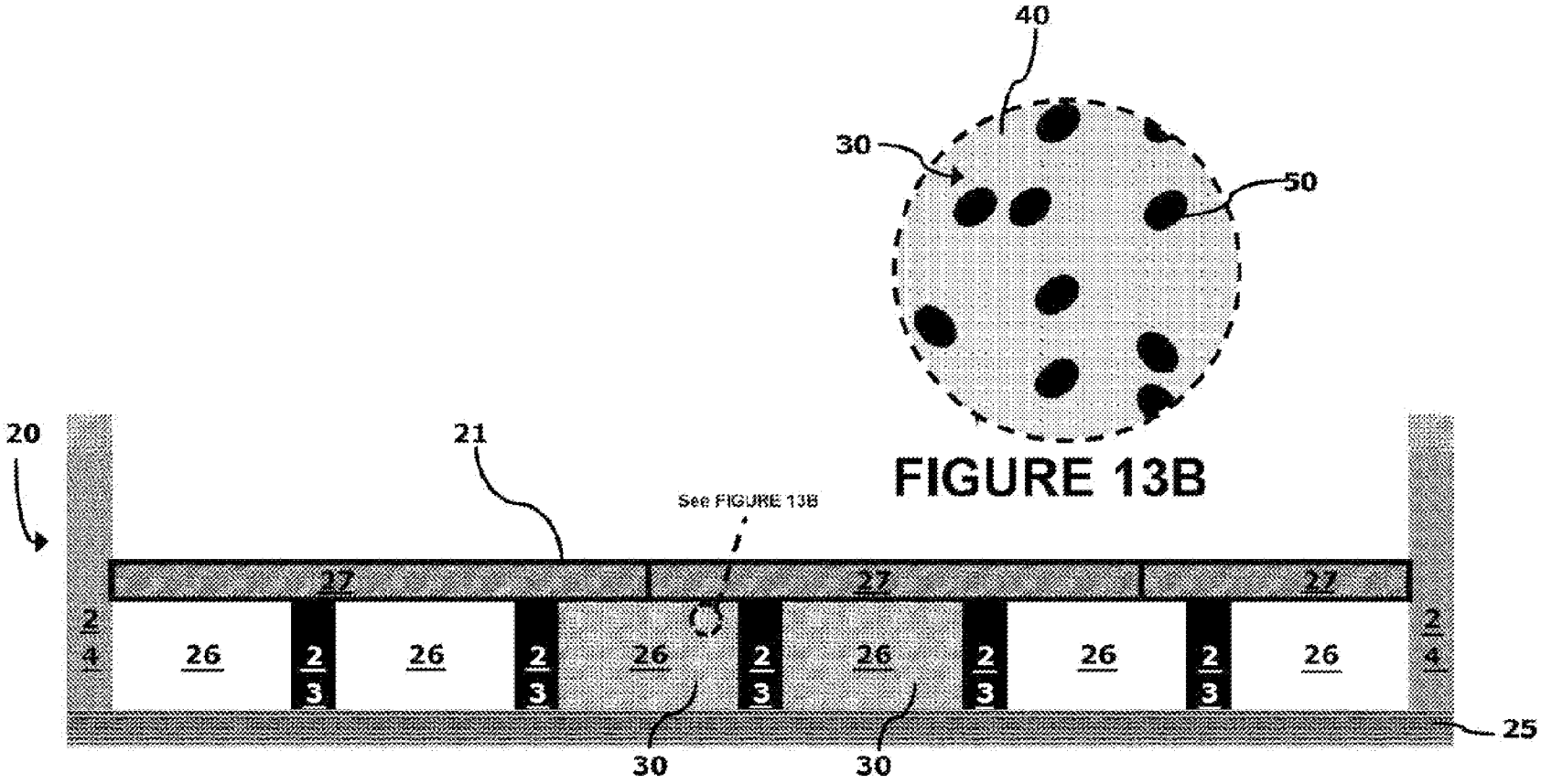
FIG. 5D shows an example floor-assembly arrangement and associated pod-making step.
Figure 13C:
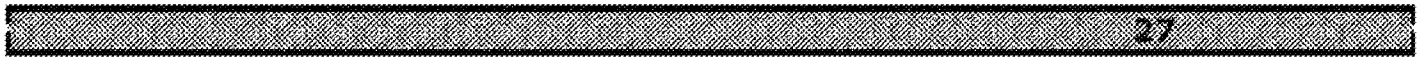
FIG. 13C shows an example pod constitution and corresponding pod-making materials.
Figure 5E:
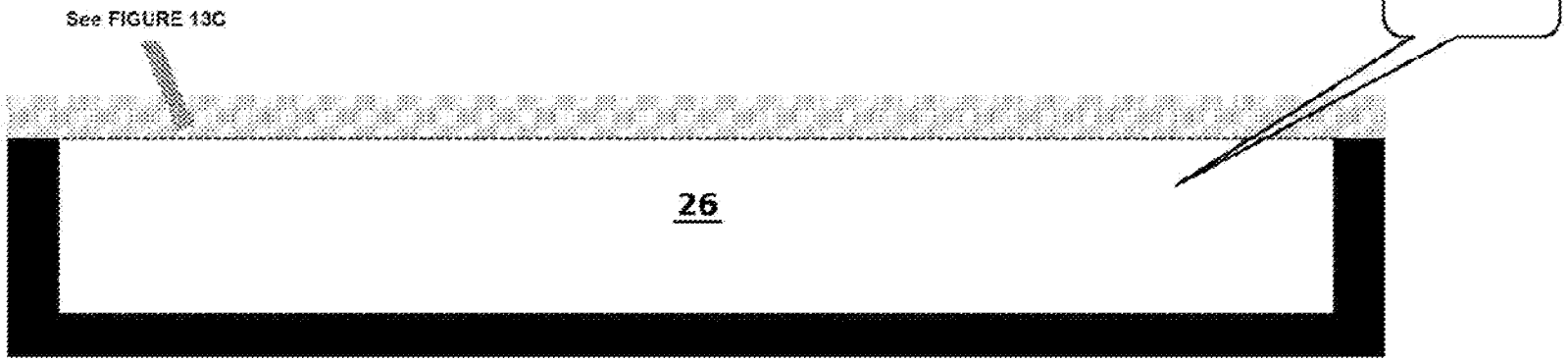
FIG. 5E shows an example floor-assembly arrangement and associated pod-making step.
Figure 5F:
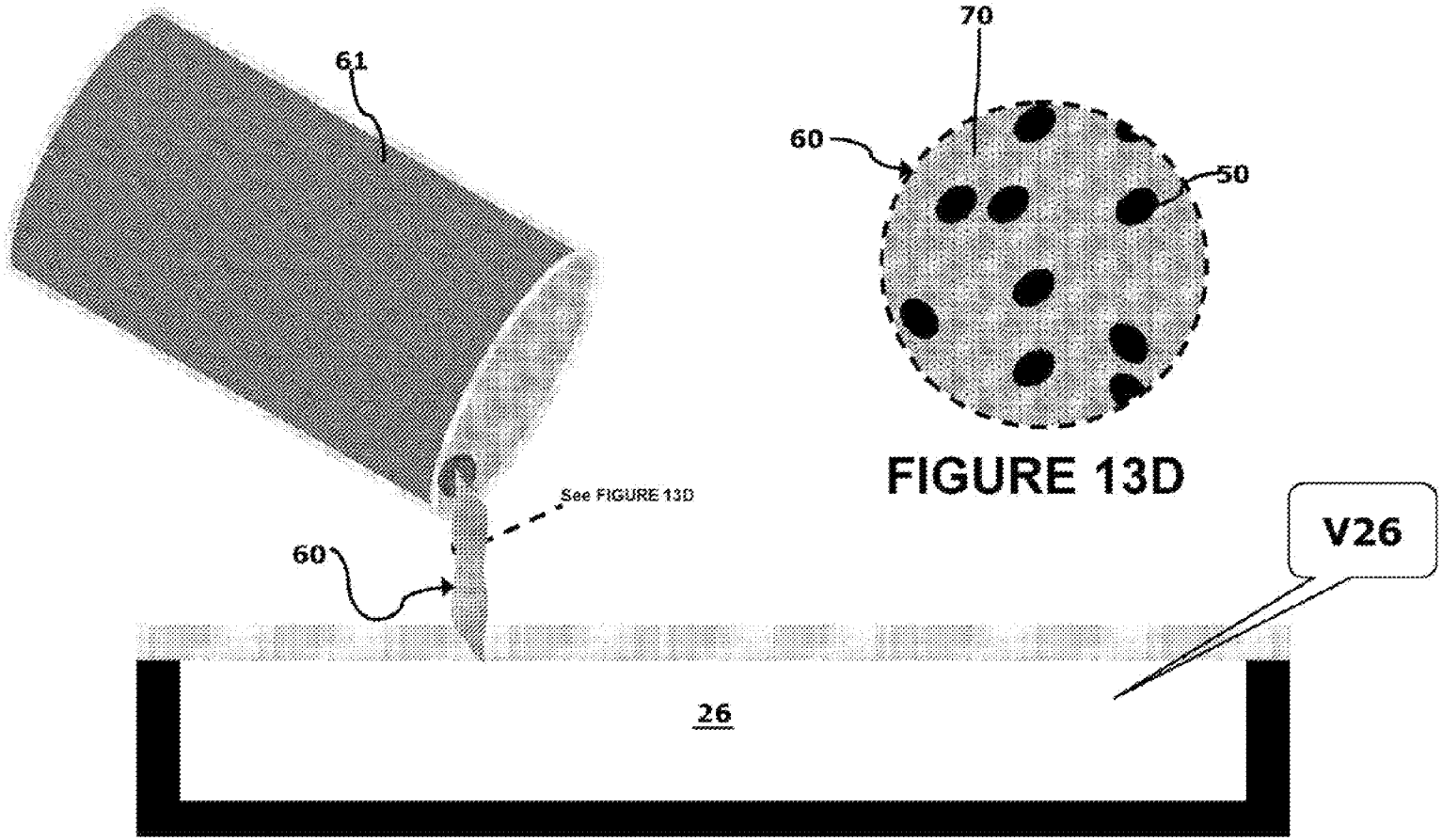
FIG. 5F shows an example floor-assembly arrangement and associated pod-making step.
Figure 5G:
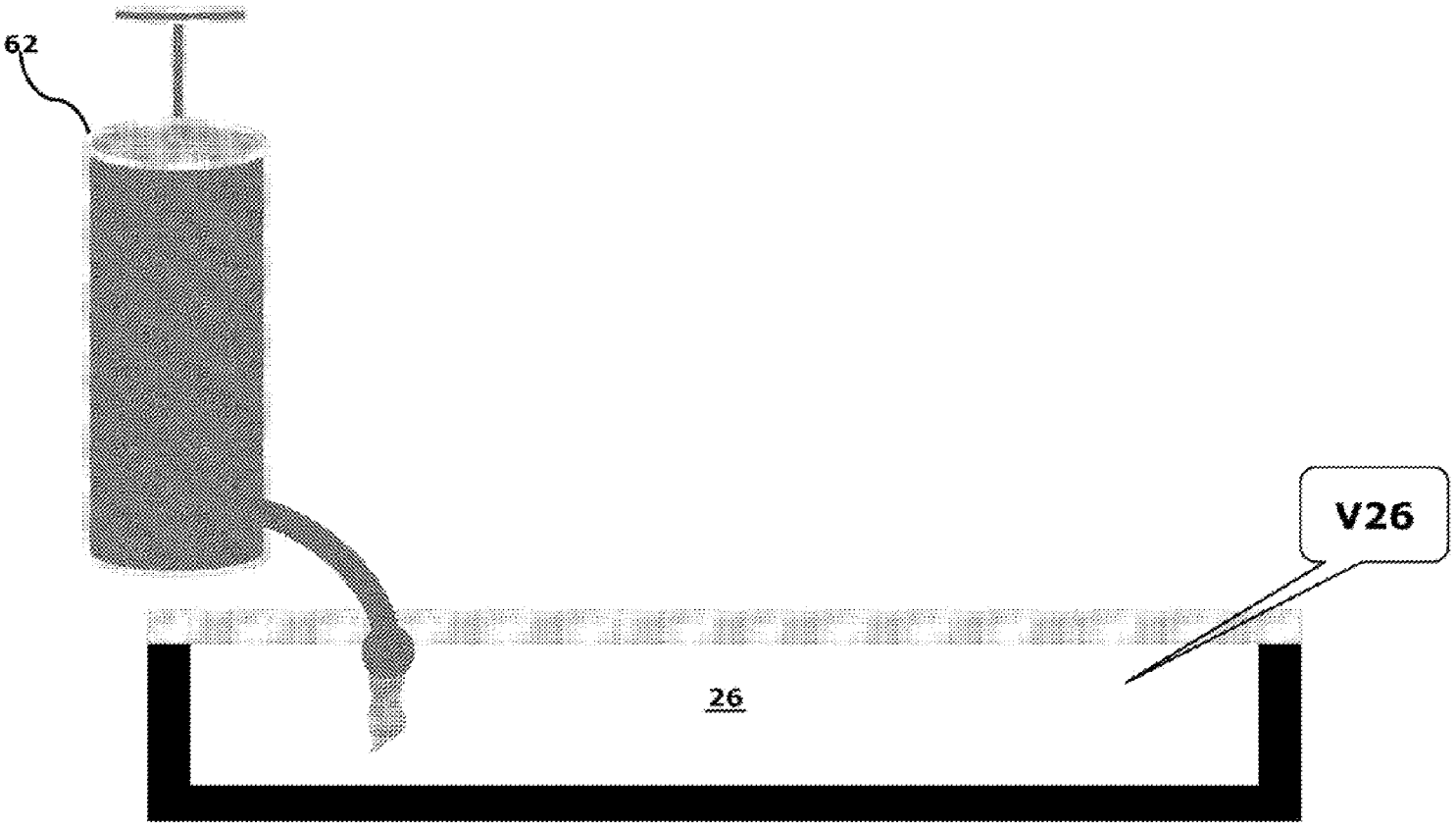
FIG. 5G shows an example floor-assembly arrangement and associated pod-making step.
Figures 5H, 13E:
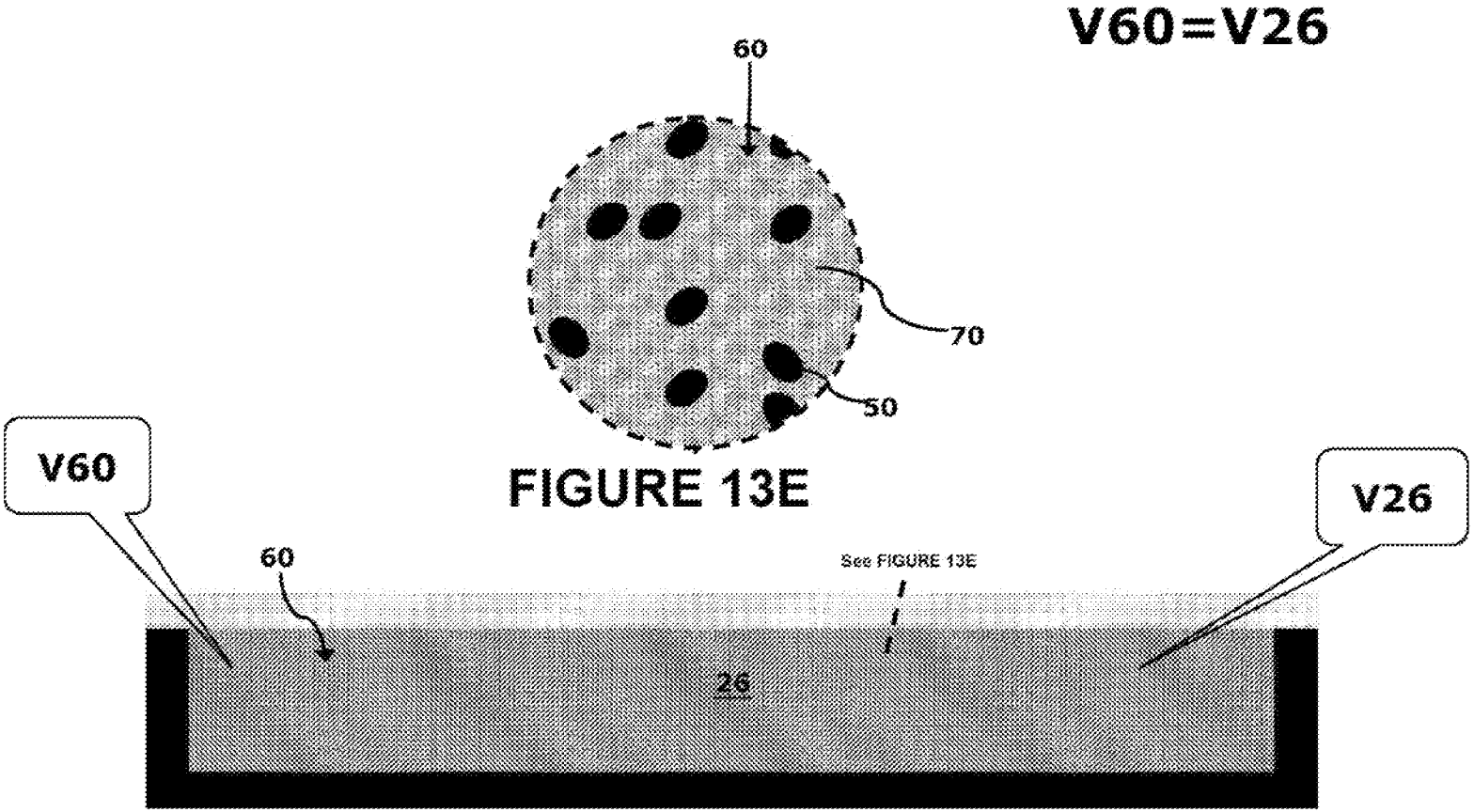
FIG. 5H shows an example floor-assembly arrangement and associated pod-making step.
FIG. 13E shows an example pod constitution and corresponding pod-making materials.
Figure 13F:
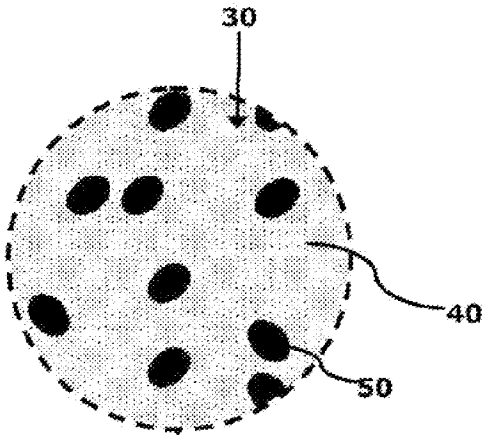
FIG. 13F shows an example pod constitution and corresponding pod-making materials.
Figure 5I:
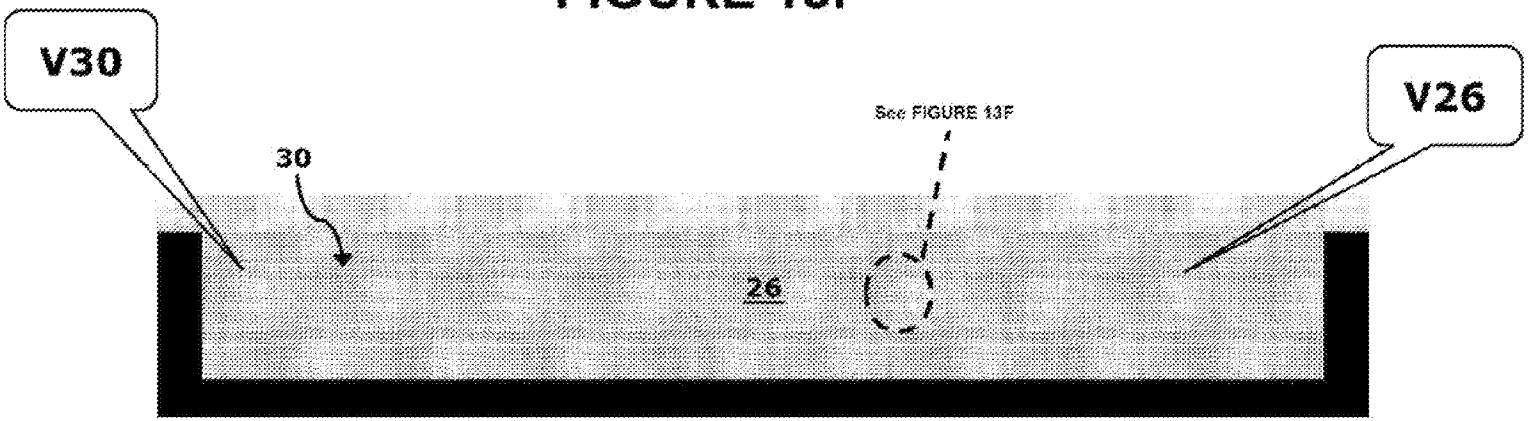
FIG. 5I shows an example floor-assembly arrangement and associated pod-making step.
Figure 13G:
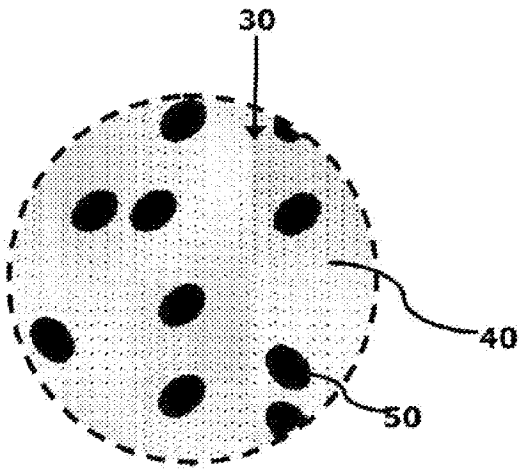
FIG. 13G shows an example pod constitution and corresponding pod-making materials.
Figure 5J:
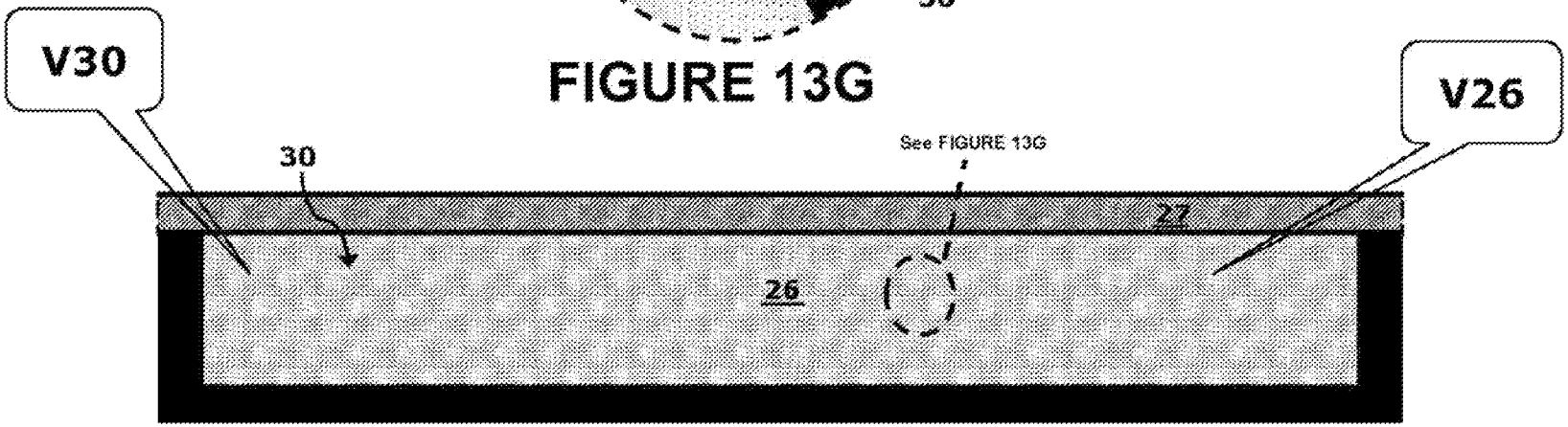
FIG. 5J shows an example floor-assembly arrangement and associated pod-making step.
Figure 14A:
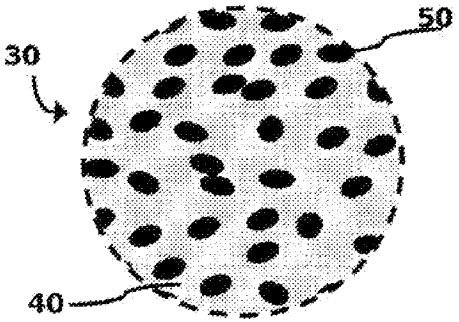
FIG. 14A shows an example pod constitution and corresponding pod-making materials.
Figure 14B:
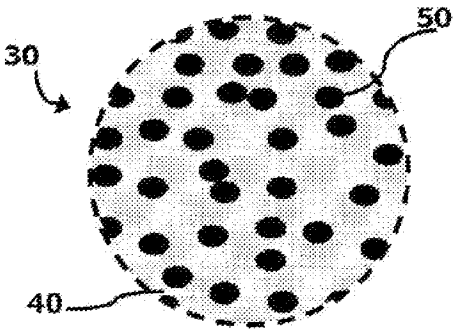
FIG. 14B shows an example pod constitution and corresponding pod-making materials.
Figure 14C:
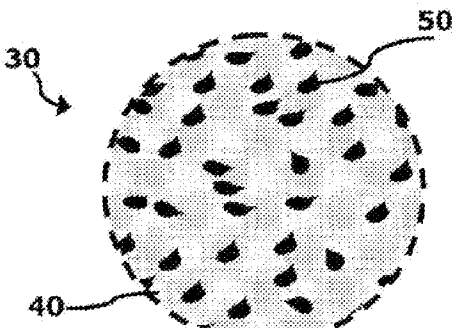
FIG. 14C shows an example pod constitution and corresponding pod-making materials.
Figure 6A:
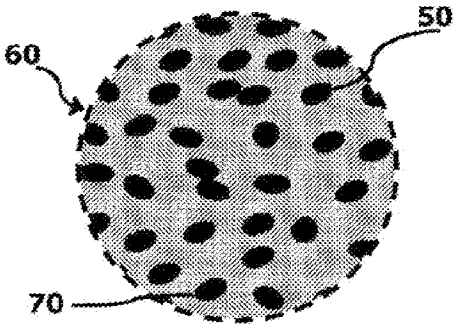
FIG. 6A shows an example pod constitution and corresponding pod-making materials.
Figure 6B:
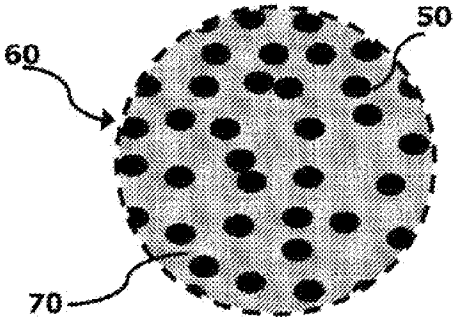
FIG. 6B shows an example pod constitution and corresponding pod-making materials.
Figure 6C:
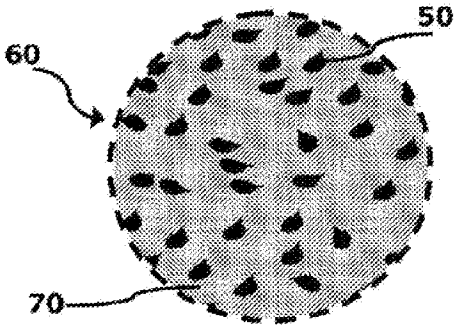
FIG. 6C shows an example pod constitution and corresponding pod-making materials.
Figure 14D:
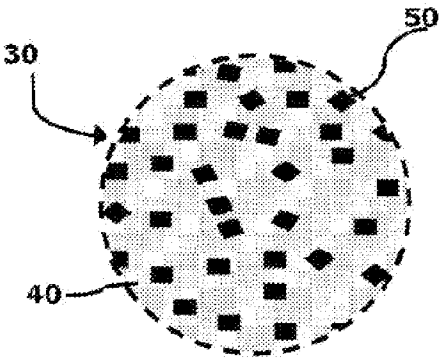
FIG. 14D shows an example pod constitution and corresponding pod-making materials.
Figure 14E:
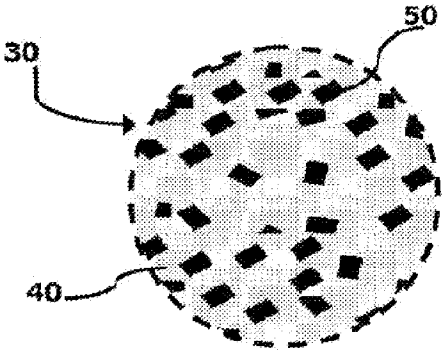
FIG. 14E shows an example pod constitution and corresponding pod-making materials.
Figure 14F:
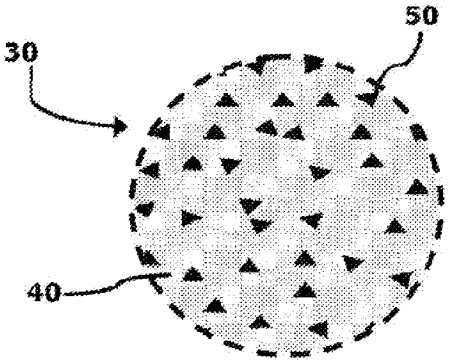
FIG. 14F shows an example pod constitution and corresponding pod-making materials.
Figure 6D:
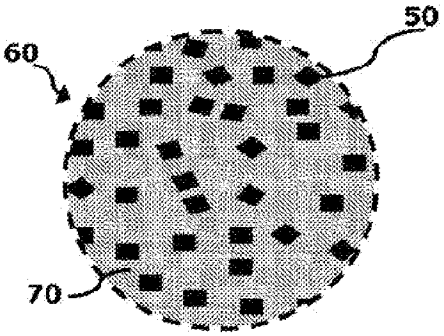
FIG. 6D shows an example pod constitution and corresponding pod-making materials.
Figure 6E:
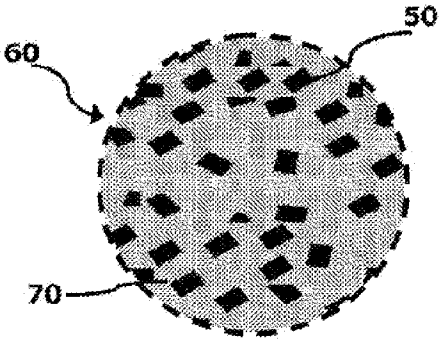
FIG. 6E shows an example pod constitution and corresponding pod-making materials.
Figure 6F:
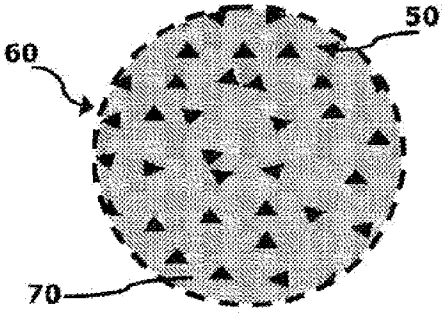
FIG. 6F shows an example pod constitution and corresponding pod-making materials.
Figure 14G:
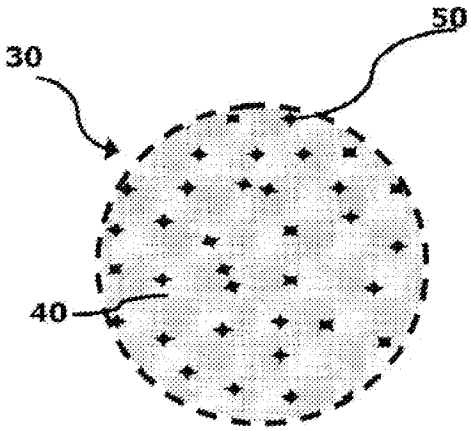
FIG. 14G shows an example pod constitution and corresponding pod-making materials.
Figure 14H:
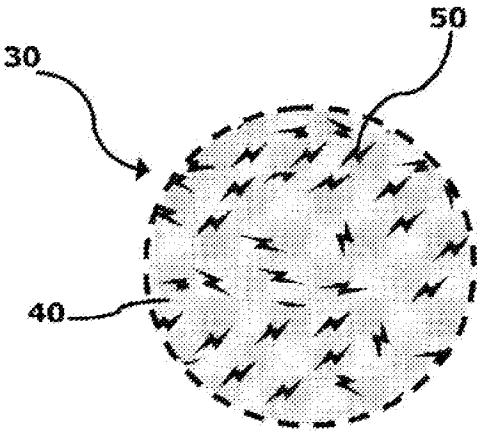
FIG. 14H shows an example pod constitution and corresponding pod-making materials.
Figure 14I:
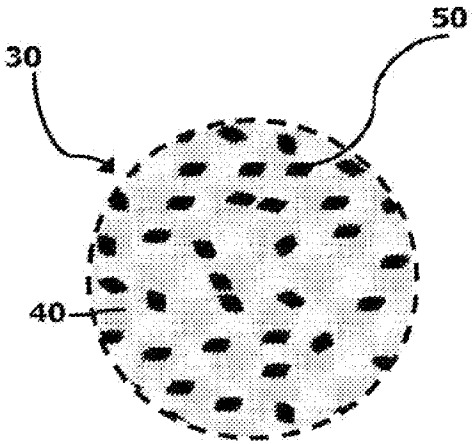
FIG. 14I shows an example pod constitution and corresponding pod-making materials.
Figure 6G:
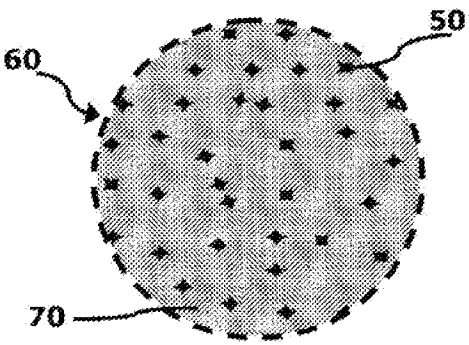
FIG. 6G shows an example pod constitution and corresponding pod-making materials.
Figure 6H:
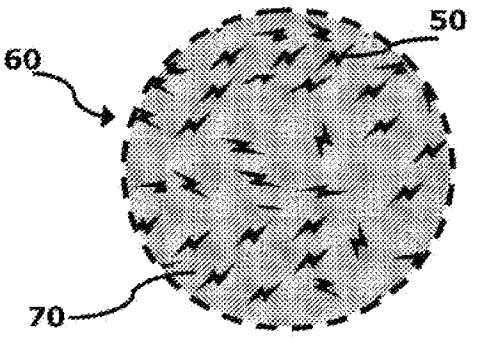
FIG. 6H shows an example pod constitution and corresponding pod-making materials.
Figure 6I:
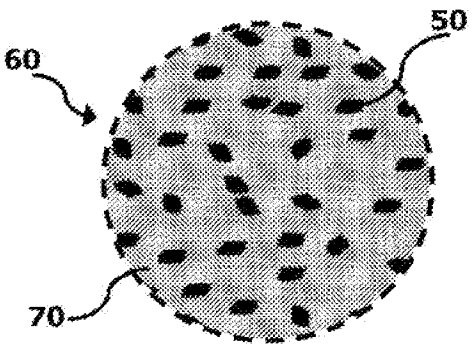
FIG. 6I shows an example pod constitution and corresponding pod-making materials.
Figure 14L:
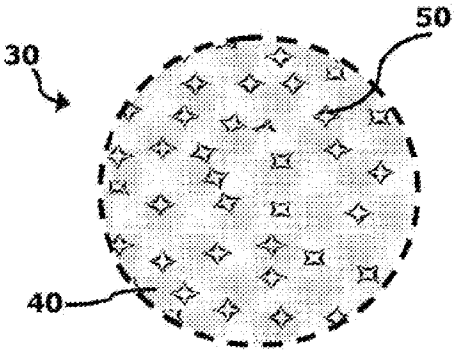
FIG. 14L shows an example pod constitution and corresponding pod-making materials.
Figure 14K:
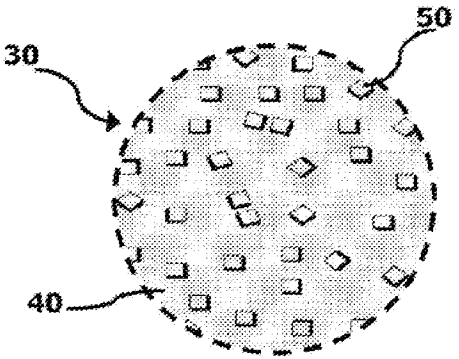
FIG. 14K shows an example pod constitution and corresponding pod-making materials.
Figure 14J:
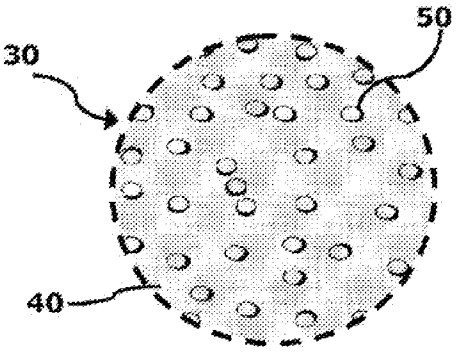
FIG. 14J shows an example pod constitution and corresponding pod-making materials.
Figure 6L:
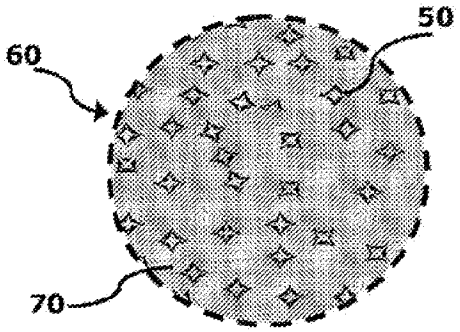
FIG. 6L shows an example pod constitution and corresponding pod-making materials.
Figure 6K:
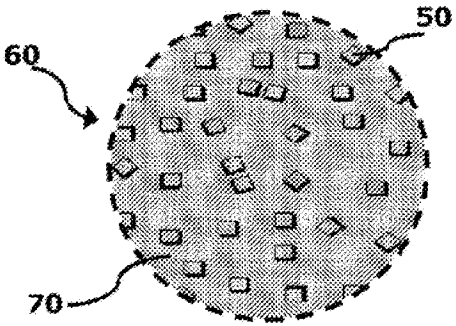
FIG. 6K shows an example pod constitution and corresponding pod-making materials.
Figure 6J:
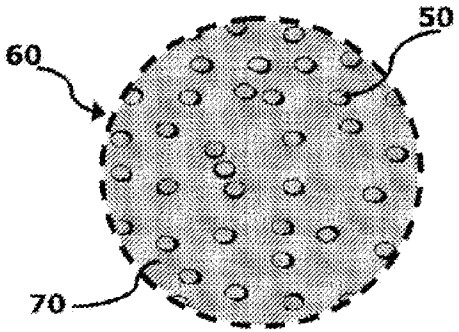
FIG. 6J shows an example pod constitution and corresponding pod-making materials.
Figure 15A:
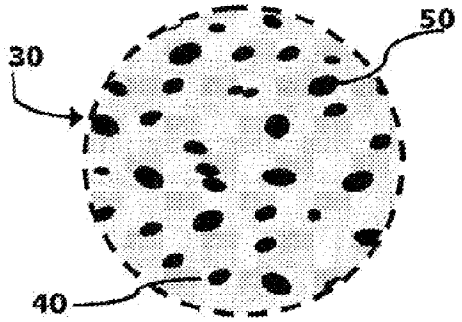
FIG. 15A shows an example pod constitution and corresponding pod-making materials.
Figure 15B:
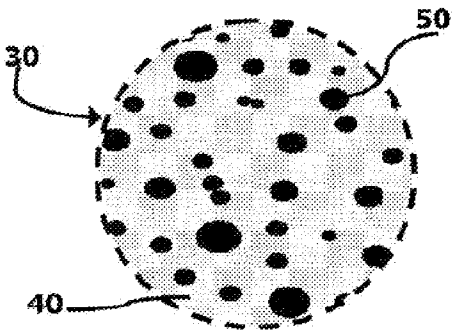
FIG. 15B shows an example pod constitution and corresponding pod-making materials.
Figure 15C:
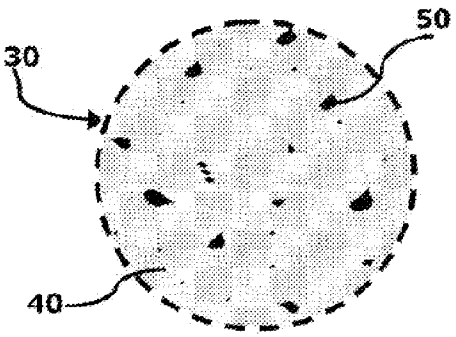
FIG. 15C shows an example pod constitution and corresponding pod-making materials.
Figure 7A:
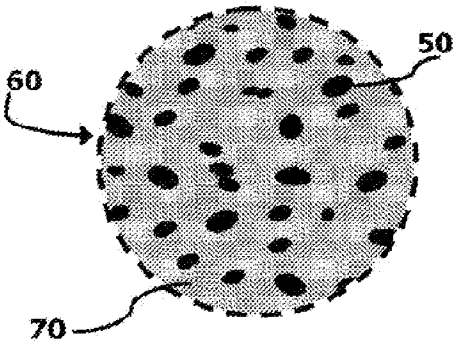
FIG. 7A shows an example pod constitution and corresponding pod-making materials.
Figure 7B:
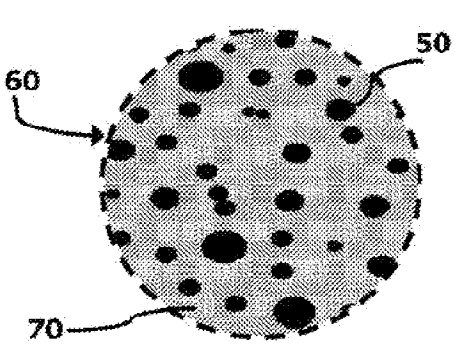
FIG. 7B shows an example pod constitution and corresponding pod-making materials.
Figure 7C:
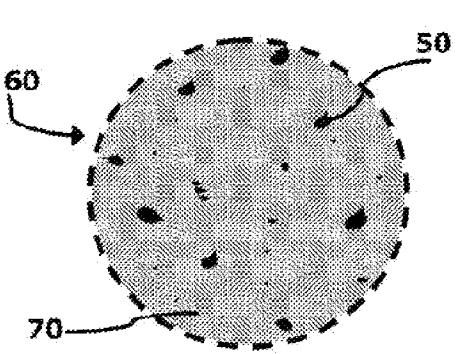
FIG. 7C shows an example pod constitution and corresponding pod-making materials.
Figure 15F:
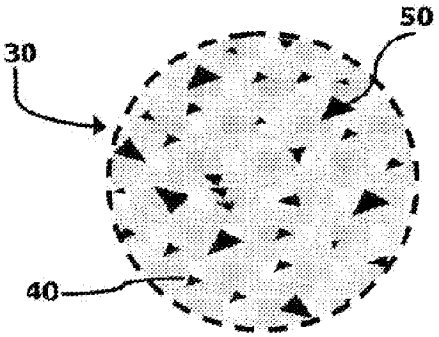
FIG. 15F shows an example pod constitution and corresponding pod-making materials.
Figure 15E:
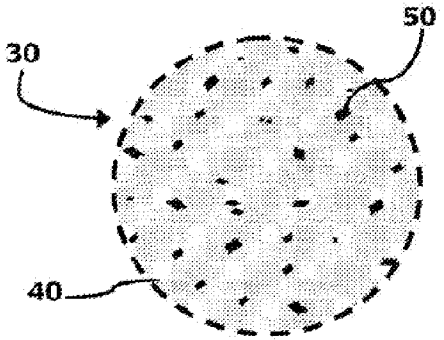
FIG. 15E shows an example pod constitution and corresponding pod-making materials.
Figure 15D:
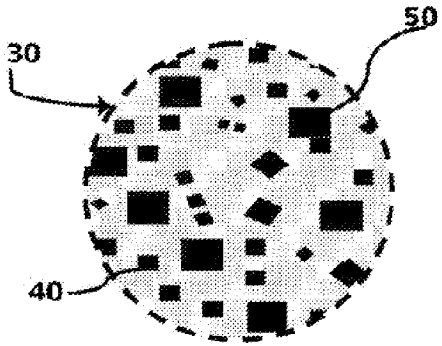
FIG. 15D shows an example pod constitution and corresponding pod-making materials.
Figure 7F:
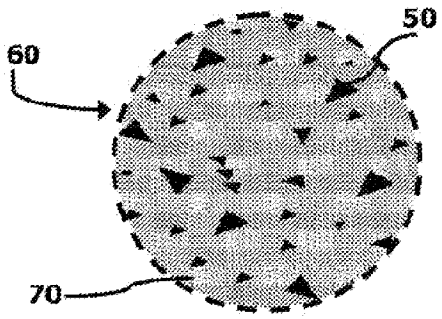
FIG. 7F shows an example pod constitution and corresponding pod-making materials.
Figure 7E:
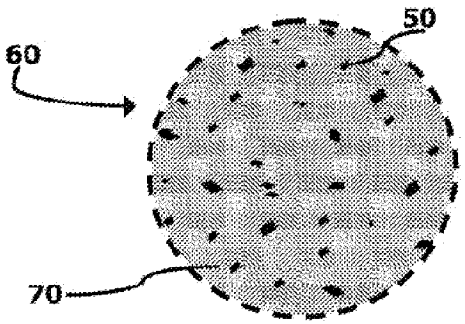
FIG. 7E shows an example pod constitution and corresponding pod-making materials.
Figure 7D:
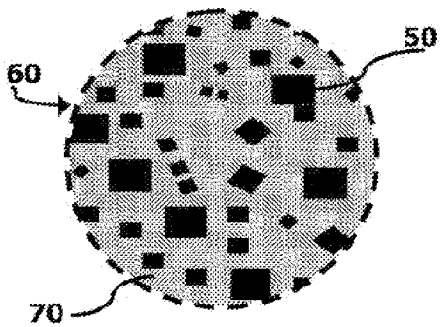
FIG. 7D shows an example pod constitution and corresponding pod-making materials.
Figure 15I:
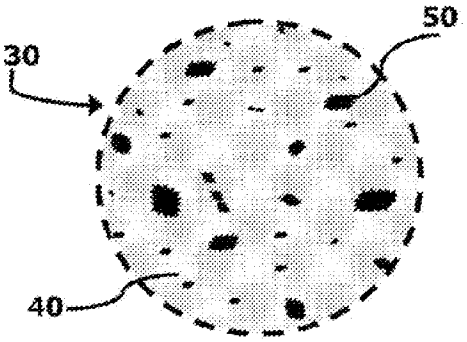
FIG. 15I shows an example pod constitution and corresponding pod-making materials.
Figure 15H:
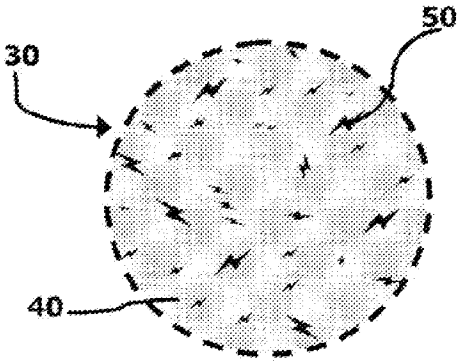
FIG. 15H shows an example pod constitution and corresponding pod-making materials.
Figure 15G:
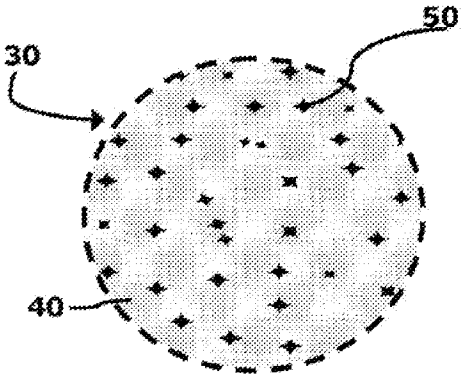
FIG. 15G shows an example pod constitution and corresponding pod-making materials.
Figure 7I:
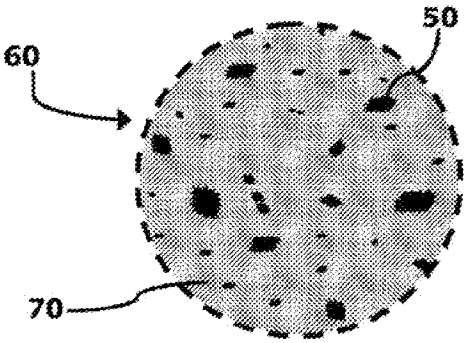
FIG. 7I shows an example pod constitution and corresponding pod-making materials.
Figure 7H:
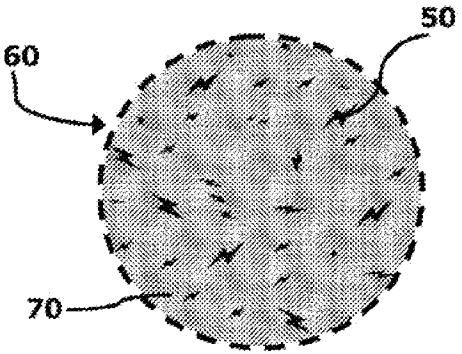
FIG. 7H shows an example pod constitution and corresponding pod-making materials.
Figure 7G:
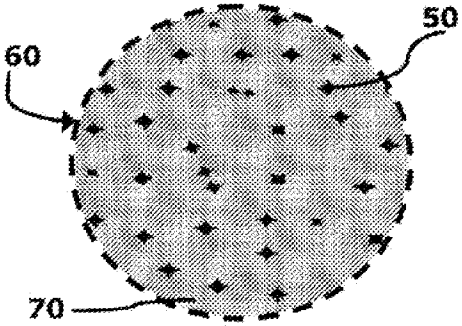
FIG. 7G shows an example pod constitution and corresponding pod-making materials.
Figure 15J:
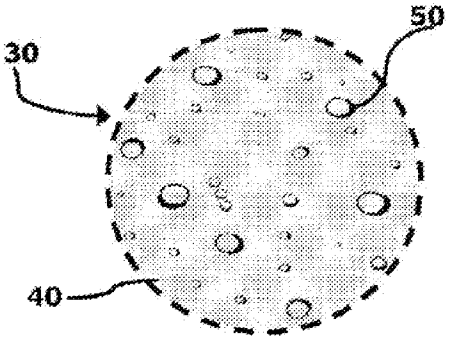
FIG. 15J shows an example pod constitution and corresponding pod-making materials.
Figure 15K:
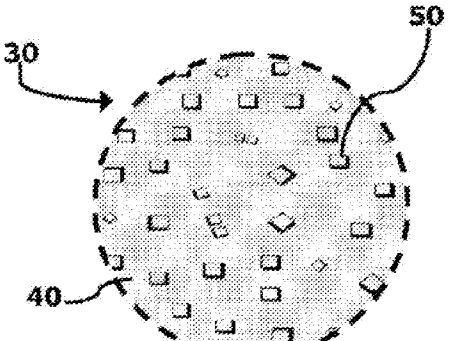
FIG. 15K shows an example pod constitution and corresponding pod-making materials.
Figure 15L:
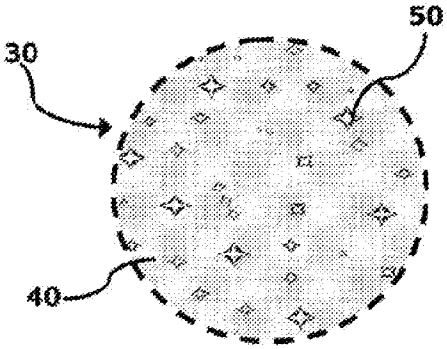
FIG. 15L shows an example pod constitution and corresponding pod-making materials.
Figure 7J:
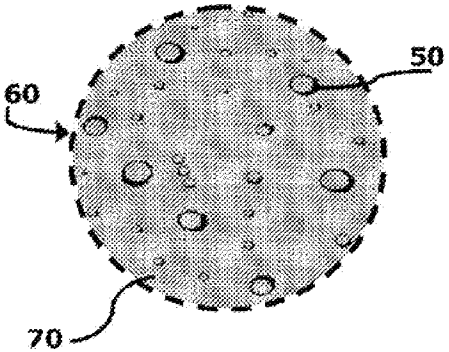
FIG. 7J shows an example pod constitution and corresponding pod-making materials.
Figure 7K:
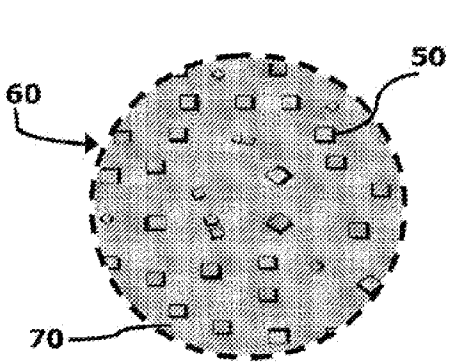
FIG. 7K shows an example pod constitution and corresponding pod-making materials.
Figure 7L:
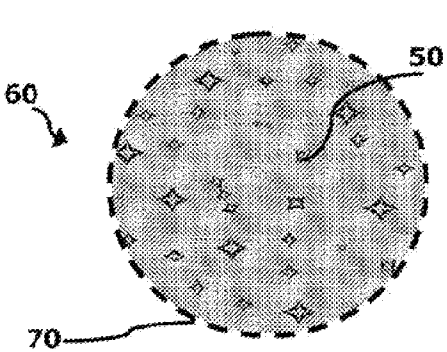
FIG. 7L shows an example pod constitution and corresponding pod-making materials.
Figure 16A:
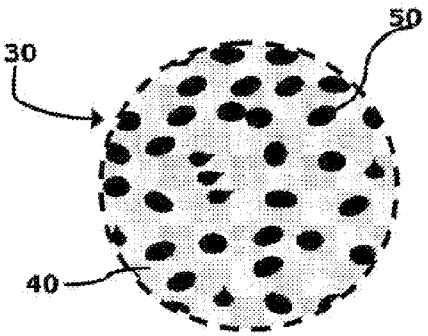
FIG. 16A shows an example pod constitution and corresponding pod-making materials.
Figure 16B:
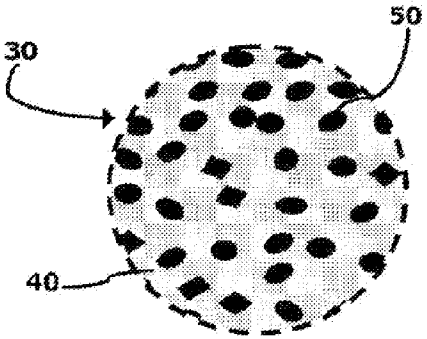
FIG. 16B shows an example pod constitution and corresponding pod-making materials.
Figure 16C:
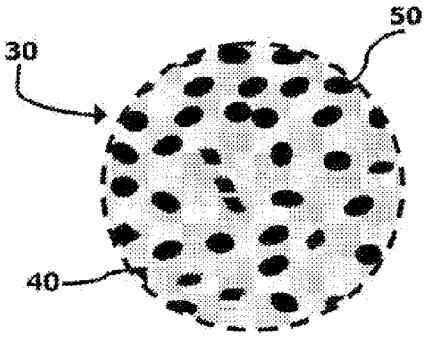
FIG. 16C shows an example pod constitution and corresponding pod-making materials.
Figure 8A:
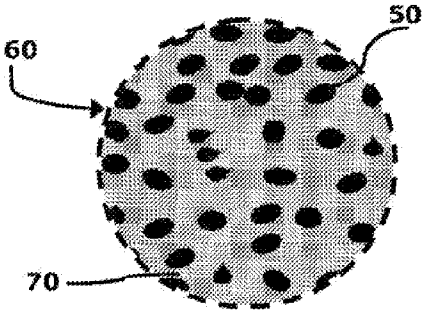
FIG. 8A shows an example pod constitution and corresponding pod-making materials.
Figure 8B:
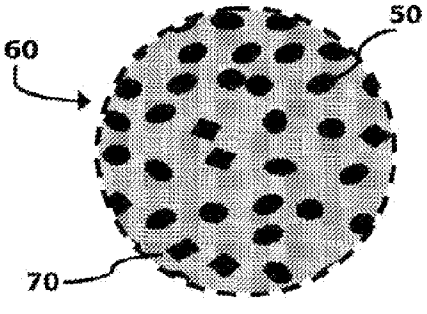
FIG. 8B shows an example pod constitution and corresponding pod-making materials.
Figure 8C:
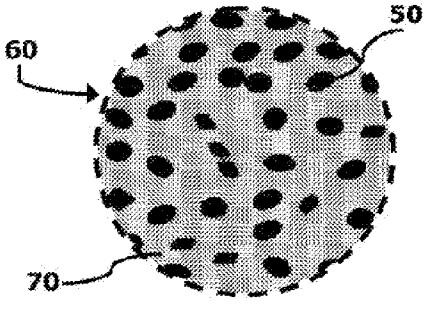
FIG. 8C shows an example pod constitution and corresponding pod-making materials.
Figure 16D:
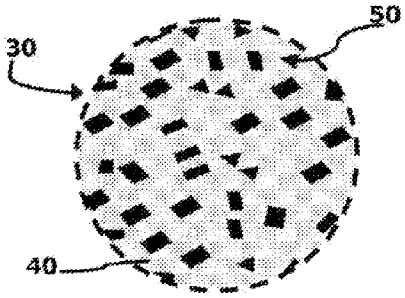
FIG. 16D shows an example pod constitution and corresponding pod-making materials.
Figure 16E:
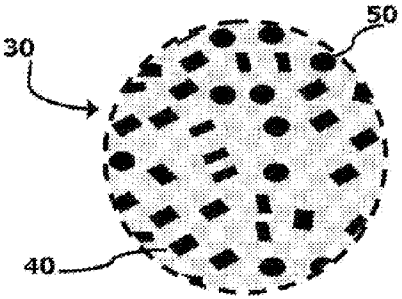
FIG. 16E shows an example pod constitution and corresponding pod-making materials.
Figure 16F:
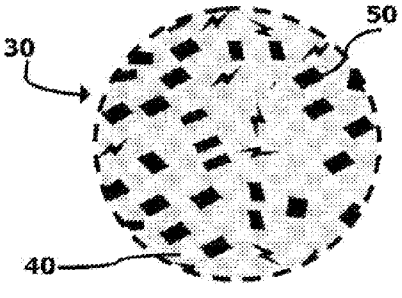
FIG. 16F shows an example pod constitution and corresponding pod-making materials.
Figure 8D:
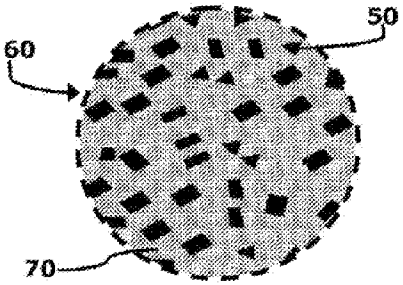
FIG. 8D shows an example pod constitution and corresponding pod-making materials.
Figure 8E:
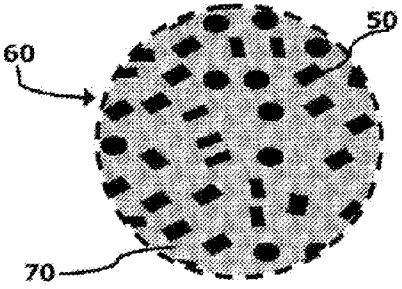
FIG. 8E shows an example pod constitution and corresponding pod-making materials.
Figure 8F:
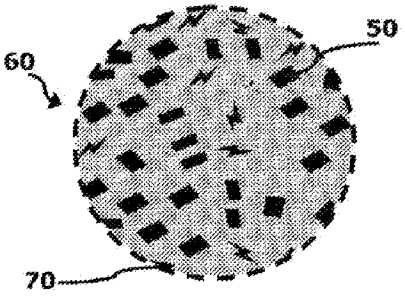
FIG. 8F shows an example pod constitution and corresponding pod-making materials.
Figure 16G:
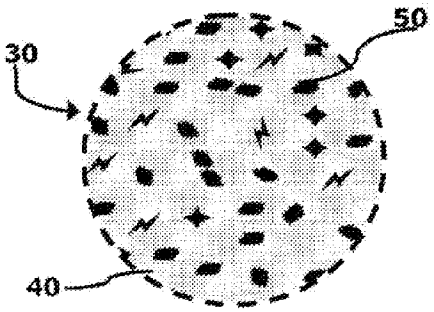
FIG. 16G shows an example pod constitution and corresponding pod-making materials.
Figure 16H:
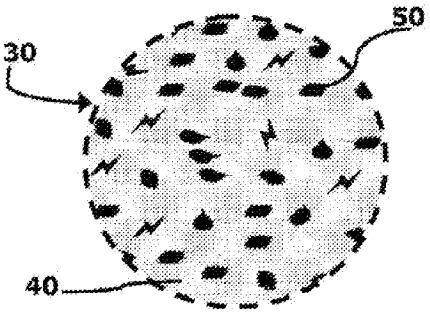
FIG. 16H shows an example pod constitution and corresponding pod-making materials.
Figure 16I:
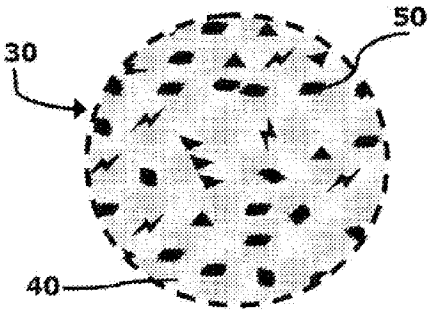
FIG. 16I shows an example pod constitution and corresponding pod-making materials.
Figure 8G:
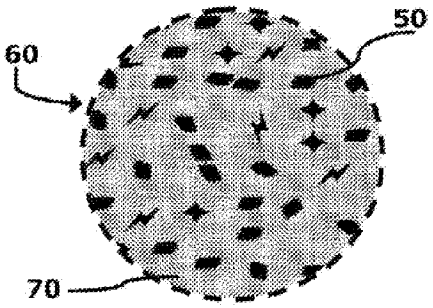
FIG. 8G shows an example pod constitution and corresponding pod-making materials.
Figure 8H:
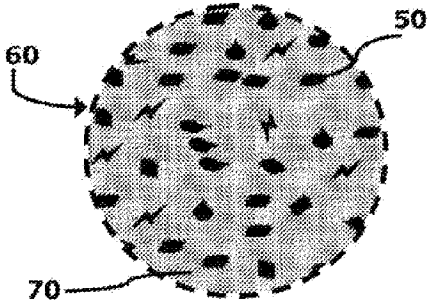
FIG. 8H shows an example pod constitution and corresponding pod-making materials.
Figure 8I:
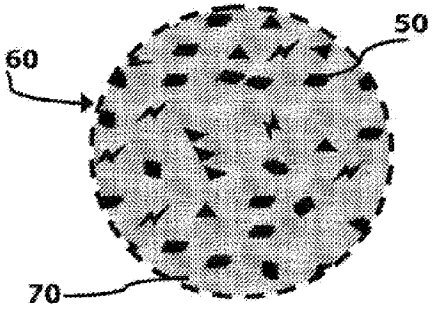
FIG. 8I shows an example pod constitution and corresponding pod-making materials.
Figure 16L:
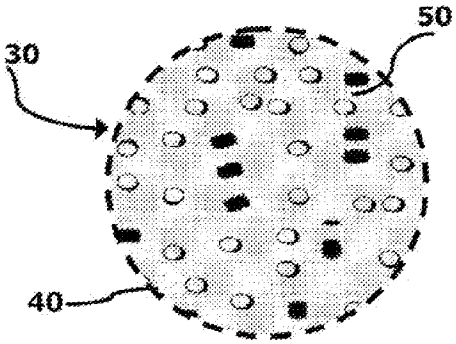
FIG. 16L shows an example pod constitution and corresponding pod-making materials.
Figure 16K:
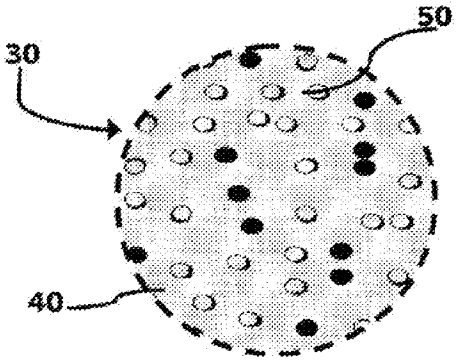
FIG. 16K shows an example pod constitution and corresponding pod-making materials.
Figure 16J:
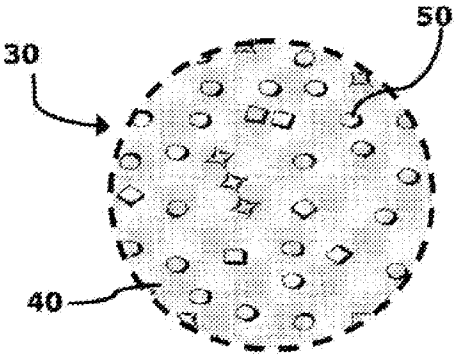
FIG. 16J shows an example pod constitution and corresponding pod-making materials.
Figure 8L:
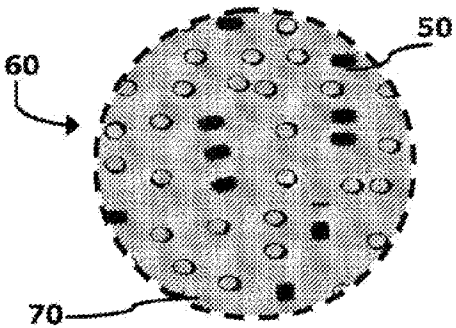
FIG. 8L shows an example pod constitution and corresponding pod-making materials.
Figure 8K:
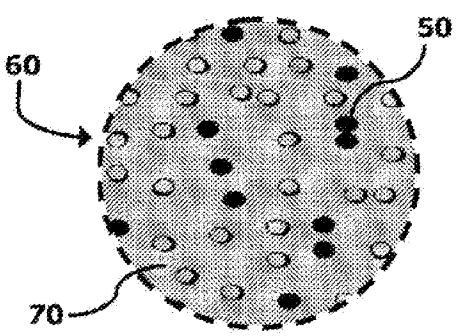
FIG. 8K shows an example pod constitution and corresponding pod-making materials.
Figure 8J:
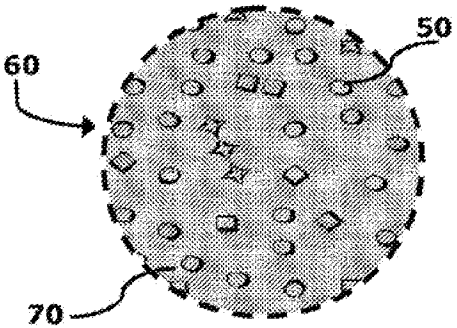
FIG. 8J shows an example pod constitution and corresponding pod-making materials.
Figure 17A:
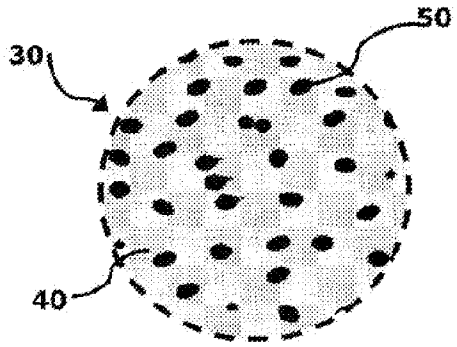
FIG. 17A shows an example pod constitution and corresponding pod-making materials.
Figure 17B:
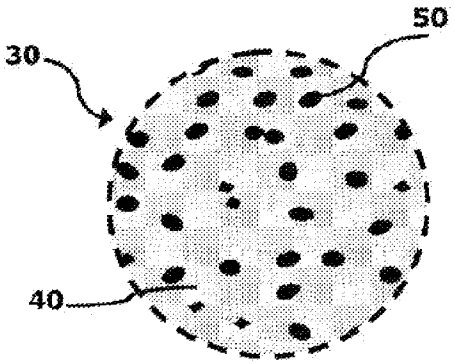
FIG. 17B shows an example pod constitution and corresponding pod-making materials.
Figure 17C:
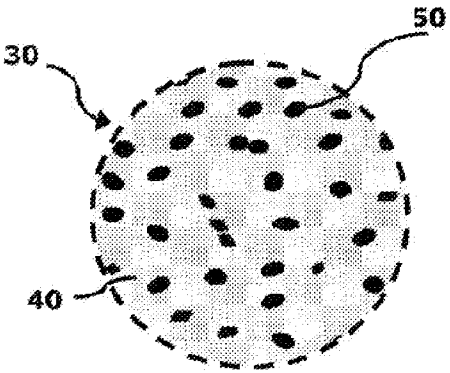
FIG. 17C shows an example pod constitution and corresponding pod-making materials.
Figure 9A:
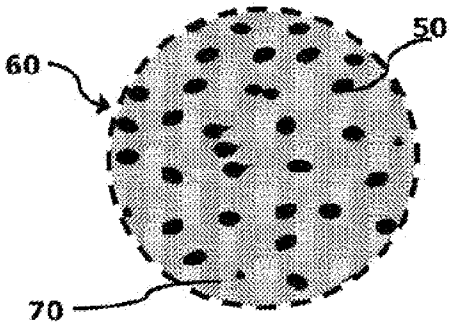
FIG. 9A shows an example pod constitution and corresponding pod-making materials.
Figure 9B:
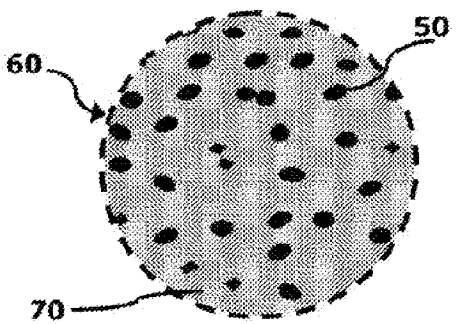
FIG. 9B shows an example pod constitution and corresponding pod-making materials.
Figure 9C:
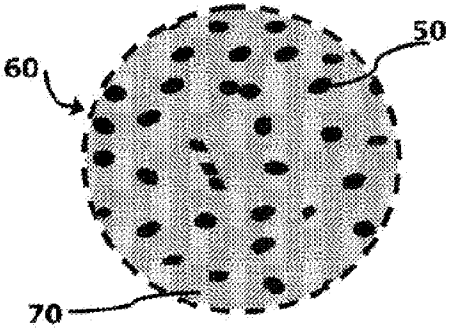
FIG. 9C shows an example pod constitution and corresponding pod-making materials.
Figure 17F:
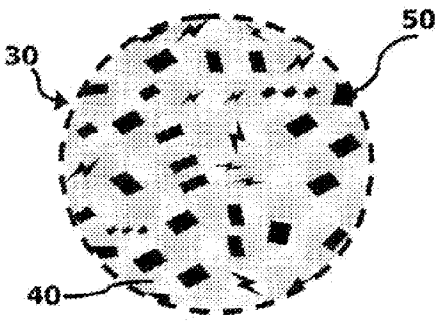
FIG. 17F shows an example pod constitution and corresponding pod-making materials.
Figure 17E:
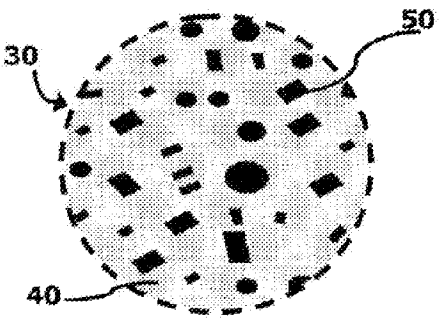
FIG. 17E shows an example pod constitution and corresponding pod-making materials.
Figure 17D:
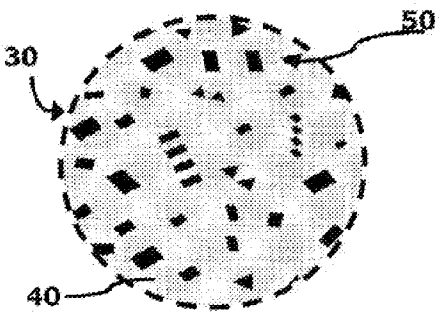
FIG. 17D shows an example pod constitution and corresponding pod-making materials.
Figure 9F:
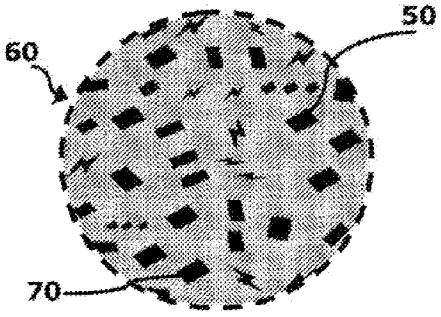
FIG. 9F shows an example pod constitution and corresponding pod-making materials.
Figure 9E:
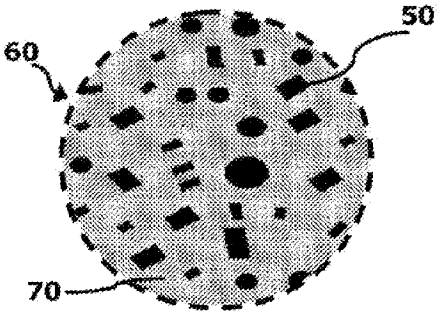
FIG. 9E shows an example pod constitution and corresponding pod-making materials.
Figure 9D:
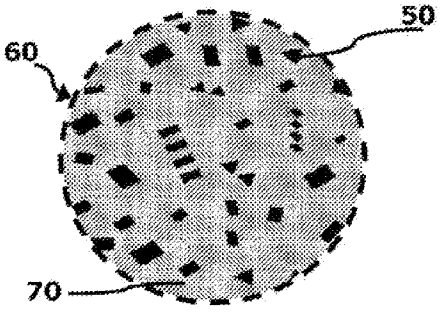
FIG. 9D shows an example pod constitution and corresponding pod-making materials.
Figure 17G:
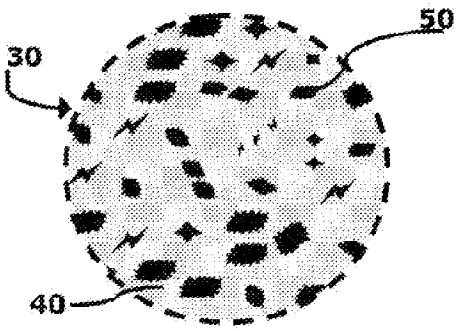
FIG. 17G shows an example pod constitution and corresponding pod-making materials.
Figure 17H:
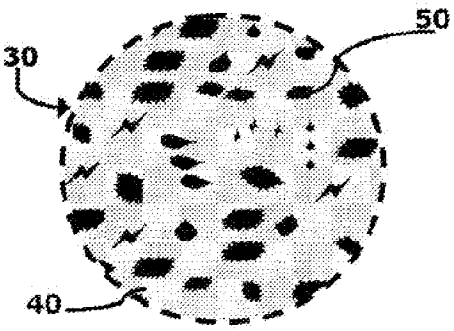
FIG. 17H shows an example pod constitution and corresponding pod-making materials.
Figure 17I:
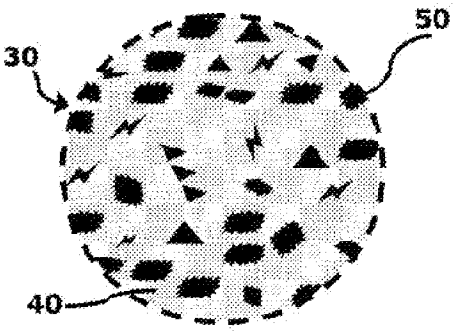
FIG. 17I shows an example pod constitution and corresponding pod-making materials.
Figure 9G:
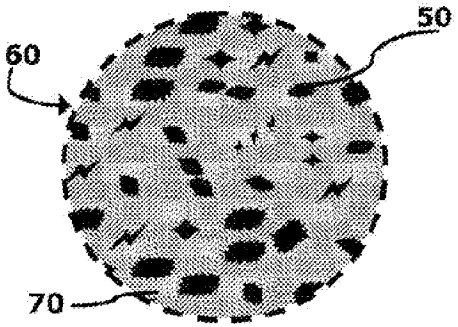
FIG. 9G shows an example pod constitution and corresponding pod-making materials.
Figure 9H:
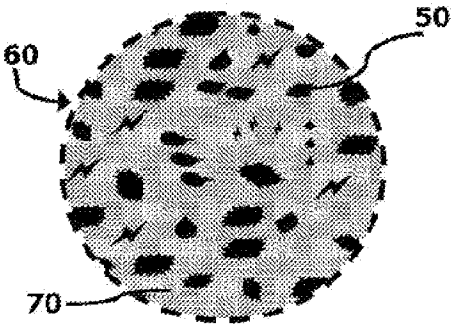
FIG. 9H shows an example pod constitution and corresponding pod-making materials.
Figure 9I:
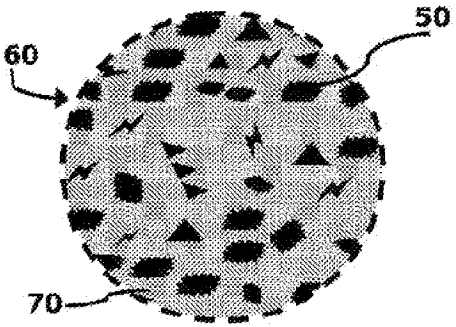
FIG. 9I shows an example pod constitution and corresponding pod-making materials.
Figure 17J:
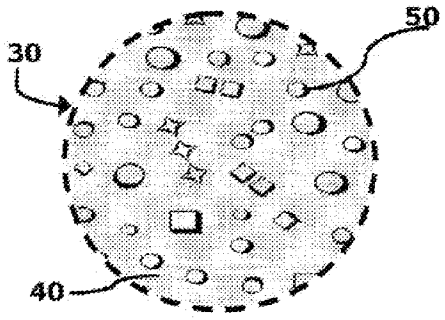
FIG. 17J shows an example pod constitution and corresponding pod-making materials.
Figure 17K:
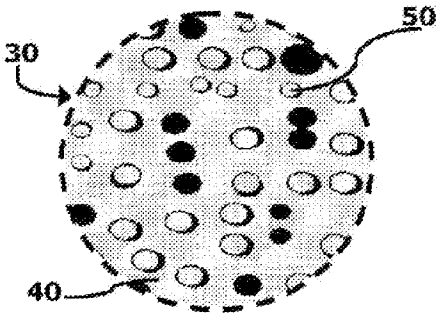
FIG. 17K shows an example pod constitution and corresponding pod-making materials.
Figure 17L:
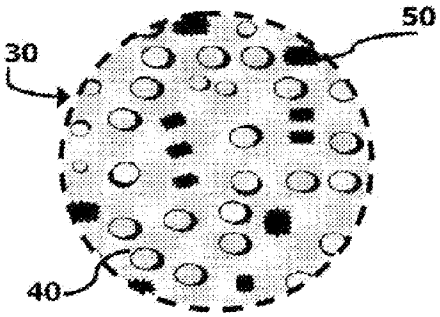
FIG. 17L shows an example pod constitution and corresponding pod-making materials.
Figure 9J:
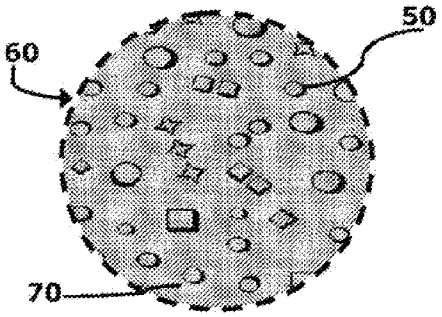
FIG. 9J shows an example pod constitution and corresponding pod-making materials.
Figure 9K:
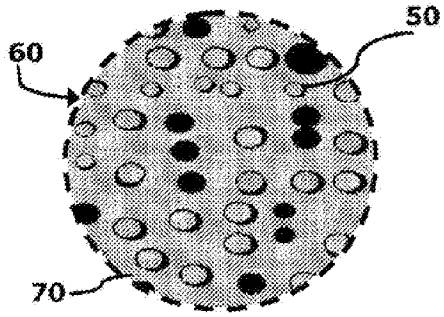
FIG. 9K shows an example pod constitution and corresponding pod-making materials.
Figure 9L:
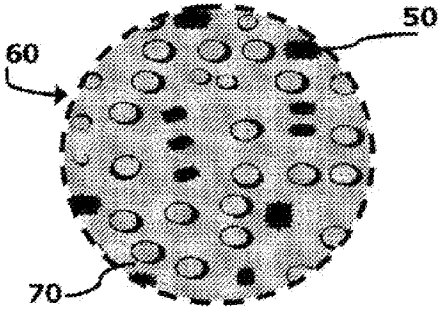
FIG. 9L shows an example pod constitution and corresponding pod-making materials.

The enclosed cavity assemblies 20 shown in the 4th and 5th drawing sets are typical of finished floors in existing buildings. In the floor assembly 20 shown in the 4th drawing set, a hole 28 can be drilled through the continuous sheet 27 and the pod-making material 60 introduced therethrough (FIGS. 4E-4G, 12C, 12D). The hole 28 can later be closed by a distinct plug 29 (FIG. 4J, 12G). Alternatively, the pod-making material 60 can be overflowed into the hole 28 whereby a nub-like projection from the pod 30 seals this opening. (FIGS. 4K-4L, 12H, 12I). In the floor assembly 20 shown in the 5th drawing set, a segment 27 can be removed to allow pod-making-material introduction and then later replaced.

The pods 30 are each produced by fluidly introducing a pod-making material 60 into the cavities. The pod-making material 60 can be, for example, poured into the cavity 26 from a receptacle 61 or the material can be pumped into the cavity 26 with a pump 62. The pod-making material 60 can be formulated to possess a viscosity compatible with the desired cavity-introduction technique. Additionally or alternatively, the fluid-introduction technique can be chosen to accommodate the material's viscosity.

When the cavity 26 is filled with the pod-making material 60, the volume V60 of the material 60 will be at least equal to the volume V26 of the filled cavity 26. In the $2^{nd}$, $4^{th}$, and $5^{th}$ drawing sets, the material's volume V60 will be equal to the cavity's volume V26. In the $3^{rd}$ drawing set, the material's volume V60 will be greater than the cavity's volume V26 because of the upper stratums 31.

The pod-making material 60 comprises a liquid carrier 70 with the pellets 50 disseminated therein. A pod 30 is produced by the liquid carrier 70 solidifying within the cavity 26, with the pellets 50 remaining substantially the same size, shape, and specific weight. The pod's volume V30 will be substantially equal to the volume V60 of the material 60. Thus an installer can accurately predict the size/shape of the pod 30 by the material 60 fluidly introduced.

The pod 30 is also dimensionally stable after installation, with its volume V30 remaining substantially the same (e.g., within 5%, within 4%, within 3%, within 2%, within 1%, etc.) for many years (e.g., at least 5 years, at least 10 years, at least 20 years, etc.). The pods 30 do not substantially settle, contract, expand, swell, or otherwise after. Thus, there will be substantially no sagging, drooping, or bulging of the walkable surface, the filled cavity, and/or the coated structure.

The pods 30 can each have a load-supporting capacity of at least at least 200 psf (at least 10 kPa), at least 300 psf (at least 15 kPa), and/or at least 400 psf (at least 20 kPa).

The lightweight pods 30 can each have a nominal specific gravity of less than about 0.3, less than about 0.2, less than about 0.1.

Additionally or alternatively, the pods 30 can each have a specific gravity of between about 0.01 and about 0.5, and/or between about 0.03 and about 0.3.

The pods 30 can individually or collectively function as a sound attenuator (e.g., it can have a sound transmission coefficient (STC) of at least 30). And agents can be incorporated into the pod 30 to allow it to further act as a flame retardant, smoke suppressant, conductive, non-conductive, and/or organism killers (e.g., biocide, fungicide, insecticide, mildewcide, bactericide, rodentcide, etc.). These adaptations and/or incorporations can be accomplished during formulation of the liquid carrier 40 and/or during production of the pellets 50.

The pellets 50 can collectively account for a significant percent of the pod volume V30 and/or the material volume V60 (e.g., at least 50%, at least 60%, at least 70%, at least 75%, at least 80%, at least 85%, at least 90%, and/or at least 95%). The carrier 40/70 can account for a less significant percentage of these volumes (e.g., less than 5%, less than 10%, less than 20%, less than 30%, less than 40%, and/or less than 50%). The sum of the pellet-percentage and the carrier-percentage will never be greater than 100%, but it can be less if additional items are incorporated into the pod material.

The pod 30 is created in the horizontal or vertical cavity, surface, or coated structure by the liquid carrier 70 solidifying to form the solid binder 40.

The carrier 40/70 can comprise a binder or an adhesive (e.g., epoxy, latex, emulsion, urethane, polyvinyl acetate, polyester, mineral silicate, etc.) or other oleoresinous or water-based systems. Solidification can additionally or alternatively be attained by chemical curing, oxidation, and/or radiation exposure (e.g., ultraviolet or electrobeam).

The pellets 50 comprise a multitude of bodies which would each be a distinct and separable entity if not for the carrier 40/70. Depending upon their shapes, the pellets 50 can also be called beads, microspheres, balls, capsules, particles, granules, grains, chips, chunks, morsels, and other similar terms. The pellet geometry can be such that no one dimension dominates another by more than three-fold and/or five-fold. In the case of the oblong pellets 50 shown in the $2^{nd}$ through $5^{th}$ drawing sets, for example, their axial lengths are not more than three times their central diameters.

As shown in the 6th through 9th (FIGS. 6A to 9L) and the $14^{th}$ through $17^{th}$ (FIGS. 14A to 17L) drawing sets, the pellets 50 can assume many different geometries, including rounded, polygonal, starred, and other regular, semi-regular, and irregular shapes. The pellets 50 can be substantially the same shape and/or substantially the same size, or they can be of different shapes and/or sizes. Additionally or alternatively, the pellets 50 can be solid and/or they can be hollow.

The pellets 50 can have average pellet dimensions of less than about 0.5 inch (about 12 mm), less than about 0.4 inch (about 10 mm), less than about 0.3 inch (about 8 mm), less than about 0.2 inch (about 6 mm), and/or less than about 0.1 inch (about 3 mm). In most cases, the pellets 50 will have average pellet dimensions greater than about 0.075 inch (about 2 mm). And in many cases, the pellets 50 will have average pellet dimensions between about 0.075 inch and about 0.20 inch (about 2 mm and 6 mm).

If the pellets 50 are hollow microspheres or other similar micro particles, their dimensions will be much smaller than set forth in the preceding paragraph. A suitable glass, silicate, mineral or ceramic microsphere could have an average particle size of 150 microns, 70 microns, 40 microns and/or 10 microns, for example.

The pellets 50 can have a low specific gravity (e.g., less than 0.30, less than 0.20, less than 0.10, less than 0.05, less than 0.04, less than 0.03, less than 0.02, less than 0.01, etc.) so as to achieve a light-weight pod in spite of a heavy carrier 40/70.

The pellets 50 can comprise expanded polymer, expanded mineral, expanded ceramic, biomass, crumb rubber, polymeric scrap materials, and combinations thereof. The preferred form of the pellets 50 can comprise, for example, mufti-cellular and/or closed cell polymer beads or hollow microspheres.

As was indicated above, the pellets 50 remain substantially the same size, shape, and specific gravity when the liquid carrier 70 solidifies to form the pod 30. To this end, the pellets 50 can be non-porous with respect to the carrier 40/70. Non-porosity can be accomplished by pellet composition, pellet formation, non-porous coating, or any other suitable technique.

Although the building 10, the floor assembly 20, the pod 30, the solidified carrier 40, the pellets 50, the material 60, and/or the liquid carrier 70 have been have been shown and described as having certain forms and fabrications, such portrayals are not quintessential and represent only some of the possible of adaptations of the claimed characteristics. Other obvious, equivalent, and/or otherwise akin embodiments could instead be created using the same or analogous attributes. For example, although the building 10 was depicted as a residential home with an attic 12, the floor assembly 20 can be integrated into other buildings and non-buildings with walkable surfaces 21 (e.g., patios, sidewalks, roads, vehicles, etc.).

Additionally or alternatively, although the walkable surface 21 was portrayed primarily as horizontal, non-vertical sloped orientations are also possible and probable, such as with ramps and slides, as well as vertical wall structures, surfaces, and cavities. The pod material is supplied as a pumpable or sprayable insulation product having obvious advantages as a structurally stable and durable composition. Other uses could include housings for HVAC equipment, machinery, industrial storage tanks, process tanks, pressure vessels, transportation vehicles, and pipelines.

The invention claimed is:

1. A structural assembly having a surface and an insulating stratum below the surface, said assembly comprising structural members and one or more pod or pods disposed between the structural members;

wherein the one or more pod or pods comprises a solidified carrier and pellets dispersed within the solidified carrier, wherein the solidified carrier comprises a material selected from the group consisting of epoxy, latex, emulsion, urethane, polyvinyl acetate, polyester, and mineral silicate;

wherein the one or more pod or pods occupy at least some of a plurality of cavities in a floor, the plurality of cavities being arranged in a grid formed by the structural members;

wherein the one or more pod or pods structurally contributes to a load-supporting capacity of the surface and insulating potential of the stratum; and wherein the one or more pod or pods, comprising the solidified carrier and the pellets dispersed within the solidified carrier, along with the structural members are non-covered and define the surface at a top of the plurality of cavities, the load-supporting capacity of the surface is at least 400 pounds per square foot (psf).

2. The structural assembly as set forth in claim 1, wherein the one or more pod or pods adapts to the shape of a respective cavity or plurality of cavities or the surface.

3. The structural assembly as set forth in claim 1, wherein the one or more pod or pods is dimensionally stable after installation, with a volume (V30) of the one or more pod or pods remaining the same.

4. The structural assembly as set forth in claim 3, wherein the volume (V30) of the one or more pod or pods remains within 10% of an installation volume of the one or more pod or pods.

5. The structural assembly as set forth in claim 1, wherein the one or more pod or pods has a nominal specific gravity of less than about 0.30.

6. The structural assembly as set forth in claim 1, wherein the one or more pod or pods also functions as thermal insulation and a sound attenuator.

7. The structural assembly as set forth in claim 1, wherein the one or more pod or pods has an R value of at least 2.

8. The structural assembly as set forth in claim 1, wherein the one or more pod or pods has a sound transmission coefficient (STC) factor of at least 30.

9. The structural assembly as set forth in claim 1, wherein the one or more pod or pods incorporates fire-retardant, smoke-suppressant, conductive, non-conductive or organism-killing agents.

10. The structural assembly as set forth in claim 1, wherein the pellets collectively account for at least 50% of a volume (V30) of the one or more pod or pods.

11. The structural assembly as set forth in claim 1, wherein the solidified carrier accounts for less than 50% of a volume (V30) of the one or more pod or pods.

* * * * *

UNITED STATES PATENT AND TRADEMARK OFFICE

CERTIFICATE OF CORRECTION

PATENT NO. : 9,222,254 B2
APPLICATION NO. : 13/795155
DATED : December 29, 2015
INVENTOR(S) : Schabel, Jr.

It is certified that error appears in the above-identified patent and that said Letters Patent is hereby corrected as shown below:

Title Page, in item (73) titled Assignee: please delete "SCabel Polymer Technology, LLC" and insert therefor --Schabel Polymer Technology, LLC--

Title Page, in item (73) titled Assignee: please delete "Rocky River" and insert therefor --Rocky River, OH (US)--

Signed and Sealed this
Fifth Day of July, 2016

Michelle K. Lee

Michelle K. Lee
*Director of the United States Patent and Trademark Office*